US006692905B2

(12) United States Patent
Kobayashi et al.

(10) Patent No.: US 6,692,905 B2
(45) Date of Patent: Feb. 17, 2004

(54) METHINE COMPOUND-CONTAINING SILVER HALIDE PHOTOGRAPHIC EMULSION AND PHOTOGRAPHIC MATERIAL USING THE SAME

(75) Inventors: Katsumi Kobayashi, Kanagawa (JP); Takanori Hioki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 279 days.

(21) Appl. No.: 09/848,341

(22) Filed: May 4, 2001

(65) Prior Publication Data

US 2002/0012892 A1 Jan. 31, 2002

(30) Foreign Application Priority Data

May 12, 2000 (JP) ..... P2000-140205

(51) Int. Cl.[7] ..... G03C 1/005; G03C 1/494

(52) U.S. Cl. ..... 430/584; 430/583; 430/588; 430/576

(58) Field of Search ..... 430/583, 584, 430/588, 576

(56) References Cited

U.S. PATENT DOCUMENTS 6,117,629 A * 9/2000 Yamashita et al. ..... 430/570
6,180,332 B1 * 1/2001 Yamashita et al. ..... 430/574
6,242,170 B1 * 6/2001 Pepe et al. ..... 430/583
6,245,497 B1 * 6/2001 Eikenberry et al. ..... 430/570
6,387,610 B1 * 5/2002 Yamashita et al. ..... 430/574
6,428,947 B1 * 8/2002 Johnston et al. ..... 430/505
6,498,004 B1 * 12/2002 Lenhard et al. ..... 430/583
6,509,144 B1 * 1/2003 Reed et al. ..... 430/577

FOREIGN PATENT DOCUMENTS

JP A-2001-152038 6/2001

* cited by examiner

*Primary Examiner*—Geraldine Letscher
(74) *Attorney, Agent, or Firm*—Sughrue Mion, PLLC

(57) ABSTRACT

A silver halide photographic emulsion comprising a methine dye compound having in a molecule thereof at least one atomic group in which at least two groups selected from the group consisting of groups represented by formulas (I) and (II) are adjacent to each other or adjacent to each other through an atom:

X—H (I)

wherein X represents an atom electrically more negative than a carbon atom,

Y (II)

wherein Y represents an atom electrically more negative than a carbon atom, and has one or more lone electron pairs; and a silver halide photographic material comprising the silver halide photographic emulsion.

18 Claims, No Drawings

METHINE COMPOUND-CONTAINING SILVER HALIDE PHOTOGRAPHIC EMULSION AND PHOTOGRAPHIC MATERIAL USING THE SAME

FIELD OF THE INVENTION

The present invention relates to a spectrally sensitized silver halide photographic emulsion and a photographic material using the same.

BACKGROUND OF THE INVENTION

Great efforts have hitherto been made to increase the sensitivity of silver halide photographic materials. In silver halide photographic emulsions, sensitizing dyes adsorbed onto surfaces of silver halide grains absorb light incident on photographic materials, and transmit its light energy to the silver halide grains, thereby giving light sensitivity. Accordingly, in spectral sensitization of silver halides, it is conceivable that the light energy transmitted to the silver halides can be increased by increasing the light absorptivity of the silver halide grains per unit grain surface area, thus achieving an increase in spectral sensitivity. Improvement in the light absorptivity of the surfaces of the silver halide grains only requires an increase in the adsorption of the spectral sensitizing dyes per unit grain surface area.

However, the adsorption of the sensitizing dyes onto the surfaces of the silver halide grains have a limitation, and it is difficult to allow more dye chromophoric groups than those in monolayer saturated adsorption (namely, one layer adsorption) to be adsorbed. In the present state, therefore, the absorptivity of incident light quanta of the individual silver halide grains in a spectral sensitizing region is still low.

For solving such problems, the following proposals have been submitted.

P. B. Gilman, Jr. et al. allowed a cationic dye to be adsorbed by a first layer, and further allowed an anionic dye to be adsorbed by a second layer using an electrostatic force in *Photographic Science an Engineering,* 20 (3), 97 (1976).

G. B. Bird et al. allowed a plurality of dyes to be adsorbed onto a silver halide in multiple layers to sensitize it by contribution of Forster type excitation energy transfer in U.S. Pat. No. 3,622,316.

Sugimoto et al. conducted spectral sensitization by the transfer of energy from a luminous dye in JP-A-63-138341 (the term "JP-A" as used herein means an "unexamined published Japanese patent application") and JP-A-64-84244.

R. Steiger et al. tried spectral sensitization by the transfer of energy from a gelatin-substituted cyanine dye in *Photographic Science and Engineering,* 27 (2), 59 (1983).

Ikekawa et al. conducted spectral sensitization by the transfer of energy from a cyclodextrin-substituted dye in JP-A-61-251842.

Further, Richard Burton et al. allowed a cationic dye and an anionic dye to be adsorbed in multiple layers, and tried to increase the sensitivity by the transfer of energy from the dye in a second layer to the dye in a first layer in EP-A-0985964, EP-A-0985965, EP-A-0985966 and JP-A-0985965.

In these methods, however, the sensitizing dyes were actually insufficiently adsorbed in multiple layers by the surfaces of the silver halide grains, so that the effect of increasing the sensitivity was very little. It has been therefore demanded that the interaction among dye molecules are enhanced to realize substantially effective adsorption in multiple layers.

On the other hand, when the sensitizing dyes are adsorbed on the grain surfaces in multiple layers, the grains have been proved to easily aggregate in some cases because the adsorption of gelatin is decreased to lower protective colloid ability. Accordingly, a technique for allowing the sensitizing dyes to be adsorbed in multiple layers and inhibiting aggregation of the grains has been desired.

We have already discovered a method of using aromatic group-containing dyes, or aromatic group-containing cationic dyes in combination with anionic dyes, as one method for achieving this object, wherein these dyes are described in JP-A-10-239789, JP-A-8-269009, JP-A-10-123650 and JP-A-8-328189. However, this method has problems with regard to increased dye residual color after processing, compared with conventional sensitizing dyes, and keeping quality (i.e., storage stability), because the cationic dyes high in hydrophobicity are used as the sensitizing dyes.

SUMMARY OF THE INVENITON

It is therefore an object of the present invention to provide a silver halide photographic emulsion inhibiting aggregation of grains and high in sensitivity.

Another object of the present invention is to provide a silver halide photographic material using the same, particularly a silver halide photographic material in which dye residual color after processing is inhibited.

Methine dyes used in the present invention are expected to be useful for other photoelectronic functional materials, as well as the silver halide photographic materials.

Such methine dyes are:

(1) A methine dye compound having at least one group represented by the following formula (I) or (II) in a molecule thereof:

$$X—H \quad (I)$$

wherein X represents an atom electrically more negative than a carbon atom, $$Y \quad (II)$$

wherein Y represents an atom electrically more negative than a carbon atom, and has one or more lone electron pairs;

(2) A methine dye compound having at least two groups selected from the group consisting of groups represented by the above formulas (I) and (II) in a molecule thereof;

(3) A methine dye compound having in a molecule thereof at least one atomic group in which at least two groups selected from the group consisting of groups represented by the above formulas (I) and (II) are adjacent to each other or adjacent to each other through a carbon atom or another atom;

(4) A methine dye compound having in a molecule thereof at least one atomic group in which at least three groups selected from the group consisting of groups represented by the above formulas (I) and (II) are adjacent to each other or adjacent to each other through a carbon atom or another atom;

(5) The methine dye compound described in the above (4), wherein the atomic group is other than an atomic group represented by the following formula (III), (IV) or (V):

(III)

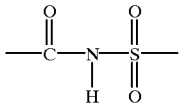

(VI)

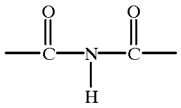

(V)

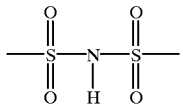

(6) A methine dye compound having in a molecule thereof at least one atomic group in which at least four groups selected from the group consisting of groups represented by the above formulas (I) and (II) are adjacent to each other or adjacent to each other through a carbon atom or another atom;

(7) The methine compound described in any one of (1) to (6), which further has in a molecule thereof at least one aromatic group not conjugated with a dye chromophoric group;

(8) The methine compound described in any one of (1) to (7), which has a basic nucleus obtained by cyclocondensation of three or more rings;

(9) The methine compound described in any one of (1) to (8), which is a cyanine dye;

(10) The methine compound described in (9), wherein the atomic group containing at least one group represented by formula (I) or (II) described in any one of (1) to (6) is contained in a group substituted at the N-position;

(11) The methine compound described in (9), wherein the atomic group containing at least one group represented by formula (I) or (II) described in any one of (1) to (6) is contained in a nucleus substituent group; and

(12) The methine compound described in (9), wherein the atomic group containing at least one group represented by formula (I) or (II) described in any one of (1) to (6) is contained in a group substituted at the meso-position.

According to the present invention, there are provided:

(13) A silver halide photographic emulsion comprising at least one methine dye compound described in any one of the above (1) to (12);

(14) A silver halide photographic emulsion which is spectrally sensitized with at least one kind of sensitizing dye having a site which can form three or more complementary hydrogen bonds between molecules of a single or more kinds of dyes;

(15) The silver halide photographic emulsion described in (14), wherein at least one kind of sensitizing dye having a site which can form three or more complementary hydrogen bonds between molecules of a single or more kinds of dyes used in the silver halide photographic emulsion described in the above (14) is positioned in a near relation that three or more hydrogen bonding groups in a molecule are within seven or less covalent bonds;

(16) The silver halide photographic emulsion described in (14) or (15), wherein at least one methine dye compound having at least one structure site represented by the following formula (VI) in a molecule thereof as a substituent group is used in combination with at least one methine dye compound having at least one structure site represented by the following formula (VII) in a molecule thereof as a substituent group.

(VI)

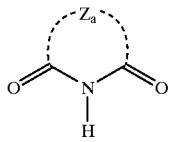

wherein Za represents an atomic group necessary to form a 5-or 6-membered nitrogen-containing heterocyclic ring, (VII)

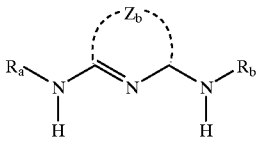

wherein Zb represents an atomic group necessary to form a 5-or 6-membered nitrogen-containing heterocyclic ring, and Ra and Rb each represents a hydrogen atom or a substituent group;

(17) The silver halide photographic emulsion described in the above (16), wherein the nitrogen-containing heterocyclic ring formed by Za represented by the above formula (VI) is barbituric acid or cyanuric acid;

(18) The silver halide photographic emulsion described in the above (16),wherein the nitrogen-containing heterocyclic ring formed by Zb represented by the above formula (VII) is melamine;

(19) The silver halide photographic emulsion described in any one of the above (13) to (18), wherein the sensitizing dye is adsorbed in multiple layers on surfaces of silver halide grains contained in the emulsion;

(20) The silver halide photographic emulsion described in the above (19), wherein adsorption energy ($\Delta G$) of the dye contained in a second and later layers is 20 kJ/mol or more;

(21) The silver halide photographic emulsion described in the above (19) or (20), wherein excitation energy of the dye contained in the second and later layers is transferred to the dye contained in the first layer at an efficiency of 10% or more;

(22) The silver halide photographic emulsion described in any one of the above (13) to (21), wherein all dyes adsorbed on surfaces of silver halide grains contained in the first and later layers show J-band absorption;

(23) The silver halide photographic emulsion described in any one of the above (13) to (22), wherein silver halide grains having a spectral absorption maximum wavelength of less than 500 nm and a light absorption intensity of 60 or more, or a spectral absorption maximum wavelength of 500 nm or more and a light absorption intensity of 100 or more are contained;

(24) The silver halide photographic emulsion described in any one of the above (13) to (23), wherein when the maximum value of spectral absorptivity due to the sensitizing dye of the emulsion is taken as Amax, the wavelength distance between the shortest wavelength showing 50% of Amax and the longest wavelength is 120 nm or less;

(25) The silver halide photographic emulsion described in any one of the above (13) to (23), wherein when the maximum value of spectral sensitivity due to the sensitizing dye of the emulsion is taken as Smax, the wavelength distance between the shortest wavelength showing 50% of Smax and the longest wavelength is 120 nm or less;

(26) The silver halide photographic emulsion described in the above (24), wherein when the maximum value of spectral absorptivity due to the sensitizing dye of the emulsion is taken as Amax, the wavelength distance between the shortest wavelength showing 80% of Amax and the longest wavelength is 20 nm or more, and the wavelength distance between the shortest wavelength showing 50% of Amax and the longest wavelength is 120 nm or less;

(27) The silver halide photographic emulsion described in the above (25), wherein when the maximum value of spectral sensitivity due to the sensitizing dye of the emulsion is taken as Smax, the wavelength distance between the shortest wavelength showing 80% of Smax and the longest wavelength is 20 nm or more, and the wavelength distance between the shortest wavelength showing 50% of Smax and the longest wavelength is 120 nm or less;

(28) The silver halide photographic emulsion described in any one of the above (13) to (27), wherein Smax is from 400 nm to 500 nm, or from 500 nm to 600 nm, or from 600 nm to 700 nm, or 700 nm to 1000 nm;

(29) The silver halide photographic emulsion described in the above (28), wherein the longest wavelength showing a spectral absorptivity of 50% of Amax is from 460 nm to 510 nm, or from 560 nm to 610 nm, or from 640 nm to 730 nm;

(30) The silver halide photographic emulsion described in the above (28) or (29), wherein the longest wavelength showing a spectral sensitivity of 50% of Smax is from 460 nm to 510 nm, or from 560 nm to 610 nm, or from 640 nm to 730 nm;

(31) The silver halide photographic emulsion described in any one of the above (13) to (30), wherein 50% or more (area) of the whole silver halide grains contained in the emulsion are tabular grains having an aspect ratio of 2 or more;

(32) The silver halide photographic emulsion described in any one of the above (13) to (31), which is subjected to selenium sensitization;

(33) The silver halide photographic emulsion described in any one of the above (13) to (32), wherein the silver halide grains contain a silver halide absorptive compound other than the sensitizing dye;

(34) The silver halide photographic emulsion described in any one of the above (13) to (33), wherein the methine dye compound used in the emulsion, which is described in any one of (1) to (12), is subjected to J-association;

(35) The silver halide photographic emulsion described in any one of the above (13) to (34), wherein the methine dye compound used in the emulsion, which is described in any one of (1) to (12), is subjected to J-association in a 10% or less aqueous solution of gelatin; and

(36) A silver halide photographic material comprising at least one layer containing the silver halide photographic emulsion described in any one of the above (13) to (35).

DETAILED DESCRIPTION OF THE INVENTION

The present invention will be described below in more detail.

The methine compounds used in the present invention will be illustrated below in detail.

First, X and Y contained in common in the methine compounds used in the present invention each represents an atom electrically more negative than a carbon atom. X and Y include in common an oxygen atom, a nitrogen atom, a fluorine atom and a chlorine atom. Preferred are an oxygen atom, a nitrogen atom and a chlorine atom, and more preferred are an oxygen atom and a nitrogen atom. These atoms originally have lone electron pairs, so that they can form groups represented by formula (II) as Y as such, except for the case where the lone electron pairs combine with others to be positively charged. The atomic groups containing such groups represented by formula (II) include, for example, a carbonyl group, an amino group, an imino group, a cyano group, an alkoxyl group, a hydroxyl group, a chloro group and a fluoro group. On the other hand, groups represented by formula (I) are groups in which hydrogen atoms combine with the above-described electrically negative atoms X, and such groups include a hydroxyl group and primary and secondary amino groups.

Naturally from the nature thereof, these groups are included in the groups represented by formula (II), except for the case where the lone electron pairs combine with others to be positively charged. Of course, an ester group, a carboxyl group, an amido group, an acetal group, a 1,2-diketone group and a ureido group formed by bonding of the plurality of groups represented by formula (I) or (II) can be said to be the atomic groups containing the groups represented by formula (I) or (II). As an embodiment of the present invention, it is preferred that two or more groups represented by formula (I) or (II) are contained in a methine dye molecule, and it is more preferred that the plurality of groups represented by formula (I) or (II) are present in positions close to each other in the methine dye molecule as the atomic group formed by bonding thereof.

Still more preferred is the case where the methine dye compound has in a molecule thereof at least one atomic group in which at least two groups selected from groups represented by formulas (I) and (II) (hereinafter, "selected from groups" is omitted) are adjacent to each other or adjacent to each other through a carbon atom or another atom.

The atomic groups in which two groups represented by formulas (I) and (II) are adjacent to each other or adjacent to each other through a carbon atom or another atom include a hydroxyamino group, an alkoxyamino group, an oxime group, a hydrazino group, a nitroso group, an amido group, an alkoxycarbonyl group, a carboxyl group, a chlorocarbonyl group, an iminoether group, an aminohydroxymethyl group, an oxazole group, an imidazole group, a pyridone ring, a 2-aminopyridino group, an oxopyrrolidine ring, a 2-thiazolidinone ring, a sulfonyl group, an alkoxythiocarbonylamino group and a thioureido group. Preferred are an amido group, an alkoxycarbonyl group, a carboxyl group, a chlorocarbonyl group, an iminoether group, an aminohydroxymethyl group, an oxazole group, an imidazole group, a pyridone ring, a 2-aminopyridino group, an oxopyrrolidine ring, a 2-thiazolidinone ring and a sulfonyl group, and more preferred are an amido group, an alkoxycarbonyl group, a carboxyl group, an aminohydroxymethyl group, an oxazole group, an imidazole group, a pyridone ring, a 2-aminopyridino group and an oxopyrrolidine ring.

The atomic groups in which three groups represented by formulas (I) and (II) are adjacent to each other or adjacent to each other through a carbon atom or another atom include urea, a carboxylic acid anhydride, a sulfonic acid ester, a sulfonic acid amide, an alkoxycarbonylamino group, a carbamoyloxy group, an orthoester group, a carbonylhydrazino group, a 2-oxazolidinone ring, a 2-imidazolidinone ring, a carbonic acid ester group, a triazane group, a triazene group, a 2,6-diaminopyridino group, a 2-aminopyrimdino group, a 2-(acylamino)pyridino group and acylthiourea. Such atomic groups are preferably urea, a sulfonic acid ester, a sulfonic acid amide, an alkoxycarbonylamino group, a carbamoyloxy group, a carbonylhydrazino group, a 2-oxazolidinone ring, a 2-imidazolidinone ring and a carbonic acid ester group.

Further, the atomic groups in which four groups represented by formulas (I) and (II) are adjacent to each other or adjacent to each other through a carbon atom or another atom include a cyclic or chain diacylhydrazido group, a cyclic or chain acylurea, uracil, oxazolidinedione, a tetraaminomethylene group and (pyridine-2-yl)urea, and preferred are a cyclic or chain diacylhydrazido group and a cyclic or chain acylurea.

Furthermore, the atomic groups in which five groups represented by formulas (I) and (II) are adjacent to each other or adjacent to each other through a carbon atom or another atom include barbituric acid, an azodicarboxylic acid monoester and diester, melamine, parabanic acid, 2,6-(diacylamino) pyridine, carbamoylurea and acylcarbamoylurea, and preferred are barbituric acid, melamine, parabanic acid, 2,6-(diacylamino)pyridine, carbamoylurea and acylcarbamoylurea.

Of the atomic groups in which at least two groups represented by formulas (I) and (II) are adjacent to each other or adjacent to each other through a carbon atom or another atom, preferred are the above-described atomic groups in which at least three groups represented by formulas (I) and (II) are adjacent to each other or adjacent to each other through a carbon atom or another atom, and more preferred are the atomic groups in which at least four groups represented by formulas (I) and (II) are adjacent to each other or adjacent to each other through a carbon atom or another atom. Particularly preferred examples thereof include a urea group and an acylurea group.

The hydrogen bond exists between an electrically negative atom (for example, O, N, F or Cl) and a hydrogen atom covalently bonded to a similarly electrically negative atom. The theoretical interpretation of the hydrogen bond is reported, for example, in H. Uneyama and Kmorokuma, *Journal of American Chemical Society,* 99, 1316–1332 (1977). Specific forms of the hydrogen bonds include a form described in J. N. Israerachiviri, translated by Tamotsu Kondo and Hiroyuki Oshima, Intermolecular Force and Surface Force, page 98, FIG. 17, McGraw-Hill (1991). Specific examples of the hydrogen bonds include, for example, one described in G. R. Desiraju, *Angewante Chemistry International Edition English,* 34, 2311 (1995).

In the present invention, sensitizing dyes each having at least three groups which can form the above-described hydrogen bonds, that is to say, electrically negative atoms (for example, O, N, F and Cl, these are hereinafter referred to as adaptor (A)), or hydrogen atoms covalently bonded thereto (for example, OH and NH, these are hereinafter referred to as donor (D)) are used alone or as a combination of a plurality of them in the single silver halide emulsion, and three or more complementary hydrogen bonds can be formed between the same or different dye molecules. The term "complementary hydrogen bonds" means a combination of hydrogen bonds whose bonding force becomes stronger than mere addition of a plurality of hydrogen bonds by simultaneous formation thereof. However, this is an abstract conception, and it is actually impossible to measure and compare the hydrogen bonding force in a silver halide emulsion. For allowing the individual hydrogen bonds to act complementarily, it is effective that the individual hydrogen bonding groups are present in positions relatively close to each other in each molecule. In the present invention, therefore, of the three or more hydrogen bonding groups, for all hydrogen bonding groups (the donor and acceptor may be any), when the bonds between one and at least one of the other hydrogen bonding groups (the donor and acceptor may be any) is within the distance of 10 bonds or less, it is defined to be the complementary hydrogen bond. In the present invention, the distance is preferably 7 bonds or less, more preferably 5 bonds or less and particularly preferably 3 bonds or less.

The three or more complementary hydrogen bonding groups (a site which can form a complementary hydrogen bond) may be used in combination with another intermolecular force other than hydrogen bond. Examples of the other intermolecular forces include a van der Waals force (more closely, it can be classified into a orientation force acting between a permanent dipole and a permanent dipole, an induction force acting between a permanent dipole and an induction dipole, and a dispersion force acting between a temporary dipole and an induction dipole), a charge transfer force (TC), a Coulomb force (electrostatic force), a hydrophobic bonding force, an NH/n interaction (M. Oki, K. Mutai, *Bull. Chem. Soc. Jpn.,* 33, 784 (1960); M. Oki, K. Mutai, *Bull. Chem. Soc. Jpn.,* 38, 387 (1965); M. Oki, K. Mutai, *Bull. Chem. Soc. Jpn.,* 39, 809 (1966); D. A. Rodham et al., *Nature,* 362, 735 (1993)), an OH/n interaction (Michinori Oki, *Kagaku no Ryoiki,* 113, 389 (1959); Shu Iwamura, *Kagaku to Kogyo,* 17, 617 (1964); J. L. Atwood et al., *Nature,* 349, 683 (1991), F. H. Allen et al., *J. Am. Chem. Soc.,* 118, 4081 (1996); M. A. Visawamitra et al., *J. Am. Chem. Soc.,* 115, 4868 (1993)), a CH/n interaction (for example, Y. Iitaka et al., *J. Chem. Soc., Chem. Commun.,* 389 (1974)), a CH/n interaction (for example, J. A. R. p. Sarma et al., *J. Chem. Soc., Perkin Trans.,* 2, 461 (1992)), a covalent bonding force (chemical bonding force) and a coordination bonding force.

At present, many studies directed toward construction of higher-order structures of molecules have been made using the complementary hydrogen bonds (for example, J. Rebeck, Jr., *Acc. Chem. Res.,* 23, 399 (1990); S. Tirumala, J. T. Davis, *J. Am. Chem. Soc.,* 119, 2769 (1997); A. Galan et al., *J. Am. Chem. Soc.,* 114, 1511 (1992); J. M. Lehn et al., *J. Chem. Soc., Perkin Trans.,* 2, 461 (1992); K. Kurihara et al., *J. Am. Chem. Soc.,* 113 5077 (1991)). As the forms of the complementary hydrogen bonds, ones described therein are also preferred in the present invention. Preferred examples of the compounds having complementary hydrogen bond (formable) sites include barbituric acid, cyanuric acid, uracil, maleimide, succinimide, phthalimide, cytosine, guanine, pterin, melamine, 2,6-diaminopyridine and 2,6-diaminotriazine. Particularly preferred are barbituric acid, cyanuric acid and melamine.

In the present invention, the dyes are used in which the complementary hydrogen bond (formable) sites as described above are bonded to the sensitizing dye molecules by covalent bonds. The complementary hydrogen bond sites and the sensitizing dye sites may be combined with each other at any positions, and connecting chains as indicated by La described later may be introduced between both. When there is a possibility that three or more complementary hydrogen bonds can be theoretically formed from only a combination of the donor and the acceptor, it shall be considered to be contained within the scope of the present invention, even though it cannot be experimentally confirmed.

The sensitizing dyes used in the present invention are preferably methine dye compounds.

Structural sites represented by formulas (VI) and (VII) will be illustrated below which can be described as preferred examples of the complementary hydrogen bond sites contained in the methine dye compounds used in the present invention. Preferred examples thereof include barbituric acid, cyanuric acid, uracil, maleimide, succinimide, phthalimide and urazole. They may have substituent groups, and examples of the substituent groups include ones described as examples of substituent groups V described later. Preferred are barbituric acid, cyanuric acid, uracil, succinimide and phthalimide, which may have substituent groups, and more preferred are barbituric acid and cyanuric acid, which may have substituent groups.

Although the 5- or 6-membered nitrogen-containing heterocyclic rings formed by Zb in formula (VII) may be any, preferred examples thereof include melamine, 2,6-diaminopyridine and 2,6-diaminotriazine. They may have substituent groups, and examples of the substituent groups include ones described as examples of substituent groups V described later. Preferred are melamine and 2,6-diaminopyridine, which may have substituent groups, and more preferred is melamine which may have a substituent group.

Ra and Rb each represents a hydrogen atom or a substituent group, and examples thereof include ones described as examples of substituent groups V described later. Preferred examples of Ra and Rb include a hydrogen atom, an alkyl group, an acyl group, a sulfonyl group, an aryl group and an alkenyl group. More preferred are a hydrogen atom, an alkyl group, an acyl group, a sulfonyl group and an aryl group, and particularly preferred are a hydrogen atom, an acyl group and a sulfonyl group. Most preferred examples of Ra and Rb are a hydrogen atom, a methyl group and an acetyl group.

The silver halide photographic materials of the present invention will be described below, and the compounds used in the present invention will be described in more detail.

The composition, structure and form of the silver halide photographic material of the present invention may be any, as long as it has at least one methine compounds of the present invention. The limitation of the form of the specific silver halide photographic material permissible in the present invention will be described later. Only the preferred form is described herein. Of course, the present invention is not limited thereto.

The term "light absorption intensity" as used in the present invention means the light absorption area intensity due to a sensitizing dye per unit grain surface area, and is defined as a value obtained by integrating the optical density $\mathrm{Log}(I_0/(I_0-I)$ to the wave number ($cm^{-1}$), when the amount of light incident to unit surface area of a grain is taken as $I_0$, and the amount of the sensitizing dye absorbed by the surface is taken as I. The integration range is from 5000 $cm^{-1}$ to 35000 $cm^{-1}$.

The silver halide photographic material according to the present invention preferably contains silver halide grains having a light absorption intensity of 100 or more, for grains having a spectral absorption maximum wavelength of 500 nm or more, and having a light absorption intensity of 60 or more, for grains having a spectral absorption maximum wavelength of less than 500 nm, in an amount of one half or more the total silver halide grain projected area. For the grains having a spectral absorption maximum wavelength of 500 nm or more, the light absorption intensity is preferably 150 or more, more preferably 170 or more, and particularly preferably 200 or more. For the grains having a spectral absorption maximum wavelength of less than 500 nm, the light absorption intensity is preferably 90 or more, more preferably 100 or more, and particularly preferably 120 or more. Although there is no particular limitation on the upper limit thereof, it is preferably 2000 or less, more preferably 1000 or less and particularly preferably 500 or less.

With respect to the grains having a spectral absorption maximum wavelength of 500 nm or less, it is preferably 350 nm or more.

Examples of methods for measuring the light absorption intensity include a method using a microspectrophotometer. The microspectrophotometer is an equipment which can measure an absorption spectrum of a minute area, and can measure a transmission spectrum of one grain. As to the measurement of an absorption spectrum of one grain by microspectrophotometry, a report of Yamashita et al. (Nippon Shashin Gakkai, collected summaries of annual lectures, 1996, page 15) can be referred to. The adsorption intensity per one grain can be determined from this absorption spectrum. However, the light passing through a grain is absorbed by both faces, an upper face and a lower face, so that the absorption intensity per unit area of a grain surface can be determined as one half the absorption intensity per grain obtained by the above-described method. At this time, the range in which an adsorption spectrum is integrated is from 5000 $cm^{-1}$ to 35000 $cm^{-1}$ in definition, but experimentally, it may be integrated between 500 $cm^{-1}$ larger than the range in which the absorption due to a sensitizing dye appears and 500 $cm^{-1}$ smaller than the range.

The light absorption intensity is a value unequivocally determined by the oscillatior strength of the sensitizing dye and the number of adsorbed molecules per unit area, and can be converted to the light absorption intensity by the determination of the oscillatior strength of the sensitizing dye, the amount of the dye adsorbed and the grain surface area.

The oscillatior strength of the sensitizing dye can be experimentally determined as a value proportional to the absorption area intensity (optical density X $cm^{-1}$) of a solution of the sensitizing dye. Accordingly, taking the absorption area intensity of the dye per M is taken as A (optical density X $cm^{-1}$), the amount of the sensitizing dye adsorbed as B (mol/mol Ag) and the grain surface area as C ($m^2$/mol Ag), the light absorption intensity can be determined by the following equation within the error range of about 10%.

$$0.156 \times A \times B/C$$

The calculation of the light absorption intensity from this equation also gives a value substantially identical with the light absorption intensity measured on the basis of the above-described definition (the value obtained by integrating $\mathrm{Log}(I_0/(I_0-I)$ to the wave number ($cm^{-1}$)) Methods for increasing the light absorption intensity include a method of allowing dye chromophoric groups to be adsorbed by grain surfaces in more than one layer, a method of increasing the molar absorption coefficient of dyes, and a method of decreasing the dye-occupying area. Although any of these methods may be used, preferred is a method of allowing dye chromophoric groups to be adsorbed by grain surfaces in more than one layer.

The state in which dye chromophoric groups are adsorbed on grain surfaces in more than one layer means that a dye restrained in the vicinity of silver halide grains exists in one or more layers, excluding a dye existing in a dispersing medium. Even when the dye chromophoric groups are connected by covalent bonds to a substance adsorbed on the grain surfaces, in the case that connecting groups are long and the dye chromophoric groups exist in the dispersing medium, the effect of increasing the light absorption intensity is little. Accordingly, such a case is not deduced as the adsorption in more than one layer. Further, in the so-called multiple layer adsorption in which the dye chromophoric groups are adsorbed on the grain surfaces in more than one layer, it is necessary that spectral sensitization takes place by a dye not allowed to be directly adsorbed by the grain surfaces. For that purpose, excitation energy is required to be transmitted from the dye not allowed to be directly adsorbed by the silver halide grains to a dye directly adsorbed on the grains. Accordingly, when the transmission of excitation energy is required to occur exceeding 10 steps, the final transmission efficiency of excitation energy is unfavorably decreased. Examples thereof include the case that most of the dye chromophoric groups exist in the dispersing medium and 10 or more steps are necessary for the transmission of excitation energy, as a polymer dye described in JP-A-2-113239.

In the present invention, the dye chromophoric step number per molecule is preferably from 1 to 3, and more preferably 1 or 2.

The chromophoric groups described herein mean atomic groups mainly contributed to absorption bands of molecules, which are described in Dictionary of Physics and Chemistry (the fourth edition, Iwanami Shoten, 1987). For example, any atomic groups such as atomic groups having unsaturated bonds such as C═C and N═N are available.

Examples of such atomic groups include cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes, azamethine dyes, coumarin dyes, arylidene dyes, anthraquinone dyes, triphenylmethane dyes, azo dyes, azomethine dyes, spiro dyes, metallocene dyes, fluorenone dyes, flugido dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophyll dyes, phthalocyanine dyes and metal complex dyes. Preferred are polymethine chromophoric groups such as cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes and azamethine dyes. More preferred are cyanine dyes, merocyanine dyes, trinuclear merocyanine dyes, tetranuclear merocyanine dyes and rhodacyanine dyes, particularly preferred are cyanine dyes, merocyanine dyes and rhodacyanine dyes, and most preferred are cyanine dyes.

Details of these dyes are described in F. M. Harmer, *Heterocyclic Compounds-Cyanine Dyes and Related Compounds*, John Wiley & Sons, New York, London (1964); and D. M. Sturmer, *Heterocyclic Compounds-Special Topics in Heterocyclic Chemistry*, chapter 18, clause 14, pages 482 to 515. Formulas of the preferred dyes include formulas described in U.S. Pat. No. 5,994,051, pages 32 to 36, and formulas described in U.S. Pat. No. 5,747,236, pages 30 to 34. Further, formulas of the preferred cyanine dyes, merocyanine dyes and rhodacyanine dyes include formulas (XI), (XII) and (XIII) described in U.S. Pat. No. 5,340,694, columns 21 and 22 (with the proviso that the number of n12, n15, n17 and n18 is not restricted, and is an integer of 0 or more (preferably 4 or less)).

The dye chromophoric groups are allowed to be adsorbed on the silver halide grains preferably in 1.5 or more layers, more preferably in 1.7 or more layers, and particularly preferably in two or more layers. Although there is no particular limitation on the upper limit thereof, 10 or less layers are preferred and 5 or less layers are more preferred.

That is to say, a preferred embodiment of the present invention is a silver halide emulsion in which the dye chromophoric groups are adsorbed on the surfaces of the silver halide grains in more than one layer, and which contains at least one compound of the present invention. It is therefore preferred that the compound of the present invention constitutes a part of the dye adsorbed on the surfaces of the silver halide grains in more than one layer.

In the present invention, the state in which the dye chromophoric groups are adsorbed on the surfaces of the silver halide grains in more than one layer means a state in which taking as the one-layer saturated coating amount the saturated adsorption amount per unit surface area achieved by a dye smallest in the dye occupying area of the surfaces of the silver halide grains, of the sensitizing dyes added to the emulsion, the adsorption amount per unit area of the dye chromophoric groups is large to the one-layer saturated coating amount. Further, the number of adsorption layers means the adsorption amount, based on the one-layer saturated coating amount. Dyes in which the dye chromophoric groups are connected by covalent bonds can be on the basis of the dye occupying area of individual dyes not connected.

The dye occupying area can be determined from an adsorption isotherm showing the relationship between the free dye concentration and the adsorbed dye amount, and the grain surface area. The adsorption isothermal line can be determined with reference to, for example, A. Herz et al., Adsorption from Aqueous Solution, *Advances in Chemistry Series,* 17, 173 (1968).

The amount of the sensitizing dye adsorbed on the emulsion grains can be measured by two methods, a method of separating an emulsion in which the dye is adsorbed on the grains into the emulsion grains and an aqueous solution of gelatin, a supernatant, in a centrifuge, determining the concentration of the dye not adsorbed from the measurement of spectral adsorption of the supernatant, and subtracting the amount of the dye not adsorbed from the amount of the dye added, thereby determining the amount of the dye adsorbed; and a method of drying the precipitated emulsion grains, dissolving a specific amount of the precipitate in a 1:1 mixed solution of an aqueous solution of sodium thiosulfate and methanol, and measuring the spectral adsorption of the resulting solution, thereby determining the amount of the dye adsorbed. When a plurality of sensitizing dyes are used, the adsorption amount can also be determined for each dye by a process such as high performance liquid chromatography.

As to the method for determining the amount of the dye adsorbed by determining the amount of the dye in the supernatant, reference can be made to, for example, W. West et al., *Journal of Physical Chemistry,* 56, 1054 (1952).

However, under the conditions that a large amount of the dye is used, the dye not adsorbed is also sometimes precipitated, so that the accurate adsorption amount has not necessarily been obtained in some cases by the method of determining the concentration of the dye in the supernatant. On the other hand, according to the method of dissolving the precipitated silver halide grains to measure the amount of the dye adsorbed, the grains and the precipitated dye can be easily separated because the emulsion grains are overwhelmingly faster in precipitation rate than the dye, which makes it possible to accurately measure only the amount of the dye adsorbed on the grains. This method is most reliable as the method for determining the amount of dye adsorbed.

Although the amount of photographic useful compounds adsorbed on the grains can also be measured similarly to the sensitizing dyes, the determination by high performance liquid chromatography is preferred rather than that by spectral absorption, because absorption is poor in the visible light region.

As an example of a method for measuring the surface area of silver halide grains, there is a method of taking a transmission electron micrograph by the replica method, determining the shape and size of individual grains, and calculating the surface area therefrom. In this case, the thickness of tabular grains is calculated from the length of shadows of replicas. As to methods for taking transmission electron micrographs, reference can be made to, for example, *Electron Microscope Sample Techniques*, edited by Nippon Electron Microscope Society, Kanto Branch, Seibundo Shinkosha (1970), and P. B. Hirsch, *Electron Microscopy of Thin Crystals*, Buttwrworths, London (1965).

As other methods, reference can be made to, for example, A. M. Kragin et al., *The Journal of Photographic Science,* 14, 185 (1966), J. F. Paddy, *Transactions of the Faraday Society,* 60, 1325 (1964), S. Boyer et al., *Journal de Chimie Physique et de Physicochimie Biologique,* 63, 1123 (1963), W. West et al., *Journal of Physical Chemistry,* 56, 1054 (1952), E. Klein et al., *International Coloquium*, edited by H. Sauvenier, Liege (1959) and "Scientific Photography".

The dye occupying area can be experimentally determined by the above-described methods for each case. However, the molecule occupying area of the sensitizing dyes usually employed is approximately 80 $Å^2$, so that the approximate number of adsorption layers can also be estimated, simply taking the dye occupying area as 80 $Å^2$ for all dyes.

In the present invention, when the dye chromophoric groups are adsorbed on the silver halide grains in multiple layers, the reduction potential and the oxidation potential of the so-called first-layer dye chromophoric groups and the second-layer and later dye chromophoric groups, which are directly adsorbed on the silver halide grains, may be any. However, it is preferred that the reduction potential of the first-layer dye chromophoric groups is more positive than a value obtained by subtracting 0.2 v from the reduction potential of the second-layer and later dye chromophoric groups.

Although the reduction potential and the oxidation potential can be measured by various methods, phase-shift discrimination type second harmonic AC polarography is preferably used, which allows to determine accurate values. A method for measuring the potential by the phase-shift discrimination type second harmonic AC polarography described above is described in *Journal of Imaging Science,* 30, 27 (1986).

The second-layer and later dye chromophoric groups are preferably luminous dyes. It is preferred that the luminous dyes have a skeleton structure of a dye used for a dye laser. These are described, for example, in Mitsuo Maeda, *Laser Research,* 8, 694, 803, 958 (1980), 9, 85 (1981) and F. Sehaefer, *Dye Lasers*, Springer (1973).

Further, it is preferred that the absorption maximum wavelength of the first-layer dye chromophoric groups in the silver halide photographic material is longer than that of the second-layer and later dye chromophoric groups. Still further, the luminescence of the second-layer and later dye chromophoric groups is preferably superimposed on the absorption of the first-layer dye chromophoric groups. The first-layer dye chromophoric groups preferably form J-associated products. Furthermore, in order to have absorption and spectral sensitivity in a desired wavelength range, the second-layer and later dye chromophoric groups also preferably form J-associated products.

The transmission efficiency of excitation energy of the second-layer dyes to the first-layer dyes is preferably 30% or more, more preferably 60% or more, and particularly preferably 90% or more. The transmission efficiency of the energy from the second-layer dyes to the first-layer dyes can be determined as (the spectral sensitizing efficiency in excitation of the second-layer dyes)/(the spectral sensitizing efficiency in excitation of the second-layer dyes).

The meanings of the terms used in the present invention are described below:

Dye occupying area: The occupying area per molecule of a dye, which can be experimentally determined from an adsorption isotherm. Dyes in which dye chromophoric groups are connected by covalent bonds can be on the basis of the dye occupying area of individual dyes not connected. The area is simply 80 $Å^2$.

One layer saturated adsorption amount: The amount of a dye adsorbed per unit grain surface area in one layer saturated coating. The reciprocal of the minimum dye occupying area, of dyes added.

Adsorption in multiple layers: A state in which the amount of dye chromophoric groups adsorbed per unit grain surface area is larger than the one layer saturated adsorption amount.

The number of adsorption layers: The amount of dye chromophoric groups adsorbed per unit grain surface area, based on the one layer saturated adsorption amount.

The intergranular distribution of light absorption intensity can be expressed as the coefficient of variation of light absorption intensity of 100 or more grains measured by microspectrophotometry at random. The coefficient of variation is determined as 100×(standard deviation/average) (%). The light absorption intensity is a value proportional to the amount of a dye adsorbed, so that the intergranular distribution of light absorption intensity may be said to be the intergranular distribution of the amount of a dye adsorbed. The coefficient of variation of the intergranular distribution of the light absorption intensity is preferably 60% or less, more preferably 30% or less, and particularly preferably 10% or less.

The coefficient of variation of the intergranular distribution of a distance between the shortest wavelength showing 50% of the maximum value Amax of the absorption of the sensitizing dye and the longest wavelength is preferably 30% or less, more preferably 10% or less, and particularly preferably 5% or less.

As to the absorption maximum wavelength of the dye for each grain, the grains having the absorption maximum at a wavelength of 10 nm or less occupy preferably 70% or more, and more preferably 90% or more of the projected area. More preferably, the grains having the absorption maximum at a wavelength of 5 nm or less occupy preferably 50% or more, more preferably 70% or more, and particularly preferably 90% or more of the projected area.

The intergranular distribution of the light absorption intensity (dye adsorption amount) has been known to be homogenized with an increase in the dye adsorption amount, when adsorption sites are fixed to surfaces of silver halide grains. However, in the case of adsorption in multiple layers of the present invention, there is no limitation on the adsorption sites, as long as adsorption not only in two layers, but also in multiple layers is possible. As a result, it has been found that the intergranular distribution has become remarkably liable to occur so that some grains are adsorbed in one layer and the other in three layers. Analyses have revealed that an increase in the ratio of the interaction energy between the second-layer dyes to the total adsorption energy of the second-layer dyes (a relative decrease in the ratio of the interaction energy between the first-layer and second-layer dye molecules) results in a tendency to cause intergranular ununiformity of the dye adsorption amount in a multiple layer system. The interaction energy between the first-layer and second-layer dye molecules is preferably 20% or more, and more preferably 40% or more, based on the total adsorption energy of the second-layer dyes.

For enhancing the interaction energy between the first-layer and second-layer dyes, it is preferred that static interactions, Van der Waals interactions, hydrogen bonds, coordinate bonds and combined interaction forces thereof between the first-layer and second-layer dye molecules are utilized. Further, the main interactions between the second-layer dyes are preferably Van der Waals interactions between dye chromophoric groups. However, the use of static interactions, Van der Waals interactions, hydrogen bonds, coordinate bonds and combined interactions thereof is also preferred, as long as the above-described preferred relationship is satisfied.

It is actually difficult to determine the ratio of the interaction energy between the first-layer and second-layer dye molecules to the total adsorption energy of the second-layer dyes. However, it can be deduced by use of the technique of computational chemistry such as molecular force field computation.

Experimentally, the mutual cohesive energy of the second-layer dye molecules, and the cohesive energy of the first-layer and second-layer dye molecules are measured, and it is also possible to estimate the ratio as 100× the first-layer dyes and the cohesive energy of the second-layer dye molecules/(the mutual cohesive energy of the second-layer dye molecules+the cohesive energy of the first-layer and second-layer dye molecules). The cohesive energy can be determined, for example, by the method of Matsubara, Tanaka et al. (*Nippon Shashin Gakkaishi,* 52, 395 (1989)).

In the adsorption in multiple layers, which is preferred in the present invention, the adsorption energy (ΔG) of the second-layer and later sensitizing dyes is preferably 10 kJ/mol or more, and more preferably 20 kJ/mol or more.

Further, it is preferred that the second-layer and later sensitizing dyes exist in the layer form.

The distance between the shortest wavelength and the longest wavelength each showing 50% of the maximum value Amax of the spectral absorptivity by the sensitizing dyes of an emulsion containing silver halide photographic emulsion grains having a light absorption intensity of 60, or 100 or more, and the maximum value Smax of the spectral sensitivity is preferably 120 nm or less, and more preferably 100 nm or less.

The distance between the shortest wavelength and the longest wavelength showing 80% of Amax and Smax is preferably from 20 nm to 100 nm, more preferably from 20 nm to 80 nm, and particularly preferably from 20 nm to 50 nm.

Further, the distance between the shortest wavelength and the longest wavelength showing 20% of Amax and Smax is preferably 180 nm or less, more preferably 150 nm or less, particularly preferably 120 nm or less, and most preferably 100 nm or less.

The longest wavelength showing a spectral absorptivity of 50% of Amax and Smax is preferably from 460 nm to 510 nm, or from 560 nm to 610 nm, or from 640 to 730 nm.

First preferred methods for realizing silver halide grains having a light absorption intensity of 60 or more at a spectral absorption maximum wavelength of less than 500 nm, or a light absorption intensity of 100 or more at a spectral absorption maximum wavelength of 500 nm or more are methods using specific dyes as shown below.

Preferred examples of such methods include methods using aromatic group-containing dyes, or aromatic group-containing cationic dyes and anionic dyes in combination as described in JP-A-10-239789, JP-A-8-269009, JP-A-10-123650 and JP-A-328189; methods using multivalent charge-containing dyes as described in JP-A-10-171058; methods using pyridinium group-containing dyes as described in JP-A-10-104774; methods using hydrophobic group-containing dyes as described in JP-A-10-186559; methods using coordinate bond group-containing dyes as described in JP-A-10-197980; and methods using specific dyes as described in JP-A-2000-256573, JP-A-2000-275776, JP-A-2000-345061, JP-A-2000-345060, JP-A-2001-5132 and Japanese Patent Application Nos. 11-221479, 11-265769, 11-260643, 11-331571, 11-331570, 11-311039, 11-331567, 11-347781 and 2000-18966.

Particularly preferred are methods using dyes each containing at least one aromatic group. Of these, preferred is a method using a positively charged dye, a dye with charges cancelled with each other in a molecule, or only a dye having no charge, or a method using a positively charged dye in combination with a negatively charged dye, wherein at least one of the positively charged dye and the negatively charged dye has at least one aromatic group as a substituent group. It is preferred that the compound used in the present invention has at least one aromatic group as a substituent group.

The aromatic groups are described in detail. The aromatic groups include aromatic hydrocarbon groups and aromatic heterocyclic groups. They may further be groups having polycyclic condensed rings in which aromatic hydrocarbon rings or aromatic heterocyclic rings are condensed with each other, or polycyclic condensed ring structures in which aromatic hydrocarbon rings are combined with aromatic heterocyclic rings. They maybe substituted by substituent groups V described later.

Preferred examples of aromatic rings contained in the aromatic groups include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, carbazole, phenanthridine, acridine, phenanthroline, thianthrene, chromene, xanthene, phenoxathiin, phenothiazine and phenazine.

More preferred are the above-described aromatic hydrocarbon rings, particularly preferred are benzene and naphthalene, and most preferred is benzene.

The dyes include the dyes shown as the examples of the dye chromophoric groups described above, and preferred examples thereof include the dyes shown as the examples of the methine dye chromophoric groups described above.

More preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarylium dyes, croconium dyes and azamethine dyes, still more preferred are cyanine dyes, merocyanine dyes, trinuclear merocyanine dyes, tetranuclear merocyanine dyes and rhodacyanine dyes, particularly preferred are cyanine dyes, merocyanine dyes and rhodacyanine dyes, and most preferred are cyanine dyes. Although it is particularly preferred that the methine compounds used in the present invention have these chromophoric groups, dyes other than the methine compounds, which are concurrently used together with the methine compound, may have these chromophoric groups.

The particularly preferred methods will be described in detail below with reference to structural formulas.

That is to say, the cases of (1) and (2) described below are preferred. Of (1) and (2), (2) is more preferred.

(1) When the methine compound used in the present invention is a cationic, betaine or nonionic methine dye represented by the following formula (XI), or at least one cationic, betaine or nonionic methine dye represented by the following formula (XI) is used in addition to the methine compound used in the present invention; and (2) When at least one cationic methine dye represented by the following formula (XI) and at least one anionic methine dye represented by the following formula (XII) are concurrently used, and at least either one of a cationic methine dye represented by formula (XI) and an anionic methine dye represented by formula (XII) is the methine compound used in the present invention, or at least one cationic methine dye represented by the following formula (XI) and at least one anionic methine dye represented by the following formula (XII) are concurrently used in addition to the methine compound used in the present invention.

(XI)

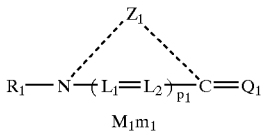

wherein $Z_1$, with which a ring may be cyclocondensed, represents an atomic group necessary to form a nitrogen-containing heterocyclic ring; $R_1$ represents an alkyl group, an aryl group or a heterocyclic group; $Q_1$ represents a group necessary to form a methine dye represented by formula (XI); $L_1$ and $L_2$ each represents a methine group; and $p_1$ is 0 or 1.

$Z_1$, $R_1$, $Q_1$, $L_1$ and $L_2$ have such substituent groups that the methine dye represented by formula (XI) form a cationic dye, a betaine dye or a nonionic dye as a whole. However, when formula (XI) represents a cyanine dye or a rhodacyanine dye, they preferably have such substituent groups as to form a cationic dye. $M_1$ represents a counter ion for charge balance, and $m_1$ represents a number of 0 or more necessary to neutralize charge of a molecule.

(XII)

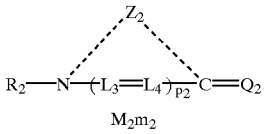

wherein $Z_2$, with which a ring may be cyclocondensed, represents an atomic group necessary to form a nitrogen-containing heterocyclic ring, $R_2$ represents an alkyl group, an aryl group or a heterocyclic group; $Q_2$ represents a group necessary to form a methine dye represented by formula (XII); $L_3$ and $L_4$ each represents a methine group; and $p_2$ is 0 or 1.

$Z_2$, $R_2$, $Q_2$, $L_3$ and $L_4$ have such substituent groups that the methine dye represented by formula (XII) form an anionic dye as a whole. $M_2$ represents a counter ion for charge balance, and $m_2$ represents a number of 0 or more necessary to neutralize charge of a molecule.

When the compound of formula (XI) is used alone, $R_1$ is preferably an aromatic ring-containing group.

When the compound of formula (XI) is used in combination with the compound of formula (XII), it is preferred that at least one of $R_1$ and $R_2$ is an aromatic ring-containing group. It is more preferred that both of $R_1$ and $R_2$ are aromatic ring-containing groups.

The cationic dye used in the present invention may be any, as long as the charge of the dye excluding the counter ion is cationic. However, preferred is a dye having no anionic substituent group. The anionic dye used in the present invention may be any, as long as the charge of the dye excluding the counter ion is anionic. However, preferred is a dye having one or more anionic substituent groups. The betaine dye used in the present invention is a dye in which although it has charge in a molecule, the molecule has no charge as a whole by formation of an internal salt. The nonionic dye used in the present invention is a dye having no charge at all in a molecule.

The term "anionic substituent group as used herein means a substituent group having negative charge, and includes, for example, a proton dissociative acidic group dissociated 90% or more at a pH of 5 to 8. Specific examples thereof include a sulfo group, a carboxyl group, a sulfite group, a phosphoric acid group and a boric acid group. Besides, such groups include a —$CONHSO_2$— group (sulfonylcarbamoyl group or carbonylsulfamoyl group), a —CONHCO— group (carbonylcarbamoy group), an —$SO_2NHSO_2$— group (sulfonylsulfamoyl group), a phenolic hydroxyl group and a group in which a proton is dissociated depending on the pka and the pH around it. More preferred are a sulfo group, a carboxyl group, a —$CONHSO_2$— group, a —CONHCO— group and an —$SO_2NHSO_2$— group.

In the —$CONHSO_2$— group, —CONHCO— group and —$SO_2NHSO_2$— group, protons are not dissociated depending on the pka and the pH around them in some cases. In such cases, they are not included in the anionic substituent groups defined herein. That is to say, when the protons are not dissociated, even though, for example, two of these groups are substituted in a dye represented by formula (XI-I) described later, the dye can be considered as a cationic dye.

The cationic substituent groups include a substituted or unsubstituted ammonium and pyridinium groups.

It is more preferred that the dye represented by formula (XI) is a dye represented by the following formula (XI-1), (XI-2) or (XI-3):

(XI-1)

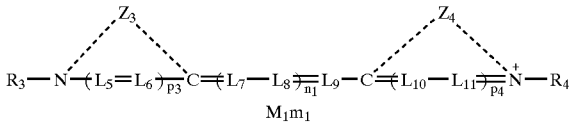

$M_1m_1$ wherein $L_5$, $L_6$, $L_7$, $L_8$, $L_9$, $L_{10}$ and $L_{11}$ each represents a methine group; $p_3$ and $p_4$ each represents 0 or 1; $n_1$ represents 0, 1, 2, 3 or 4; $Z_3$ and $Z_4$, with which rings may be cyclocondensed, each represents an atomic group necessary to form a nitrogen-containing heterocyclic ring, $R_3$ and $R_4$ each represents an alkyl group, an aryl group or a heterocyclic group; and $M_1$ and $m_1$ have the same meanings as defined for formula (XI). $R_3$, $R_4$, $Z_3$, $Z_4$ and $L_5$ to $L_{11}$ have no anionic substituent groups when the dye of formula (XI-1) is a cationic dye, and have one anionic substituent group when the dye of formula (XI-1) is a betaine dye.

(XI-2)

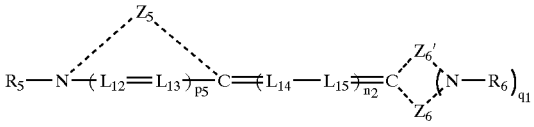

$M_1m_1$ wherein $L_{12}$, $L_{13}$, $L_{14}$ and $L_{15}$ each represents a methine group; $p_5$ represents 0 or 1; q, represents 0 or 1; $n_2$ represents 0, 1, 2, 3 or 4; $Z_5$, with which a ring may be cyclocondensed, represents an atomic group necessary to form a nitrogen-containing heterocyclic ring, $Z_6$ and $Z_6'$, with which rings may be cyclocondensed, each represents an atomic group necessary to form a heterocyclic ring or acyclic acidic end group together with $(N—R_6)q_1$, $R_5$ and $R_6$ each represents an alkyl group, an aryl group or a heterocyclic group; and $M_1$ and $m_1$ have the same meanings as defined for formula (XI). $R_5$, $R_6$, $Z_9$, $Z_6$, $Z_6'$ and $L_{12}$ to $L_{15}$ have cationic substituent groups when the dye of formula (XI-2) is a cationic dye, have one cationic substituent group and one anionic substituent group when the dye of formula (XI-2) is a betaine dye, and have no cationic substituent group and no anionic substituent group when the dye of formula (XI-2) is a nonionic dye.

(XI-3)

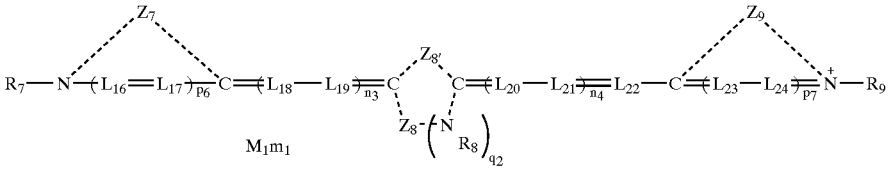

$M_1m_1$ wherein $L_{16}$, $L_{17}$, $L_{18}$, $L_{19}$, $L_{20}$, $L_{21}$, $L_{22}$, $L_{23}$ and $L_{24}$ each represents a methine group; $p_6$ and $p_7$ each represents 0 or 1; $q_2$ represents 0 or 1; $n_3$ and $n_4$ each represents 0, 1, 2, 3 or 4; $Z_7$ and $Z_9$, with which rings may be cyclocondensed, each represents an atomic group necessary to form a nitrogen-containing heterocyclic ring; $Z_8$ and $Z_8'$, with which rings may be cyclocondensed, each represents an atomic group necessary to form a heterocyclic ring together with $(N—R_8)q_2$, $R_7$, $R_8$ and $R_9$ each represents an alkyl group, an aryl group or a heterocyclic group; and $M_1$ and $m_1$ have the same meanings as defined for formula (XI). $R_7$, $R_8$, $R_9$, $Z_7$, $Z_8$, $Z_8'$, $Z_9$ and $L_{16}$ to $L_{24}$ have no anionic substituent groups when the dye of formula (XI-3) is a cationic dye, and have one anionic substituent group when the dye of formula (XI-3) is a betaine dye.

It is more preferred that the anionic dye represented by formula (XII) is a dye represented by the following formula (XII-1), (XII-2) or (XII-3):

(XII-1)

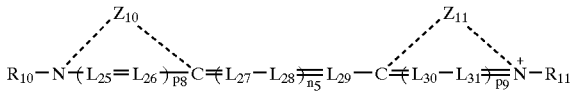

$M_2m_2$ wherein $L_{25}$, $L_{26}$, $L_{27}$, $L_{28}$, $L_{29}$, $L_{30}$ and $L_3$, each represents a methine group; $p_8$ and $p_9$ each represents 0 or 1; $n_5$ represents 0, 1, 2, 3 or 4; $Z_{10}$ and $Z_{11}$, with which rings may be cyclocondensed, each represents an atomic group necessary to form a nitrogen-containing heterocyclic ring, $R_{10}$ and $R_{11}$ each represents an alkyl group, an aryl group or a heterocyclic group; and $M_2$ and $m_2$ have the same meanings as defined for formula (XII). However, $R_{10}$ and $R_{11}$ have anionic substituent groups.

(XII-2)

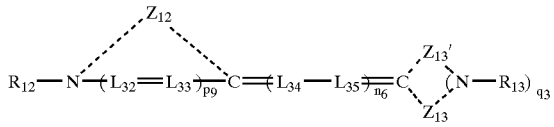

$M_2m_2$ wherein $L_{32}$, $L_{33}$, $L_{34}$ and $L_{35}$ each represents a methine group; $p_9$ represents 0 or 1; $q_3$ represents 0 or 1; $n_6$ represents 0, 1, 2, 3 or 4; $Z_{12}$, with which a ring may be cyclocondensed, represents an atomic group necessary to form a nitrogen-containing heterocyclic ring, $Z_{13}$ and $Z_{13}'$, with which rings maybe cyclocondensed, each represents an atomic group necessary to form a heterocyclic ring or acyclic acidic end group together with $(N—R_{13})q_3$, $R_{12}$ and $R_{13}$ each represents an alkyl group, an aryl group or a heterocyclic group; and $M_2$ and $m_2$ have the same meanings as defined for formula (XII). However, at least one of $R_{12}$ and $R_{13}$ has an anionic substituent group.

(XII-3)

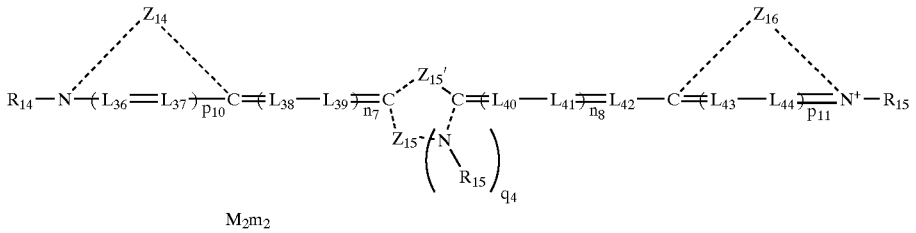

$M_2m_2$ wherein $L_{36}$, $L_{37}$, $L_{38}$, $L_{39}$, $L_{40}$, $L_{41}$, $L_{42}$, $L_{43}$ and $L_{44}$ each represents a methine group; $p_{10}$ and $p_{11}$ each represents 0 or 1; $q_4$ represents 0 or 1; $n_7$ and $n_8$ each represents 0, 1, 2, 3 or 4; $Z_{14}$ and $Z_{16}$, with which rings maybe cyclocondensed, each represents an atomic group necessary to form a nitrogen-containing heterocyclic ring, $Z_{15}$ and $Z_{15}'$, with which rings may be cyclocondensed, each represents an atomic group necessary to form a heterocyclic ring together with $(N—R_{15})q_4$, $R_{14}$, $R_{15}$ and $R_{16}$ each represents an alkyl group, an aryl group or a heterocyclic group; and $M_2$ and $m_2$ have the same meanings as defined for formula (XII) However, at least two of $R_{14}$, $R_{15}$ and $R_{16}$ have anionic substituent groups.

When the compounds of formulas (XI-1), (XI-2) and (XI-3) are used alone, at least one of $R_3$ and $R_4$ is an aromatic group-containing group, and preferably, both are aromatic group-containing groups. Further, at least one of $R_5$ and $R_6$ is an aromatic group-containing group, and preferably, both are aromatic group-containing groups. Furthermore, at least one of $R_7$, $R_8$ and $R_9$ is an aromatic group-containing group, and preferably, both, and more preferably, all three are aromatic group-containing groups.

When the compounds of formulas (XI-1), (XI-2) and (XI-3) are used in combination with the compounds of formulas (XII-1), (XII-2) and (XII-3), at least one of $R_3$ to $R_9$ and $R_{10}$ to $R_{16}$ of the dyes combined is an aromatic group-containing group. Preferably, two are aromatic group-containing groups, more preferably, three are aromatic group-containing groups, and particularly preferably, four or more are aromatic group-containing groups.

The preferred methods described above allow to realize silver halide grains having a spectral absorption maximum wavelength of less than 500 nm and a light absorption intensity of 60 or more, or a spectral absorption maximum wavelength of 500 nm or more and a light absorption intensity of 100 or more. However, the second-layer dye is usually adsorbed in the monomer state, so that the width of adsorption and the width of spectral sensitivity become broader than desired values in most cases. Accordingly, for realizing high sensitivity in a desired wavelength region, it is necessary to allow the dye adsorbed in the second layer to form a J-associated product. The J-associated product is high in the fluorescence yield and small in the Stokes shift, so that the light energy absorbed by the second-layer dye is preferably transferred to the first-layer dye having a light absorption wavelength close to that of the second-layer dye by Forster type energy transfer.

The term "the second-layer and later dyes" as used in the present invention means dyes which are not directly adsorbed on the silver halide grains, although it is adsorbed on the silver halide grains.

The term "J-associated product of the second-layer and later dye" used in the present invention is defined that the absorption width on the long wavelength side of absorption shown by the dye adsorbed in the second or later layer is twice or less the absorption width on the long wavelength side of absorption shown by a dye solution in the monomer state having no interaction between dye chromophoric groups. The term "the absorption width on the long wavelength side" as used herein indicates the energy width between the absorption maximum wavelength and the wavelength longer than the absorption maximum wavelength and showing the absorption of one half the absorption maximum. In general, when the J-associated product is formed, the absorption width on the long wavelength side has been known to be decreased compared with the monomer state. When the dye is adsorbed in the second layer in the monomer state, the absorption width is increased twice or more the absorption width on the long wavelength side of the dye solution in the monomer state, because of the ununiformity of adsorption sites and conditions. Accordingly, the J-associated product of the second-layer or later dye can be defined by the above-described definition.

The spectral absorption of the dyes adsorbed in the second and later layers can be determined by subtracting the spectral absorption due to the first-layer dye from the whole spectral absorption of the given emulsion.

The spectral absorption due to the first-layer dye is determined by measuring an absorption spectrum at the time when only the first-layer dye is added. Further, the spectral absorption due to the first-layer dye can also be measured by adding a dye desorbing agent to an emulsion in which sensitizing dyes are adsorbed in multiple layers, thereby desorbing the second-layer and later dyes.

In an experiment of desorbing the dyes from surfaces of the grains with the dye desorbing agent, the first-layer dye is usually desorbed after the second-layer and later dyes are desorbed, so that selection of suitable conditions allows determination of spectral absorption due to the first-layer dye, which makes it possible to determine spectral absorption of the second-layer and later dyes. As to the method using the dye desorbing agent, reference can be made to Asanuma et al., *Journal of Physical Chemistry,* 101, 2149-2153 (1997).

For forming the J-associated products of the second-layer dyes using the cationic, betaine or nonionic dyes represented by formula (XI) and the anionic dyes represented by formula (XII), the dye adsorbed in the first layer is preferably added separately from the dyes adsorbed in the second and later layers. It is more preferred that the dye used in the first layer is different from the dyes used in the second and later layers in structure. As to the second-layer and later dyes, it is preferred that the cationic, betaine or nonionic dyes are added alone, or that the cationic dyes and the anionic dyes are added in combination.

As the first-layer dyes, any dyes can be used. However, preferred are the dyes represented by formula (XI) or (XII), and more preferred are the dyes represented by formula (XI)

For the second-layer dyes, it is preferred that the cationic, betaine or nonionic dyes of formula (XI) are used alone. Further, when the cationic dyes are used in combination with the anionic dyes as the second-layer dyes similarly preferred, either of them is preferably the cationic dyes of formula (XI) or the anionic dyes of formula (XII), and both the cationic dyes of formula (XI) and the anionic dyes of formula (XII) are preferably contained. The cationic dye/anionic dye ratio as the second-layer dyes is preferably from 0.5 to 2, more preferably from 0.75 to 1.33, and most preferably from 0.9 to 1.11.

In the present invention, any dye other than the dyes represented by formula (XI) or formula (XII) may be added. However, the amount of the dyes represented by formula (XI) or formula (XII) is preferably 50% or more, more preferably 70% or more, and most preferably 90% or more, based on the total amount of dyes added.

Such addition of the second-layer dyes can enhance the interaction between the second-layer dyes while promoting rearrangement of the second-layer dyes, so that the formation of the J-associated products can be realized.

When the dye of formula (XI) or (XII) is used as the first-layer dye, $Z_1$ and $Z_2$ is each preferably a basic nucleus substituted by an aromatic group, or a basic nucleus in which three or more rings are cyclocondensed. Further, when the dye is used as the second-layer and more dye, $Z_1$ and $Z_2$ is each preferably a basic nucleus in which three or more rings are cyclocondensed.

For example, the cyclocondensation number of the basic nucleus is 2 for a benzoxazole nucleus, and 3 for a naphthoxazole nucleus. Even though a benzoxazole nucleus is substituted by a phenyl group, the cyclocondensation number thereof is 2. The tricyclic or more cyclocondensed basic nucleus may be any, as long as it is a polycyclic cyclocondensation type heterocyclic basic nucleus in which tree or more rings are cyclocondensed. Preferred examples thereof include tricyclic cyclocondensation type heterocyclic rings and tetracyclic cyclocondensation type heterocyclic rings. Preferred examples of the tricyclic cyclocondensation type heterocyclic rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]imidazole, naphtho[2,1-d]imidazole, naphtho[2,3-d]slenazole, naphtho[1,2-d]slenazole, naphtho[2,1-d]slenazole, indolo[5,6-d]oxazole, indolo[6,5-d]oxazole, indolo[2,3-d]oxazole, indolo [5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole and benzothieno[2,3-d]oxazole. Preferred examples of the tetracyclic cyclocondensation type heterocycles include anthra[2,3-d]oxazole, anthra[1,2-d]oxazole, anthra[2,1-d]oxazole, anthra[2,3-d]thiazole, anthra[1,2-d]thiazole, anthra[2,1-d]thiazole, phenanthro[2,1-d]thiazole, phenanthro[2,3-d]imidazole, anthra[1,2d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, di-benzothieno[3,2-d]oxazole, tetrahydrocarbazolo[6,7-d]oxazole, tetrahydrocarbazolo[7,6-d]oxazole, dibenzothieno[2,3-d]thiazole, dibenzothieno[3,2-d]thiazole and tetrahydrocarbazolo[6,7-d]thiazole. As the basic nuclei in which three or more rings are cyclocondensed, more preferred are naphtho[2,3-d]oxazole, naphtho[1,2-d]oxazole, naphtho[12,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazole[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole, and particularly preferred are naphtho[2,3-d]oxazole, naphtho[1,2-d]oxazole, naphtho[2,3d]thiazole, indolo[5,6-d]-oxazole, indolo [6,5-d]oxazole, indolo [5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazole[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole and dibenzothieno[3,2-d]oxazole.

Another preferred method which has realized such a state that the surfaces of the silver halide grains are coated with the dye chromophoric groups in multiple layers is a method using a dye compound having two or more dye chromophoric group moieties connected by a covalent bond. The available dye chromophoric groups include the dye chromophoric groups described above, although they may be any. Preferred are the polymethine dye chromophoric groups described above. More preferred are cyanine dyes, merocyanine dyes, rhodacyanine dyes and oxonol dyes, particularly preferred are cyanine dyes, rhodacyanine dyes and merocyanine dyes, and most preferred are cyanine dyes.

Preferred examples thereof include a method using a dye connected by a methine chain as described in JP-A-9-265144, a method using a dye in which oxonol dye molecules are connected as described in JP-A-10-226758, a method using a connected dye having a specific structure as described in JP-A-10-110107, JP-A-10-307358, JP-A-10-307359 and JP-A-10-310715, a method using a connected dye having a specific connecting group as described in JP-A-9-189986 and JP-A-10-204306, a method using a connected dye having a specific structure as described in JP-A-2000-231174, JP-A-2000-231172 and JP-A-2000-231173, and a method using a dye having a reactive group and allowing a connecting dye to be formed in an emulsion as described in JP-A-2000-81678.

Preferred examples of the connected dyes are dyes represented by the following formula (XIII):

$$D_1 — La — [D_2]q)r \quad M_3m_3 \tag{XIII}$$

wherein $D_1$ and $D_2$ each represents a dye chromophoric group; La represents a connecting group or a single bond; q and r each represents an integer of 1 to 100; $M_3$ represents a counter ion for charge balance; and $m_3$ represents the number necessary to neutralize charge of a molecule.

$D_1$, $D_2$ and La will be described.

The dye chromophoric groups represented by $D_1$ and $D_2$ may be any. Specifically, they include the dye chromophoric groups described above. Preferred are the polymethine dye chromophoric groups described above. More preferred are cyanine dyes, merocyanine dyes, rhodacyanine dyes and oxonol dyes, particularly preferred are cyanine dyes, merocyanine dyes and rhodacyanine dyes, and most preferred are cyanine dyes.

The examples of formulas of the preferred dyes include formulas described in U.S. Pat. No. 5,994,051, pages 32 to 36, and formulas described in U.S. Pat. No. 5,747,236, pages 30 to 34. Further, formulas of the preferred cyanine dyes, merocyanine dyes and rhodacyanine dyes include formulas shown in U.S. Pat. No. 5,340,694, columns 21 to 22, (XI), (XII) and (XIII) (with the proviso that the numbers of n12, n15, n17 and n18 are not limited and an integer of 0 or more (preferably 4 or less)).

In the present invention, the connected dye represented by formula (XIII) are adsorbed on the silver halide grains, $D_2$ is preferably a chromophoric group not directly adsorbed on the silver halide.

That is to say, the adsorptivity of $D_2$ on the silver halide grains is preferably weaker than that of $D_1$. Further, it is most preferred that the order of the adsorptivity on the silver halide grains is $D_1$>La>$D_2$.

As described above, $D_1$ is preferably a sensitizing dye moiety having adsorptivity on the silver halide grains. However, adsorption may be carried out either by physical adsorption or by chemical adsorption.

It is preferred that $D_2$ is weak in adsorptivity on the silver halide grains and is a luminous dye. It is preferred that the luminous dyes have a skeleton structure of a dye used for a dye laser. These are described, for example, in Mitsuo Maeda, *Laser Research,* 8, 694, 803, 958 (1980), 9, 85 (1981) and F. Sehaefer, *Dye Lasers*, Springer (1973).

Further, it is preferred that the absorption maximum wavelength of $D_1$ in the silver halide photographic material is longer than that of $D_2$. Still further, the luminescence of $D_2$ is preferably superimposed on the absorption of $D_1$. $D_1$ preferably forms a J-associated product. Furthermore, in order that the connected dye represented by formula (XI) has absorption and spectral sensitivity in a desired wavelength range, $D_2$ also preferably forms a J-associated product.

The reduction potential and the oxidation potential of $D_1$ and $D_2$ may be any. However, it is preferred that the reduction potential of $D_1$ is more positive than a value obtained by subtracting 0.2 v from the reduction potential of $D_2$.

La represents a connecting group (preferably a divalent connecting group) or a single bond. The connecting group preferably comprises at least one of a carbon atom, a nitrogen atom, a sulfur atom and an oxygen atom, or an atomic group containing at least one of them. Preferably, La represents a connecting group having from 0 to 100 carbon atoms, preferably from 1 to 20 carbon atoms, which is constituted by one or more of an alkylene group (e.g., methylene, ethylene, propylene, butylenes, pentylene), an arylene group (e.g., phenylene, naphthylene), an alkenylene group (e.g., ethenylene, propenylene), an alkynylene group (e.g., ethynylene, propynylene), an amido group, an ester group, a sulfoamido group, a sulfonate group, a ureido group, a sulfonyl group, a sulfinyl group, a thioether group, an ether group, a carbonyl group, an —N(Va)— group (wherein Va represents a hydrogen atom or a monovalent substituent group, which includes V described later) and a divalent heterocyclic group (e.g., 6-chloro-1,3,5-triazine-2, 4-diyl, pyrimidine-2,4-diyl, quinoxaline-2,3-diyl).

The above-described connecting group may further have a substituent group represented by V described later. Furthermore, the connecting group may contain a ring (an aromatic ring, a non-aromatic hydrocarbon ring or a heterocyclic ring) More preferably, La is a divalent connecting group having from 1 to 10 carbon atoms, which is constituted by one or more of an alkylene group having from 1 to 10 carbon atoms (e.g., methylene, ethylene, propylene, butylenes), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfoamido group and a sulfonate group. This connecting group may be substituted by V described later.

La is a connecting group which may perform energy transfer or electron transfer by a through-bond interaction. Although the through-bond interaction includes a tunnel interaction and a super-exchange interaction, the through-bond interaction based on the super-exchange interaction is preferred among others. The through-bond interaction and the super-exchange interaction are defined in Shammai Speiser, *Chem. Rev.,* 96, 1960-1963 (1996). As the connecting groups performing energy transfer or electron transfer by such an interaction, ones described in Shammai Speiser, *Chem. Rev.,* 96, 1967–1969 (1996) are preferred.

q and r each represents an integer of 1 to 100, preferably an integer of 1 to 5, more preferably 1 or 2, and particularly preferably 1. When q and r are each 2 or more, a plurality of La's and a plurality of $D_2$'s may be different connecting groups and dye chromophoric groups, respectively.

It is preferred that the dye of formula (XIII) has a charge of −1 as a whole.

More preferably, in formula (XIII), $D_1$ and $D_2$ are each independently a methine dye represented by the following formula (XIV), (XV), (XVI) or (XVII):

(XIV)

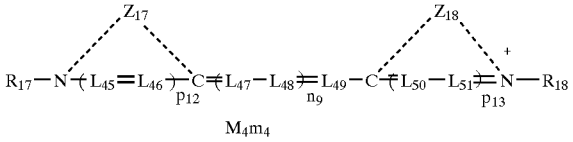

$M_4m_4$ wherein $L_{45}$, $L_{46}$, $L_{47}$, $L_{48}$, $L_{49}$, $L_{50}$ and $L_{51}$ each represents a methine group; $p_{12}$ and $p_{13}$ each represents 0 or 1; $n_9$ represents 0, 1, 2, 3 or 4; $Z_{17}$ and $Z_{18}$, with which rings may be cyclocondensed, each represents an atomic group necessary to form a nitrogen-containing heterocyclic ring; $M_4$ represents a counter ion for charge balance; $m_4$ represents a number of 0 or more necessary to neutralize charge of a molecule; and $R_{17}$ and $R_{18}$ each represents an alkyl group, an aryl group or a heterocyclic group.

(XV)

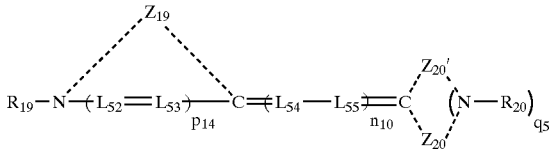

$M_5m_5$ wherein $L_{52}$, $L_{53}$, $L_{54}$ and $L_{55}$ each represents a methine group; $p_{14}$ represents 0 or 1; $q_5$ represents 0 or 1; $n_{10}$ represents 0, 1, 2, 3 or 4; $Z_{19}$, with which a ring may be cyclocondensed, represents an atomic group necessary to form a nitrogen-containing heterocyclic ring, $Z_{20}$ and $Z_{20}'$, with which rings maybe cyclocondensed, each represents an atomic group necessary to form a heterocyclic ring or acyclic acidic end group together with $(N—R_{20})q_5$, $M_5$ represents a counter ion for charge balance; $m_5$ represents a number of 0 or more necessary to neutralize charge of a molecule; and $R_{19}$ and $R_{20}$ each represents an alkyl group, an aryl group or a heterocyclic group.

Of the method using the dye of formula (XI) or (XII) and the method using the dye of formula (XIII), the method using the dye of formula (XI) or (XII) is more preferred.

The methine compounds represented by formulas (XI) (including (XI-1, 2, 3)), (XII) (including (XII-1, 2,3)), (XIV), (XV), (XVI) and (XVII) will be described in detail below.

In formulas (XI) and (XII), $Q_1$ and $Q_2$ each represents a group necessary to form a methine dye. Although any methine dyes can be formed by $Q_1$ and $Q_2$, examples thereof include the methine dyes shown as the examples of the dye chromophoric groups described above.

(XVI)

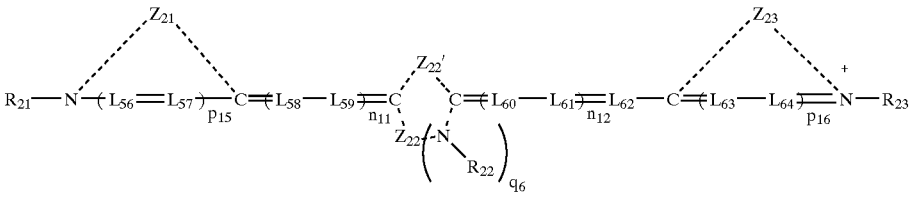

$M_6m_6$ wherein $L_{56}$, $L_{57}$, $L_{58}$, $L_{59}$, $L_{60}$, $L_{61}$, $L_{62}$, $L_{63}$ and $L_{64}$ each represents a methine group; $p_{15}$ and $p_{16}$ each represents 0 or 1; $q_6$ represents 0 or 1; $n_{11}$ and $n_{12}$ each represents 0, 1, 2, 3 or 4; $Z_{21}$ and $Z_{23}$, with which rings may be cyclocondensed, each represents an atomic group necessary to form a nitrogen-containing heterocyclic ring; $Z_{22}$ and $Z_{22}'$, with which rings may be cyclocondensed, each represents an atomic group necessary to form a heterocyclic ring together with $(N—R_{22})$ $q_6$, $M_6$ represents a counter ion for charge balance; $m_6$ represents a number of 0 or more necessary to neutralize charge of a molecule; and $R_{21}$, $R_{22}$ and $R_{23}$ each represents an alkyl group, an aryl group or a heterocyclic group.

(XVII)

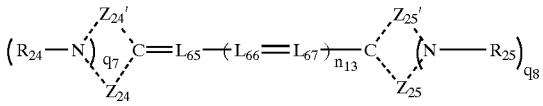

$M_7m_7$ wherein $L_{65}$, $L_{66}$ and $L_{67}$ each represents a methine group; $q_7$ and $q_8$ each represents 0 or 1; $n_{13}$ represents 0, 1, 2, 3 or 4; $Z_{24}$ and $Z_{24}'$, with which rings may be cyclocondensed, each represents an atomic group necessary to form a heterocyclic ring or an acyclic acidic end group together with $(N—R_{24})q_7$; $Z_{25}$ and $Z_{25}'$, with which rings may be cyclocondensed, each represents an atomic group necessary to form a heterocyclic ring or an acyclic acidic end group together with $(N—R_{25})q_8$, $M_7$ represents a counter ion for charge balance; $m_7$ represents a number of 0 or more necessary to neutralize charge of a molecule; and $R_{25}$ and $R_{26}$ each represents an alkyl group, an aryl group or a heterocyclic group.

$D_1$ of formula (XIII) is preferably a methine group represented by the above-described formula (XIV), (XV) or (XVI), and more preferably the methine group represented by formula (XIV). $D_2$ of formula (XIII) is preferably a methine group represented by the above-described formula (XIV), (XV) or (XVI), more preferably the methine group represented by formula (XIV) or (XV), and particularly preferably the methine group represented by formula (XIV).

Preferred examples thereof include cyanine dyes, merocyanine dyes, rhodacyanine dyes, trinuclear merocyanine dyes, tetranuclear merocyanine dyes, allopolar dyes, hemicyanine dyes and styryl dyes. More preferred are cyanine dyes, merocyanine dyes and rhodacyanine dyes, and particularly preferred are cyanine dyes. Details of these dyes are described in F. M. Harmer, *Heterocyclic Compounds-Cyanine Dyes and Related Compounds*, John Wiley & Sons, New York, London (1964); and D. M. Sturmer, *Heterocyclic Compounds-Special Topics in Heterocyclic Chemistry*, chapter 18, clause 14, pages 482 to 515. Formulas of the preferred dyes include formulas described in U.S. Pat. No. 5,994,051, pages 32 to 36, and formulas described in U.S. Pat. No. 5,747,236, pages 30 to 34. Further, formulas of the preferred cyanine dyes, merocyanine dyes and rhodacyanine dyes include formulas (XI), (XII) and (XIII) described in U.S. Pat. No. 5,340,694, columns 21 and 22 (with the proviso that the number of n12, n15, n17 and n18 is not restricted, and is an integer of 0 or more (preferably 4 or less)).

When the cyanine dye or the rhodacyanine dye is formed by $Q_1$ and $Q_2$, formulas (XI) and (XII) can be expressed by the following resonance formulas:

(XI)

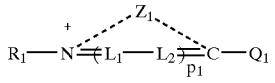

$M_1m_1$ (XII)

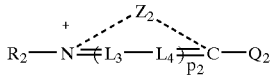

$M_2m_2$

In formulas (XI), (XII), (XIV), (XV) and (XVI), $Z_1$, $Z_2$, $Z_3$, $Z_4$, $Z_5$, $Z_7$, $Z_9$, $Z_{10}$, $Z_{11}$, $Z_{12}$, $Z_{14}$, $Z_{16}$, $Z_{17}$, $Z_{18}$, $Z_{19}$, $Z_{21}$ and $Z_{23}$, with which rings may be cyclocondensed, each represents an atomic group necessary to form a nitrogen-containing heterocyclic ring, preferably a 5- or 6-membered nitrogen-containing heterocyclic ring. The rings maybe either aromatic rings or non-aromatic rings. Preferred are aromatic rings, which include, for example, aromatic hydrocarbon rings such as a benzene ring and a naphthalene ring, and aromatic heterocyclic rings such as a pyrazine ring and a thiophene ring.

The nitrogen-containing heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus and a pyrimidine nucleus. Preferred are a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, 2-quinoline nucleus, a 4-quinoline nucleus, a 1-soquinoline nucleus and a 3-isoquinoline nucleus, more preferred are a benzothiazole nucleus, a benzoxazole nucleus, a 3,3-dialkylindolenine nucleus (e.g., 3,3-dimethylindolenine) and a benzimidazole nucleus, particularly preferred are a benzoxazole nucleus, a benzothiazole nucleus and a benzimidazole nucleus, and most preferred are a benzoxazole nucleus and a benzothiazole nucleus.

Taking a substituent group on the nitrogen-containing heterocyclic ring as V, there is no particular limitation on the substituent group represented by V. Examples thereof include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group (i.e., a hetero ring), a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group and a silyl group.

More particularly, V represents a hydrogen atom (e.g., chlorine, bromine, iodine), an alkyl group [which represents a straight-chain, branched-chain or cyclic substituted or unsubstituted alkyl group, including an alkyl group (preferably, an alkyl group having from 1 to 30 carbon atoms, e.g., methyl, ethyl, n-propyl, isopropyl, t-butyl, n-octyl, eicosyl, 2-chloroethyl, 2-cyanoethyl, 2-ethylhexyl), a cycloalkyl group (preferably, a substituted or unsubstituted cycloalkyl group having from 3 to 30 carbon atoms, e.g., cyclohexyl, cyclopentyl, 4-n-dodecylcyclohexyl), a bicycloalkyl group (preferably, a substituted or unsubstituted bicycloalkyl group having from 5 to 30 carbon atoms, that is to say, a monovalent group in which one hydrogen atom is eliminated from a bicycloalkane having from 5 to 30 carbon atoms, e.g., bicyclo[1,2,2]heptane-2-yl, bicyclo[2,2,2]octane-3-yl), and polycyclic structures such as a tricyclic structure; an alkyl group in a substituent group described below (for example, an alkyl group in an alkylthio group) represents an alkyl group having such a concept, but shall be considered to include also an alkenyl group and an alkynyl group], an alkenyl group [which represents a straight-chain, branched-chain or cyclic substituted or unsubstituted alkenyl group, including an alkenyl group (preferably, a substituted or unsubstituted alkenyl group having from 2 to 30 carbon atoms, e.g., vinyl, allyl, prenyl, geranyl, oleyl), a cycloalkenyl group (preferably, a substituted or unsubstituted cycloalkenyl group having from 3 to 30 carbon atoms, that is to say, a monovalent group in which one hydrogen atom is eliminated from a cycloalkene having from 3 to 30 carbon atoms, e.g., 2-cyclopentene-1-yl, 2-cyclohexene-1-yl), and a bicycloalkenyl group (a substituted or unsubstituted bicycloalkenyl group, preferably, a substituted or unsubstituted bicycloalkenyl group having from 5 to 30 carbon atoms, that is to say, a monovalent group in which one hydrogen atom is eliminated from a bicycloalkene having one double bond, e.g., bicyclo[2,2,1]hepto-2-ene-1-yl, bicyclo[2,2,2]octo-2-ene-4-yl,)], an alkynyl group (preferably, a substituted or unsubstituted alkynyl group having from 2 to 30 carbon atoms, e.g., ethynyl, propargyl, trimethylsilylethynyl), an aryl group (preferably, a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably, a monovalent group in which one hydrogen atom is eliminated from a 5- or 6-membered, substituted or unsubstituted, aromatic or non-aromatic heterocyclic compound, more preferably, a 5- or 6-membered aromatic heterocyclic group having from 3 to 30 carbon atoms, e.g., 2-furyl, 2-thienyl, 2-pyrimidinyl, 2-benzothiazolyl) a cyano group, a hydroxyl group, a nitro group, a carboxyl group, an alkoxyl group (preferably, a substituted or unsubstituted alkoxyl group having from 1 to 30 carbon atoms, e.g., methoxy, ethoxy, isopropoxy, t-butoxy, n-octyloxy, 2-methoxyethoxy), an aryloxy group (preferably, a substituted or unsubstituted aryloxy group having from 6 to 30 carbon atoms, e.g., phenoxy, 2-methylphenoxy, 4-t-butylphenoxy, 3-nitrophenoxy, 2-tetradecanoylaminophenoxy), a silyloxy group (preferably, a silyloxy group having from 3 to 20 carbon atoms, e.g., trimethylsilyloxy, t-butyldimethylsilyloxy), a heterocyclic oxy group (preferably, a substituted or unsubstituted heterocyclic oxy group having from 2 to 30 carbon atoms, e.g., 1-phenyltetrazole-5-oxy, 2-tetrahydropyranyloxy), an acyloxy group (preferably, a formyloxy group, a subsitituted or unsubstituted alkylcarbonyloxy group having 2 to 30 carbon atoms and a substituted or unsubstituted arylcarbonyloxy group having 6 to 30 carbon atoms, e.g., formyloxy, acetyloxy, pivaloyloxy, stearoyloxy, benzoyloxy, p-methoxyphenylcarbonyloxy), a carbamoyloxy group (preferably, a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably, a substituted or unsubstituted alkoxycarbonyloxy group having from 2 to 30 carbon atoms, e.g., methoxycarbonyloxy, ethoxycarbonyloxy, t-butoxycarbonyloxy, n-octylcarbonyloxy), an aryloxycarbonyloxy group (preferably, a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably, an amino group, a substituted or unsubstituted alkylamino group having from 1 to 30 carbon atoms, a substituted or unsubstituted anilino group having from 6 to 30 carbon atoms, e.g., amino, methylamino, dimethylamino, anilino, N-methylanilino, diphenylamino), an acylamino group (preferably, a formylamino group, a substituted or unsubstituted alkylcarbonylamino group having from 1 to 30 carbon atoms, a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably, a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably, a substituted or unsubstituted alkoxycarbonylamino group having from 2 to 30 carbon atoms, e.g., methoxycarbonylamino, ethoxycarbonylamino, t-butoxycarbonylamino, n-octadecyloxycarbonylamino, N-methylmethoxycarbonylamino), an aryloxycarbonylamino group (preferably, a substituted or unsubstituted aryloxycarbonylamino group having from 7 to 30 carbon atoms, e.g., phenoxycarbonylamino, p-chlorophenoxycarbonylamino, m-n-octyloxyphenoxycarbonylamino), a sulfamoylamino group (preferably, a substituted or unsubstituted sulfamoylamino group having from 0 to 30 carbon atoms, e.g., sulfamoylamino, N,N-dimethylaminosulfonylamino, N-n-octylaminosulfonylamino), an alkylsulfonylamino and arylsulfonylamino groups (preferably, a substituted or unsubstituted alkylsulfonylamino group having from 1 to 30 carbon atoms, a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably, a substituted or unsubstituted alkylthio group having from 1 to 30 carbon atoms, e.g., methylthio, ethylthio, n-hexadecylthio), an arylthio group (preferably, a substituted or unsubstituted arylthio group having from 6 to 30 carbon atoms, e.g., phenylthio, p-chlorophenylthio, m-methoxyphenylthio), a heterocyclic thio group (preferably, a substituted or unsubstituted heterocyclic thio group having from 2 to 30 carbon atoms, e.g., 2-benzothiazolylthio, 1-phenyltetrazole-5-ylthio, a sulfamoyl group (preferably, a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl) sulfamoyl, a sulfo group, an alkylsulfinyl and arylsulfinyl groups (preferably, a substituted or unsubstituted alkylsulfinyl group having from 1 to 30 carbon atoms, a substituted or unsubstituted arylsulfinyl group having from 6 to 30 carbon atoms, e.g., methylsulfinyl, ethylsulfinyl, phenylsulfinyl, p-methylphenylsulfinyl), an alkylsulfonyl and arylsulfonyl groups (preferably, a substituted or unsubstituted alkylsulfonyl group having from 1 to 30 carbon atoms, a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably, a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having 4 to 30 carbon atoms linked by a carbon atom to a carbonyl group, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably, a substituted or unsubstituted aryloxycarbonyl group having from 7 to 30 carbon atoms, e.g., phenoxycarbonyl, o-chlorophenoxycarbonyl, m-nitrophenoxycarbonyl, p-t-butylphenoxycarbonyl), an alkoxycarbonyl group (preferably, a substituted or unsubstituted alkoxycarbonyl group having from 2 to 30 carbon atoms, e.g., methoxycarbonyl, ethoxycarbonyl, t-buthoxycarbonyl, n-octadecyloxycarbonyl), a carbamoyl group (preferably, a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an arylazo and heterocyclic azo groups (preferably, a substituted or unsubstituted arylazo group having from 6 to 30 carbon atoms, a substituted or unsubstituted heterocyclic azo group having from 3 to 30 carbon atoms, e.g., phenylazo, p-chlorophenylazo, 5-ethylthio-1,3,4-thiadiazole-2-ylazo), an imido group (preferably, N-succinimido, N-phthalimido), a phosphino group (preferably, a substituted or unsubstituted phosphino group having from 2 to 30 carbon atoms, e.g., dimethylphosphino, diphenylphosphino, methylphenoxyphosphino), a phosphinyl group (preferably, a substituted or unsubstituted phosphinyl group having from 2 to 30 carbon atoms, e.g., phosphinyl, dioctyloxyphosphinyl, diethoxyphosphinyl), a phosphinyloxy group (preferably, a substituted or unsubstituted phosphinyloxy group having from 2 to 30 carbon atoms, e.g., diphenoxyphosphinyloxy, dioctyloxyphosphinyloxy), a phosphinylamino group (preferably, a substituted or unsubstituted phosphinylamino group having from 2 to 30 carbon atoms, e.g., dimethoxyphosphinylamino, dimethylaminophosphinylamino) and a silyl group (preferably, a substituted or unsubstituted silyl group having from 3 to 30 carbon atoms, e.g., trirmethylsilyl, t-butyldimethylsilyl, phenyldimethylsilyl).

Further, the rings (aromatic or non-aromatic hydrocarbon rings or heterocyclic rings) can have condensed structures. They can be further combined to form polycyclic condensed rings. Examples thereof include a benzene ring, a naphthalene ring, an anthracene ring, a quinoline ring, a phenanthrene ring, a fluorine ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthyridine ring, a quinoxaline ring, a quinoxazoline ring, a carbazole ring, a phenanthridine ring, an acridine ring, a phenanthroline ring, a thianthrene ring, a chromene ring, a xanthene ring, a phenoxathiin ring, a phenothiazine ring and a phenazine ring.

Of the above-described functional groups, ones having hydrogen atoms may be substituted by the above-described groups after elimination of the hydrogen atoms. Examples of such functional groups include an alkylcarblonylaminosulfonyl group, an arylcarblonylaminosulfonyl group, an alkylsulfonylaminocarbonyl group and an arylsulfonylaminocarbonyl group. Examples thereof include methylsulfonylaminocarbonyl, p-methylphenylsulfonylaminocarbonyl, acetylaminosulfonyl and benzoylaminosulfonyl.

Preferred examples of the substituent groups are the above-described alkyl group, aryl group, alkoxyl group, halogen atom, aromatic ring condensation group, sulfo group, carboxyl group and hydroxyl group.

Substituent groups on $Z_1$, $Z_2$, $Z_3$, $Z_4$, $Z_5$, $Z_7$, $Z_9$, $Z_{10}$, $Z_{11}$, $Z_{12}$, $Z_{14}$ and $Z_{16}$ are preferably aromatic groups or aromatic ring condensation groups. Particularly preferred is the case that each of substituent groups V described above has at least one group (preferably two or more, more preferably four or more and still more preferably six or more groups) represented by formula (I) or (II), or the case that each of substituent groups V described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

When the methine dyes represented by formula (XIV), (XV) or (XVI) indicate the dye chromophoric groups represented by $D_1$ in formula (XIII), substituent groups on $Z_{17}$, $Z_{18}$, $Z_{19}$, $Z_{21}$ and $Z_{23}$ are more preferably aromatic groups or aromatic ring condensation groups. Particularly preferred is the case that each of substituent groups V described above has at least one group (preferably two or more, more preferably four or more and still more preferably six or more groups) represented by formula (I) or (II), or the case that each of substituent groups V described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

When the methine dyes represented by formula (XIV), (XV) or (XVI) indicate the dye chromophoric groups represented by $D_2$ in formula (XIII), substituent groups on $Z_{17}$, $Z_{18}$, $Z_{19}$, $Z_{21}$ and $Z_{23}$ are more preferably a carboxyl group, a sulfo group and a hydroxyl group, and particularly preferably a sulfo group. Particularly preferred is the case that each of substituent groups V described above has at least one group (preferably two or more, more preferably four or more and still more preferably six or more groups) represented by formula (I) or (II), or the case that each of substituent groups V described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

$Z_6$, $Z_6'$ and $(N—R_6)$ $q_1$, $Z_{13}$, $Z_{13}'$ and $(N—R_{13})$ $q_3$, $Z_{20}$, $Z_{20}'$ and $(N—R_{20})$ $q_5$, and $Z_{24}$, $Z_{24}'$ and $(N—Z_{24})$ $q_7$, and $Z_{25}$, $Z_{25}'$ and $(N—R_{25})$ $q_8$, each represents an atomic group necessary to form a heterocyclic ring or an acyclic acidic end group together. Although the heterocyclic ring (preferably, the 5- or 6-membered heterocyclic ring) may be any, an acidic nucleus is preferred. The acidic nuclei and acyclic acidic end groups are described below. The acidic nuclei and acyclic acidic end groups can also have the form of the acidic nuclei and acyclic acidic end groups of any general merocyanine dyes. In a preferred form, $Z_6$, $Z_{13}$, $Z_{20}$, $Z_{24}$ and $Z_{25}$ are a thiocarbonyl group, a carbonyl group, an ester group, an acyl group, a carbamoyl group, a cyano group and a sulfonyl group, and more preferably a thiocarbonyl group and a carbonyl group. $Z_6'$, $Z_{13}'$, $Z_{20}'$, $Z_{24}'$ and $Z_{25}'$ represent remaining atomic groups necessary to form the acidic nuclei and acyclic acidic end groups. When the acyclic acidic end groups are formed, preferred are a thiocarbonyl group, a carbonyl group, an ester group, an acyl group, a carbamoyl group, a cyano group and a sulfonyl group.

$q_1$, $q_3$, $q_5$, $q_7$ and $q_8$ are 0 or 1, and preferably 1.

The acidic nuclei and acyclic acidic end groups used herein are described, for example, in *The Theory of the Photographic Process*, the fourth edition, edited by James, pages 198 to 200, Macmillan (1977). The term "acyclic acidic end group" as used herein means a group forming no ring, of acidic, namely electron acceptable end groups.

Specific examples of the acidic nuclei and acyclic acidic end groups include ones described in U.S. Pat. Nos. 3,567,719, 3,575,869, 3,804,634, 3,837,862, 4,002,480 and 4,925,777, JP-A-3-167546, U.S. Pat. Nos. 5,994,051 and 5,747,236.

The acidic nucleus is preferably a heterocyclic ring comprising carbon, nitrogen and/or a chalcogen atom, and more psreferably a 5- or 6-membered nitrogen-containing heterocycle comprising carbon, nitrogen and/or a chalcogen atom (typically, oxygen, sulfur, selenium or tellurium). The specific examples of the nuclei include 2-pyrazoline-5-one, pyrazolidine-3,5-dione, imidazoline-5-one, hydantoin, 2- or 4-thiohydantoin, 2-iminooxazolidine-4-one, 2-oxazoline5-one, 2-thiooxazolidine-2,5-dione, 2-thiooxazoline-2,4-dione, isooxazoline-5-one, 2-thiazoline-4-one, thiazolidine-4-one, thiazolidine-2,4-dione, rhodanine, thiazolidine-2,4-dithione, isorhodanine, indan-1,3-dione, thiophene-3-one, thiophene-3-one-1,1-dioxide, indoline-2-one, indoline-3-one, 2-oxoindazlinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazoline-2-one, pyrido[1,2-a]pyrimidine-1,3-dione, pyrazole [1,5-b]quinazolone, pyrazole[1,5-a]benzoimidazole, pyrazolopyridone, 1,2,3,4-tetrahydroquinoline2,4-dione, 3-oxo-2,3-dihydrobenzo[d]thiophene-1,1-dioxide and 3-dicyanomethine-2,3-dihydrobenzo[d]thiophene-1,1-dioxide.

They further include nuclei having an exo-methylene structure in which the carbonyl groups or thiocarbonyl groups forming these nuclei are substituted at active methylene positions of the acidic nuclei, and nuclei having an exo-methylene structure in which substitution is conducted at active methylene positions of active methylene compounds having a structure of ketomethylene or cyanomethylene which is a raw material for the acyclic acidic end groups.

These acidic nuclei and acyclic acidic end groups may be substituted by or cyclocondensed with substituent groups or rings indicated by the above-described substituent groups V. Preferred is the case that each of substituent groups V described above has at least one group (preferably two or more, more preferably four or more and still more preferably six or more groups) represented by formula (I) or (II), or the case that each of substituent groups V described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

Preferred examples of the heterocyclic rings formed by $Z_6$, $Z_6'$ and $(N—R_6)q_1$, $Z_{13}$, $Z_{13}'$ and $(N—R_{13})q_3$, $Z_{20}$, $Z_{20}'$ and $(N—R_{20})q_5$, and $Z_{24}$, $Z_{24}'$ and $(N—R_{24})q_7$, and $Z_{25}$, $Z_{25}'$ and $(N—R_{25})q_8$ include hydantoin, 2- or 4-thiohydantoin, 2-oxazoline-5-one, 2-thiooxazoline-2,4-dione, thiazolidine-2,4-dione, rhodanine, thiazolidine-2,4-dithione, barbituric acid and 2-thiobarbituric acid. More preferred are hydantoin, 2- or 4-thiohydantoin, 2-oxazoline-5-one, rhodanine, barbituric acid and 2-thiobarbituric acid, and particularly preferred are 2- or 4-thiohydantoin, 2-oxazoline-5-one, rhodanine and barbituric acid.

Examples of the heterocyclic rings formed by $Z_8$, $Z_8'$ and $(N—R_8)q_2$, $Z_{15}$, $Z_{15}'$ and $(N—R_{15})$ $q_4$, and $Z_{22}$, $Z_{22}'$ and $(N—R_{22})q_6$ include the heterocyclic rings described for the heterocyclic rings formed by $Z_6$, $Z_6'$ and $(N—R_6)q_1$, $Z_{13}$, $Z_{13}'$ and $(N—R_{13})$ $q_3$, $Z_{20}$, $Z_{20}'$ and $(N—R_{20})q_5$, and $Z_{24}$, $Z_{24}'$ and $(N—R_{24})q_7$, and $Z_{25}$, $Z_{25}'$ and $(N—R_{25})q_8$. Preferred are $(N—R_{13})$ $q_3$, $Z_{20}$, $Z_{20}'$ ones in which oxo groups or thioxo groups are eliminated from the acidic groups described for the heterocyclic rings formed by $Z_6$, $Z_6'$ and $(N—R_6)q_1$, $Z_{13}$, $Z_{13}'$ and $(N—R_{13})q_3$, $Z_{20}$, $Z_{20}'$ and $(N—R_{20})q_5$, and $Z_{24}$, $Z_{24}'$ and $(N—R_{24})q_7$, and $Z_{25}$, $Z_{25}'$ and $(N—R_{25})q_8$.

More preferred are ones in which oxo groups or thioxo groups are eliminated from the acidic groups specifically described for the heterocyclic rings formed by $Z_6$, $Z_6'$ and $(N—R_6)q_1$, $Z_{13}$, $Z_{13}'$ and $(N—R_{13})q_3$, $Z_{20}$, $Z_{20}'$ and $(N—R_{20})q_5$, and $Z_{24}$, $Z_{24}'$ and $(N—R_{24})q_7$, and $Z_{25}$, $Z_{25}'$ and $(N—R_{25})q_8$.

Still more preferred are ones in which oxo groups or thioxo groups are eliminated from hydantoin, 2- or 4-thiohydantoin, 2-oxazoline-5-one, 2-thiooxazoline-2,4-dione, thiazolidine-2,4-dione, rhodanine, thiazolidine-2,4-dithione, barbituric acid and 2-thiobarbituric acid, particularly preferred are ones in which oxo groups or thioxo groups are eliminated from hydantoin, 2- or 4-thiohydantoin, 2-oxazoline-5-one, rhodanine, barbituric acid and 2-thiobarbituric acid, and particularly preferred are ones in which oxo groups or thioxo groups are eliminated from 2- or 4-thiohydantoin, 2-oxazoline-5-one and rhodanine.

$q_2$, $q_4$ and $q_6$ are 0 or 1, and preferably 1.

$R_1$ to $R_{25}$ each represents an alkyl group, an aryl group or a heterocyclic group. Specific examples thereof include an unsubstituted alkyl group having from 1 to 18 carbon atoms, preferably from 1 to 7 carbon atoms, particularly preferably from 1 to 4 carbon atoms (e.g., methyl, ethyl, propyl, isopropyl, butyl, isobutyl, hexyl, octyl, dodecyl, octadecyl); a substituted alkyl group having from 1 to 18 carbon atoms, preferably from 1 to 7 carbon atoms, particularly preferably from 1 to 4 carbon atoms [for example, an alkyl group substituted by substituent group V described above, preferably, an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-[3-sulfopropoxy]ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic ring-substituted alkyl group (e.g., 2-(pyrrolidine-2-one-1-yl)ethyl, tetrahydrofuryl), an alkylsulfonylcarbamoylalkyl group (e.g., methanesulfonylcarbamoylmethyl) an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl); an unsubstituted aryl group having from 6 to 20 carbon atoms, preferably from 6 to 10 carbon atoms, still more preferably from 6 to 8 carbon atoms (e.g., phenyl, 1-naphthyl), a substituted aryl group having from 6 to 20 carbon atoms, preferably from 6 to 10 carbon atoms, still more preferably from 6 t 8 carbon atoms (for example, an aryl group substituted by substituent group V described above, specifically, p-methoxyphenyl, p-methylphenyl, p-chlorophenyl); an unsubstituted heterocyclic group having form 1 to 20 carbon atoms, preferably from 3 to 10 carbon atoms, more preferably from 4 to 8 carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), a substituted heterocyclic group having form 1 to 20 carbon atoms, preferably from 3 to 10 carbon atoms, more preferably from 4 to 8 carbon atoms (for example, a heterocyclic group substituted by substituent group V described above, specifically, 5-methyl-2-thienyl, 4-methoxy-2-pyridyl).

$R_1$ and $R_3$ to $R_9$ are preferably aromatic ring-containing groups. The aromatic rings include aromatic hydrocarbon rings and aromatic heterocyclic rings. They may further be polycyclic condensed rings in which aromatic hydrocarbon rings or aromatic heterocyclic rings are condensed with each other, or polycyclic condensed ring structures in which aromatic hydrocarbon rings are combined with aromatic heterocyclic rings. They may be substituted by substituent groups V described above. Preferred examples of the aromatic rings include the examples of the aromatic rings described above for the aromatic groups. More preferred is the case that each of the substituent groups described above has at least one group (preferably two or more, more preferably four or more and still more preferably six or more groups) represented by formula (I) or (II), or the case that each of the substituent groups described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom). Particularly preferred is the case that each of the substituent groups described above has an aromatic group and at least one group (preferably two or more, more preferably four or more and still more preferably six or more groups) represented by formula (I) or (II), or the case that each of the substituent groups described above has an aromatic group and two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

The aromatic ring containing group can be expressed by $-Lb-A_1$, wherein Lb represents a single bond or a connecting group, and $A_1$ represents an aromatic group. Preferred examples of the connecting groups Lb include the connecting groups described above for La. Preferred examples of the aromatic groups $A_1$ include the examples of the aromatic groups described above.

Preferred examples of the aromatic hydrocarbon ring-containing alkyl groups include an aralkyl group (e.g., benzyl, 2-phenylethyl, naphthylmethyl, 2-(4-biphenyl) ethyl), an aryloxyalkyl group (e.g., 2-phenoxyethyl, 2-(1-naphthoxy)ethyl, 2-(4-biphenyloxy)ethyl, 2-(o-, m- or p-halophenoxy)ethyl, 2-(o-, m- or p-methoxyphenoxy) ethyl) and an aryloxycarbonylalkyl group (3-phenoxycarbonylpropyl, 2-(1-naphthoxycarbonyl)ethyl). Examples of the aromatic heterocyclic ring-containing alkyl groups include 2-(2-pyridyl)ethyl, 2-(4-pyridyl)ethyl, 2-(2-furyl)ethyl, 2-(2-thienyl)ethyl and 2-(2-pyridylmethoxy) ethyl. Aromatic hydrocarbon groups include 4-methoxyphenyl, phenyl, naphthyl and biphenyl. The aromatic heterocyclic groups include 2-thienyl, 4-chloro-2-thienyl; 2-pyridyl and 3-pyrazolyl.

More preferred are alkyl groups having the above-described substituted or unsubstituted aromatic hydrocarbon rings or aromatic heterocyclic rings. Particularly preferred are alkyl groups having the above-described substituted or unsubstituted aromatic hydrocarbon rings.

$R_2$ and $R_{10}$ to $R_{16}$ are preferably aromatic ring-containing groups. Both of $R_{10}$ and $R_{11}$, at least one of $R_{12}$ and $R_{13}$, and at least two of $R_{14}$, $R_{15}$ and $R_{16}$ have anionic substituent groups. Further, it is preferred that $R_2$ has an anionic substituent group. The aromatic rings include aromatic hydrocarbon rings and aromatic heterocyclic rings. They may further be polycyclic condensed rings in which aromatic hydrocarbon rings or aromatic heterocyclic rings are condensed with each other, or polycyclic condensed rings in which aromatic hydrocarbon rings are combined with aromatic heterocyclic rings. They may be substituted by substituent groups V described above. Preferred examples of the aromatic rings include the examples of the aromatic rings described above for the aromatic groups. More preferred is the case that each of the substituent groups described above has at least one group (preferably two or more, more preferably four or more and still more preferably six or more groups) represented by formula (I) or (II), or the case that each of the substituent groups described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom). Particularly preferred is the case that each of the substituent groups described above has an aromatic group and at least one group (preferably two or more, more preferably four or more and still more preferably six or more groups) represented by formula (I) or (II), or the case that each of the substituent groups described above has an aromatic group and two or more groups represented by formula (I) or (II), which are present in positions close to each other (preferably adjacent to each other with the interposition of from 0 to 3 carbon atoms or other atoms, and more preferably with the interposition of 0 or one carbon atom or other atom)

The aromatic ring containing group can be expressed by -Lc-$A_2$, wherein Lc represents a single bond or a connecting group, and $A_2$ represents an aromatic group. Preferred examples of the connecting groups Lc include the connecting groups described above for La. Preferred examples of the aromatic groups $A_2$ include the examples of the aromatic groups described above. Lc or $A_2$ is preferably substituted by at least one anionic substituent group.

Preferred examples of the aromatic hydrocarbon ring-containing alkyl groups include a sulfo group-, phosphoric acid group- and/or carboxyl group-substituted aralkyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), a sulfo group-, phosphoric acid group- and/or carboxyl group-substituted aryloxycarbonylalkyl group (e.g., 3-sulfophenoxycarbonylpropyl), and a sulfo group-, phosphoric acid group- and/or carboxyl group-substituted aryloxyalkyl group (e.g., 2-(4-sulfophenoxy) ethyl, 2-(2-phosphophenoxy)ethyl, 4,4-diphenoxy-3-sulfobutyl).

The aromatic heterocyclic group-containing alkyl groups include 3-(2-pyridyl)-3-sulfopropyl, 3-(2-furyl)-3-sulfopropyl and 2-(2-thienyl)-2-sulfopropyl.

The aromatic hydrocarbon groups include a sulfo group-, phosphoric acid group- and/or carboxyl group-substituted aryl group (e.g., 4-sulfophenyl, 4-sulfonaphthyl), and the aromatic heterocyclic groups include a sulfo group-, phosphoric acid group- and/or carboxyl group-substituted heterocyclic group (e.g., 4-sulfo-2-thienyl, 4-sulfo-2-pyridyl).

More preferred are the above-described alkyl groups having sulfo group-, phosphoric acid group- and/or carboxyl group-substituted aromatic hydrocarbon rings or aromatic heterocyclic rings, and particularly preferred are the above-described alkyl groups having sulfo group-, phosphoric acid group- and/or carboxyl group-substituted aromatic hydrocarbon rings. Most preferred are 2-sulfobenzyl, 4-sulfobenzyl, 4-sulfophenethyl, 3-phenyl-3-sulfopropyl and 4-phenyl-4-sulfobutyl.

When the methine dyes represented by formula (XIV), (XV), (XVI) or (XVII) indicate the chromophoric groups represented by $D_1$ in formula (XIII), substituent groups represented by $R_{17}$ to $R_{25}$ are preferably the above-described unsubstituted alkyl groups and substituted alkyl groups (e.g., carboxyalkyl, sulfoalkyl, aralkyl, aryloxyalkyl). More preferred is the case that each of the substituent groups described above has at least one group (preferably two or more, more preferably four or more and still more preferably six or more groups) represented by formula (I) or (II), or the case that each of the substituent groups described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom). Particularly preferred is the case that each of the substituent groups described above has an aromatic group and at least one group (preferably two or more, more preferably four or more and still more preferably six or more groups) represented by formula (I) or (II), or the case that each of the substituent groups described above has an aromatic group and two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

When the methine dyes represented by formula (XIV), (XV), (XVI) or (XVII) indicate the chromophoric groups represented by $D_2$ in formula (XIII), substituent groups represented by $R_{17}$ to $R_{25}$ are preferably unsubstituted alkyl groups and substituted alkyl groups, more preferably alkyl groups having anionic substituent groups (e.g., carboxyalkyl, sulfoalkyl), and still more preferably sulfoalkyl groups. More preferred is the case that each of the substituent groups described above has at least one group (preferably two or more, more preferably four or more and still more preferably six or more groups) represented by formula (I) or (II), or the case that each of the substituent groups described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom). Particularly preferred is the case that each of the substituent groups described above has an aromatic group and at least one group (preferably two or more, more preferably four or more and still more preferably six or more groups) represented by formula (I) or (II), or the case that each of the substituent groups described above has an aromatic group and two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

$L_1$ to $L_{67}$ each independently represents a methine group. The methine groups represented by $L_1$ to $L_{67}$ may have substituent groups, which include substituent groups V described above. Examples thereof include a substituted or unsubstituted alkyl group having from 1 to 15 carbon atoms, preferably from 1 to 10 carbon atoms, and particularly preferably from 1 to 5 carbon atoms (e.g., methyl, ethyl, 2-carboxyethyl), a substituted or unsubstituted aryl group having from 6 to 20 carbon atoms, preferably from 6 to 15 carbon atoms, and more preferably from 6 to 10 carbon atoms (e.g., phenyl, o-carboxyphenyl), a substituted or unsubstituted heterocyclic group having from 3 to 20 carbon atoms, preferably from 4 to 15 carbon atoms, and more preferably from 6 to 10 carbon atoms (e.g., N,N-dimethylbarbituric acid), a halogen atom (e.g., chlorine, bromine, iodine, fluorine), an alkoxyl group having from 1 to 15 carbon atoms, preferably from 1 to 10 carbon atoms, and more preferably from 1 to 5 carbon atoms (e.g., methoxy, ethoxy), an amino group having from 0 to 15 carbon atoms, preferably from 2 to 10 carbon atoms, and more preferably from 4 to 10 carbon atoms (e.g., methylamino, N,N-dimethylamino, N-methyl-N-phenylamino, N-methylpiperazino), an alkylthio group having from 1 to 15 carbon atoms, preferably from 1 to 10 carbon atoms, and more preferably from 1 to 5 carbon atoms (e.g., methylthio, ethylthio) and an arylthio group having from 6 to 20 carbon atoms, preferably from 6 to 12 carbon atoms, and more preferably from 6 to 10 carbon atoms (e.g., phenylthio, p-methylphenylthio). They may form rings with other methine groups, and can also form rings with $Z_1$ to $Z_{26}$ and $R_1$ to $R_{25}$.

$L_1$ to $L_6$, $L_{10}$ to $L_{13}$, $L_{16}$, $L_{17}$, $L_{23}$ to $L_{26}$, $L_{30}$ to $L_{33}$, $L_{36}$, $L_{37}$, $L_{43}$ to $L_{46}$, $L_{50}$ to $L_{53}$, $L_{56}$, $L_{57}$, $L_{63}$ and $L_{64}$ are preferably unsubstituted methine groups. More preferred is the case that each of the substituent groups described above has at least one group (preferably two or more, more preferably four or more and still more preferably six or more groups) represented by formula (I) or (II), or the case that each of the substituent groups described above has two or more groups represented by formula (I) or (II), which are present in positions close to each other (preferably adjacent to each other with the interposition of from 0 to 3 carbon atoms or other atoms, and more preferably with the interposition of 0 or one carbon atom or other atom). Particularly preferred is the case that each of the substituent groups described above has an aromatic group and at least one group (preferably two or more, more preferably four or more and still more preferably six or more groups) represented by formula (I) or (II), or the case that each of the substituent groups described above has an aromatic group and two or more groups represented by formula (I) or (II), which are present in positions close to each other (preferably adjacent to each other with the interposition of from 0 to 3 carbon atoms or other atoms, and more preferably with the interposition of 0 or one carbon atom or other atom).

$n_1$ to $n_{13}$ each independently represents 0, 1, 2, 3 or 4, preferably 0, 1, 2 or 3, more preferably 0, 1 or 2, and particularly preferably 0 or 1. When $n_1$ to $n_{13}$ are 2 or more, the methine group is repeated. However, the repeated methine groups are not required to be the same.

$p_1$ to $p_{16}$ each independently represents 0 or 1, and preferably 0.

$M_1$ to $M_7$ are contained in the formulas for indicating the existence of cations or anions when they are necessary to neutralize ion charge of the dyes. Typical examples of the cations include inorganic cations such as a hydrogen ion (H+), an alkali metal ion (e.g., a sodium ion, a potassium ion, a lithium ion) and an alkaline earth metal ion (e.g., a calcium ion); and organic ions such as an ammonium ion (e.g., an ammonium ion, a tetraalkylammonium ion, triethylammonium ion, a pyridinium ion, an ethylpyridinium ion, a 1,8-diazabicyclo[5.4.0]-7-undecenium ion). The cations may be either inorganic cation or organic cations, and include a halogen cation (e.g., a fluorine ion, a chlorine ion, a iodine ion), a substituted arylsulfonic acid ion (e.g., a p-toluenesulfonic acid ion, a p-chlorobenzenesulfonic acid ion), an aryldisulfonic acid ion (e.g., a 1,3-benzenesulfonic acid ion, a 1,5-naphthalenedisulfonic acid ion, a 2,6-naphthalenedisulfonic acid ion), an alkylsulfuric acid ion (e.g., a methylsulfuric acid ion, a sulfuric acid ion, a thiocyanic acid ion, a perchloric acid ion, a tetrafluoroboric acid ion, a picric acid ion, an acetic acid ion and a trifluoromethanesulfonic acid ion. Further, ionic polymers or other dyes having reverse charge to the dyes may be used. Further, it is also possible to show $CO_2^-$ and $SO_3^-$ as $CO_2H$ and $SO_3H$, respectively, when they have hydrogen ions as counter ions.

$m_1$ to $m_7$ each represents a number of 0 or more necessary for balancing charge. The number is preferably from 0 to 4, and more preferably from 0 to 1. When a salt is formed in a molecule, it is 0.

Only specific examples of the dyes used in particularly preferred embodiments of the present invention described above will be shown below, but are not to be construed as limiting the present invention.

I-1
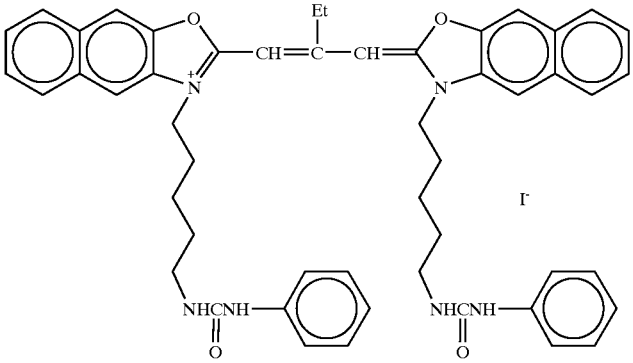
I-2
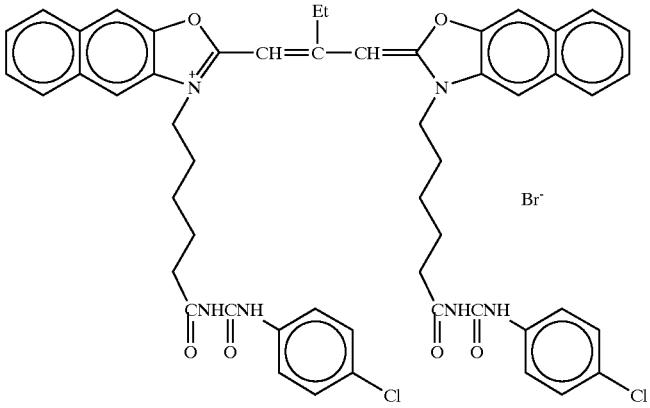
I-3
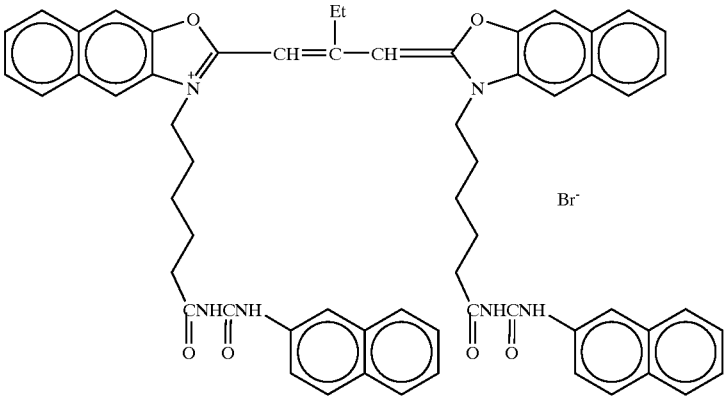
I-4
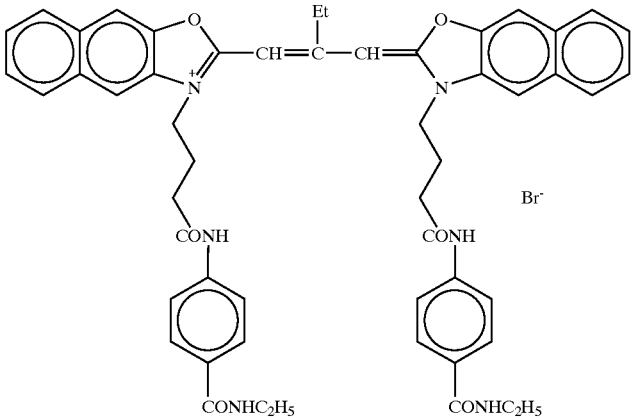

-continued
I-5
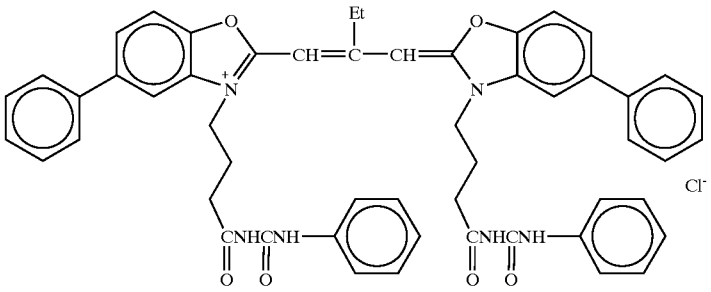
I-6
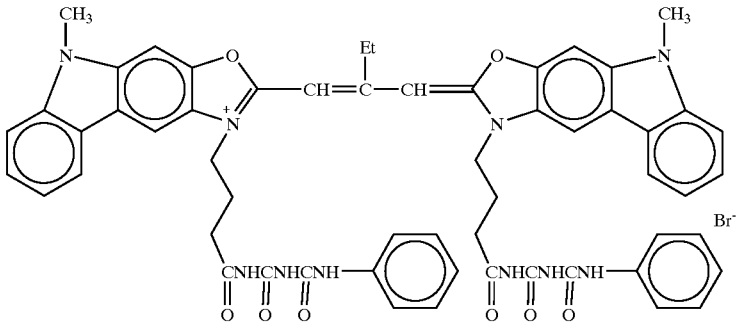
I-7
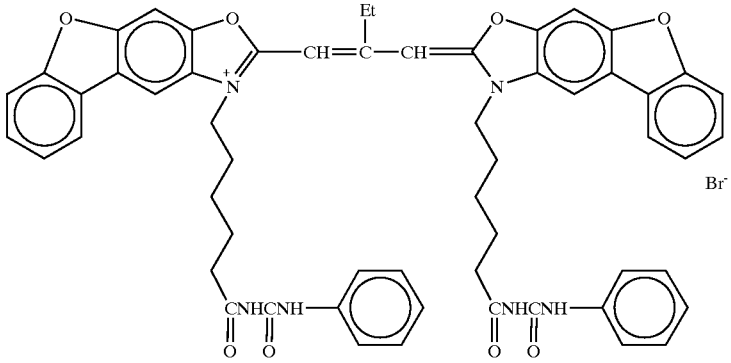
I-8
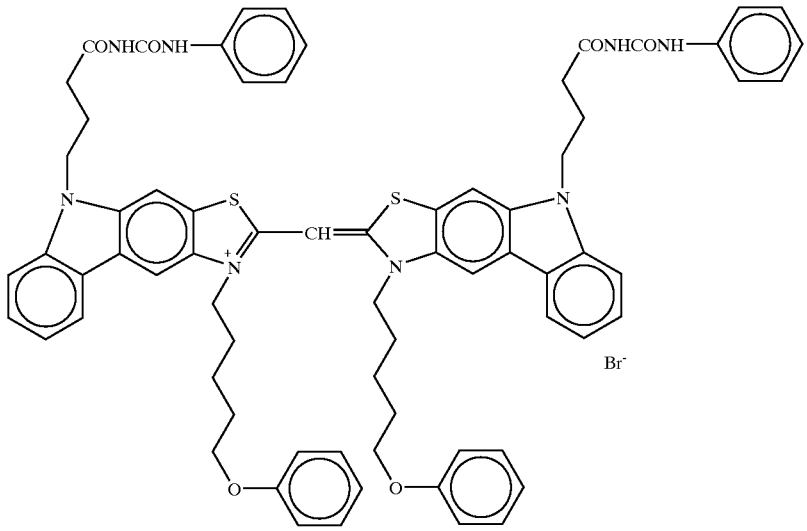

-continued
I-9
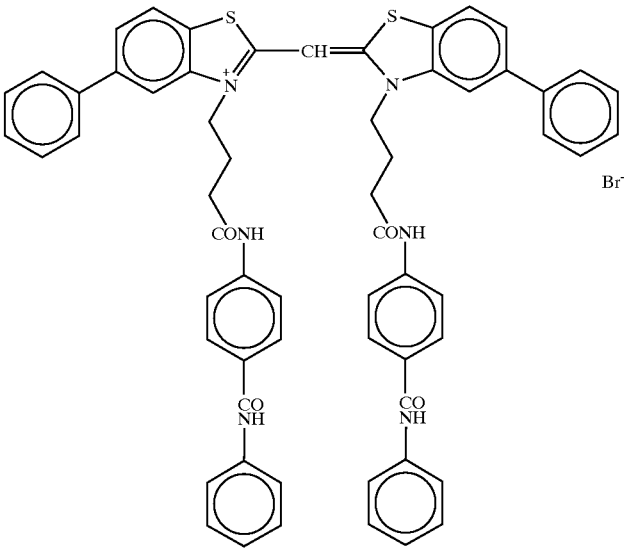
I-10
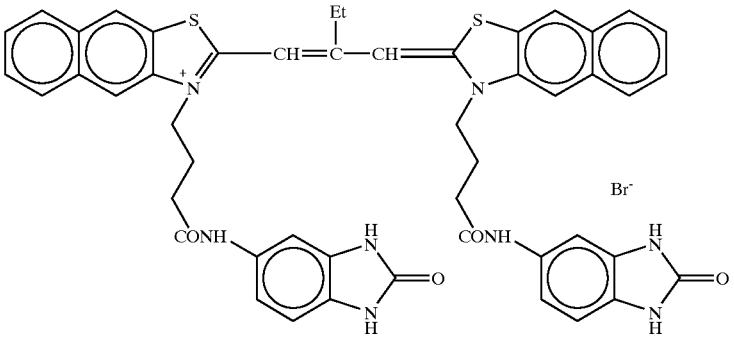
I-11
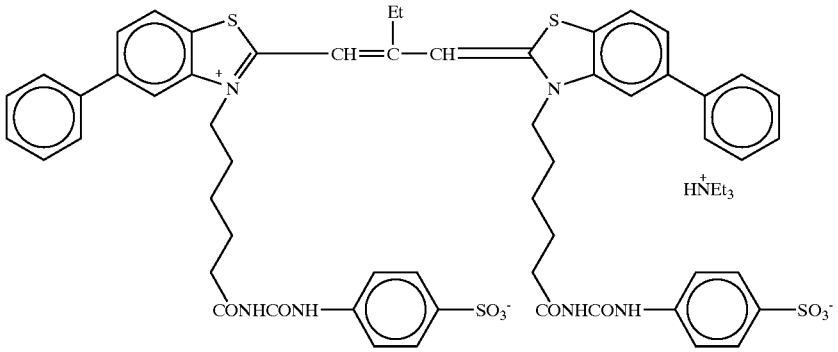

-continued
I-12
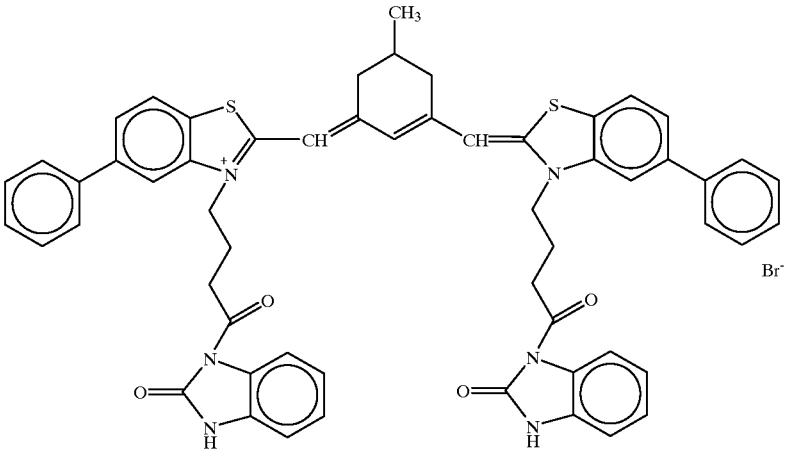
I-13
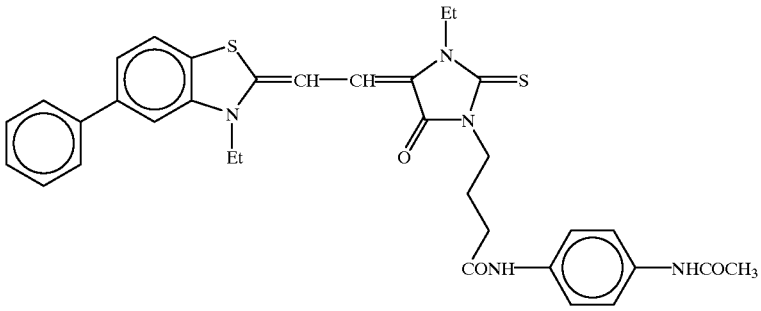
I-14
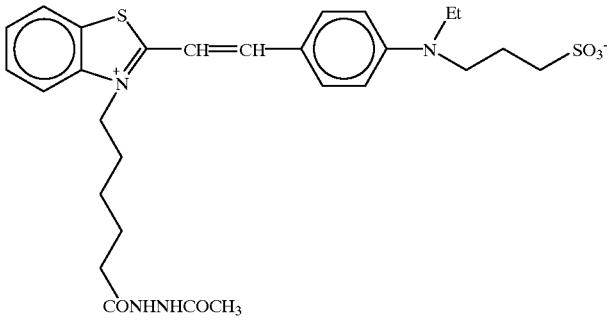
Preferred examples of the simultaneous use of two kinds of dyes will be shown below, but are not to be construed as limiting the present invention.

Use of
I-15
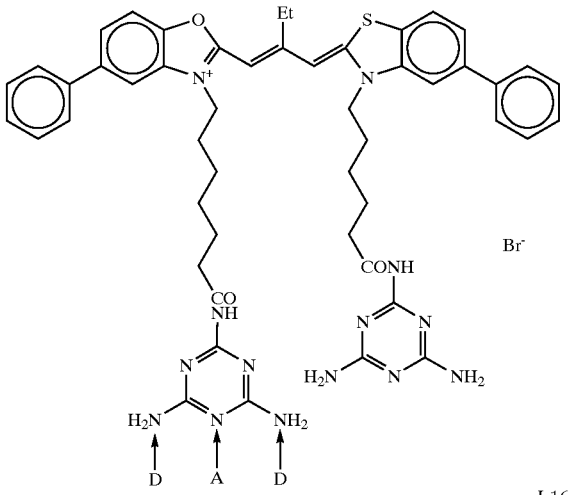
in combination with
I-16
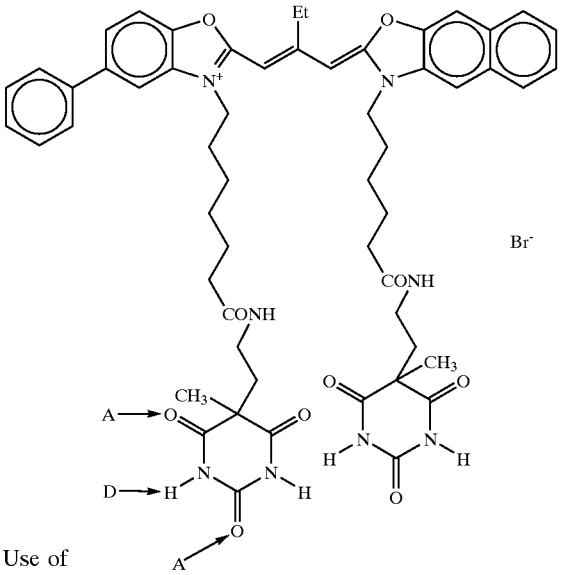
Use of
I-17
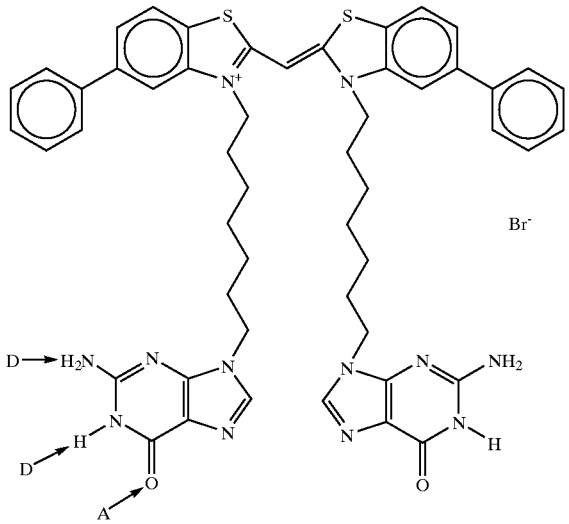
in combination with
I-18
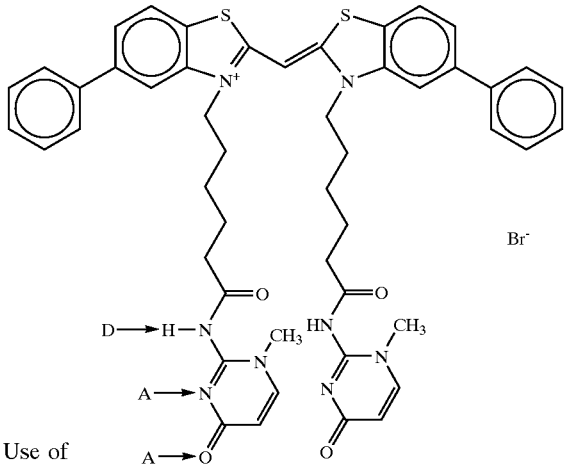
Use of
I-19
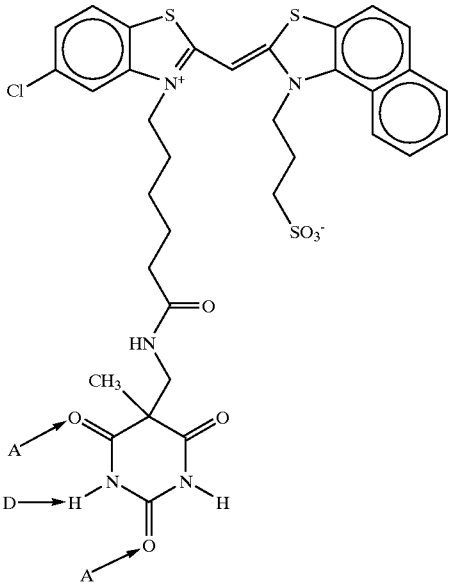
in combination with
I-20
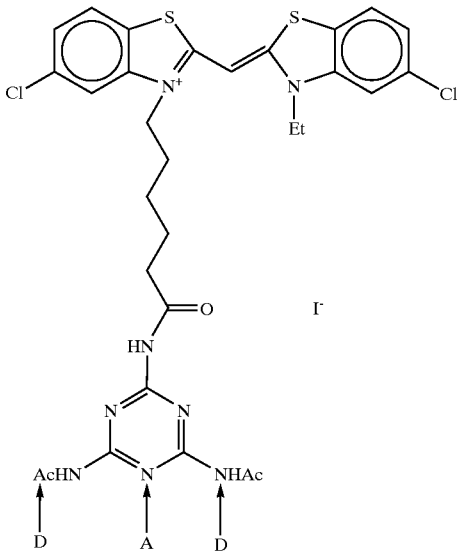

Use of

I-21

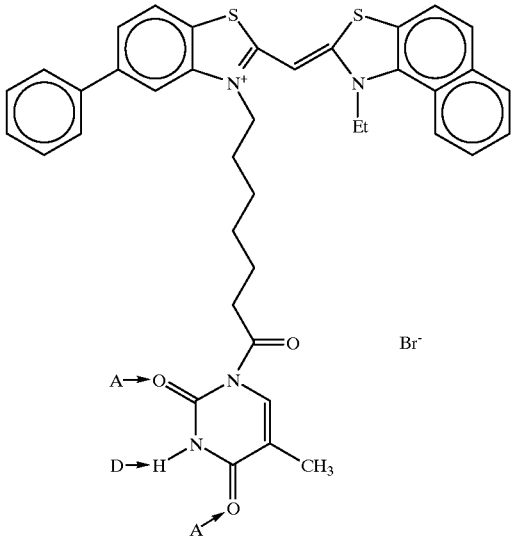

in combination with

I-22

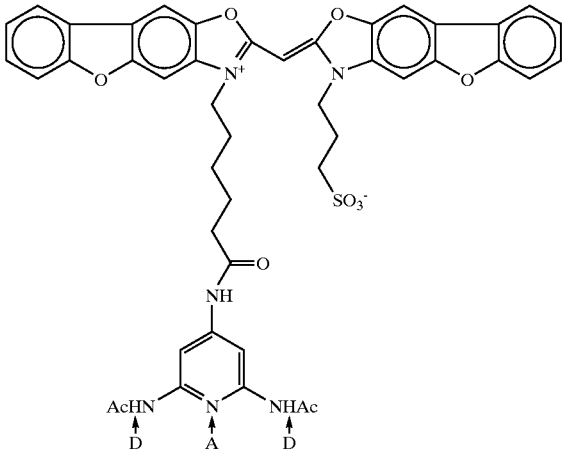

The dyes used in the present invention can be synthesized based on methods described in F. M. Harmer, *Heterocyclic Compounds-Cyanine Dyes and Related Compounds*, John Wiley & Sons, New York, London (1964); D. M. Sturmer, *Heterocyclic Compounds-Special Topics in Heterocyclic Chemistry*, chapter 18, clause 14, pages 482 to 515, John Wiley & Sons, New York, London (1977); *Rodd's Chemistry of Carbon Compounds,* 2nd Ed., vol. IV, part B, chapter 15, pages 369 to 422, Elsvier Science Public Company Inc., New York (1977); and the above-described patents and literatures (cited for the description of specific examples).

In the present invention, the other sensitizing dyes in addition to the dyes described above may be used either alone or a combination of two or more.

Examples of the other sensitizing dye used preferably include cyanine dyes, styryl dyes, merocyanine dyes, trinuclear merocyanine dyes, tetranuclear merocyanine dyes, rhodacyanine dyes, allopolar dyes and hemioxonol dyes.

Preferred are cyanine dyes, merocyanine dyes, rhodacyanine dyes. More preferred are cyanine dyes.

Details of these dyes are described in F. M. Harmer, *Heterocyclic Compounds-Cyanine Dyes and Related Compounds*, John Wiley & Sons, New York, London (1964); and D. M. Sturmer, *Heterocyclic Compounds-Special Topics in Heterocyclic Chemistry*, chapter 18, clause 14, pages 482 to 515.

Preferred examples of the dyes include sensitizing dyes described in U.S. Pat. No. 5,994,051, pages 32 to 44, and shown by formulas and specific examples described in U.S. Pat. No. 5,747,236.

Formulas of the preferred cyanine dyes, merocyanine dyes and rhodacyanine dyes include formulas (XI), (XII) and (XIII) described in U.S. Pat. No. 5,340,694, columns 21 and 22 (with the proviso that the number of n12, n15, n17 and n18 is not restricted, and is an integer of 0 or more (preferably 4 or less)).

These sensitizing dyes may be used either alone or as a combination of two or more. The combinations of the sensitizing dyes are often used, particularly for supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862 and 4,026,707, British Patents 1,344,281 and 1,507,803, JP-B-43-49336 (the term "JP-B" as used herein means an "examined Japanese patent publication"), JP-B-53-12375, JP-A-52-110618 and JP-A-52-109925.

The emulsions may contain dyes having no spectral sensitizing action themselves or substances which do not substantially absorb visible light and exhibit supersensitization, together with the sensitizing dyes.

Supersensitizing agents useful in supersensitization in the present invention (for example, pyrimidylamino compounds, triazinylamino compounds, azolium compounds, aminostyryl compounds, aromatic organic acid-formaldehyde condensation products, azaindene compounds and cadmium salts) and the combinations of the supersensitizing agents and the sensitizing dyes are described, for example, in U.S. Pat. Nos. 3,511,664, 3,615,613, 3,615,632, 3,615,641, 4,596,767, 4,945,038, 4,965,182, 4,965,182, 2,933,390, 3,635,721, 3,743,510, 3,617,295 and 3,635,721. As how to use them, methods described in the above patents are preferred.

The sensitizing dyes (the same applies to other sensitizing dyes and supersensitizing agents) used in the present invention may be added to the silver halide emulsions of the present invention at any stages of the preparation of the emulsions which have hitherto been accepted to be useful. For example, they may be added at a silver halide grain formation stage and/or before desalting, during desalting stage and/or from after desalting to before the start of chemical ripening, as described in U.S. Pat. Nos. 2,735,766, 3,628,960, 4,183,756 and 4,225,666, JP-A-58-184142 and JP-A-60-196749, or at any time and stage before the coating of emulsions, such as immediately before or during chemical ripening, or from after chemical ripening to the coating of the emulsions, as described in JP-A-58-113920. Furthermore, as disclosed in U.S. Pat. No. 4,225,666 and JP-A-58-7629, the same compound may be singly added, or in combination with a compound having a different structure, divided, for example, into during a grain formation stage and during or after chemical ripening, or before or during chemical ripening and after chemical ripening. The kinds of compounds added in parts and combinations thereof maybe changed.

The sensitizing dyes (the same applies to other sensitizing dyes and supersensitizing agents) used in the present invention can be added in an amount of $1\times10^{-6}$ to $10\times10^{-3}$ mol per mol of silver halide, although the amount added varies according to the shape and size of silver halide grains. For example, when the size of the silver halide grains ranges from 0.2 to 1.3 $\mu$m, the amount added is preferably from $2\times10^{-6}$ to $3.5\times10^{-3}$ mol, and more preferably $7.5\times10^{-6}$ to $1.5\times10^{-3}$ mol, per mol of silver.

However, when the sensitizing dyes used in the present invention are adsorbed in multiple layers as described above, they are added in an amount necessary for multiple-layer adsorption.

The sensitizing dyes (the same applies to other sensitizing dyes and supersensitizing agents) used in the present invention maybe directly dispersed in the silver halide emulsions, or may be dissolved in appropriate solvents such as methyl alcohol, ethyl alcohol, methyl cellosolve, acetone, water, pyridine or mixed solvents thereof to add them to the emulsions as solutions. In this case, additives such as bases, acids and surfactants can also be allowed to coexist with the sensitizing dyes. Further, ultrasonic waves can also be applied to the solutions. Methods for adding the compounds include a method of dissolving the compounds in volatile organic solvents, dispersing the resulting solutions into hydrophilic colloids, and adding the resulting dispersions to the emulsions, as described in U.S. Pat. No. 3,469,987; a method of dissolving the compound in a water soluble solvent, and adding the resulting dispersion to the emulsion, as described in JP-A-46-24185; a method of dissolving the compound in a surfactant, and adding the resulting solution to the emulsion, as described in U.S. Pat. No. 3,822,135; a method of dissolving the compounds by the use of red shifting compounds, and adding the resulting solutions to the emulsions, as described in JP-A-51-74624; and a method of dissolving the compounds in acids substantially free from water, and adding the resulting solutions to the emulsions, as described in JP-A-50-80826. In addition, methods described in U.S. Pat. Nos. 2,912,343, 3,342,605, 2,996,287 and 3,429,835 can also be used for adding the compounds to the emulsions.

In the present invention, silver halide adsorptive compounds (photographic useful compounds adsorbed on silver halide grains) include antifoggants, stabilizers and nucleating agents. As the antifoggants and the stabilizers, compounds described in *Research Disclosure,* 176, Item 17643 (RD 17643), ibid., 187, Item 18716 (RD 18716) and ibid., 308, Item 308119 (RD 308119) can be used. Examples of the nucleating agents used herein include hydrazines described in U.S. Pat. Nos. 2,563,785 and 2,588,982, hydrazides and hydrazones described in U.S. Pat. No. 3,227,552, heterocyclic quaternary salt compounds described in British Patent 1,283,835, JP-A-52-69613, JP-A-55-138742, JP-A-60-11837, JP-A-62-210451, JP-A-62-291637, U.S. Pat. Nos. 3,615,515, 3,719,494, 3,734,738, 4,049,683, 4,115,122, 4,306,016 and 4,471,044, sensitizing dyes containing in their dye molecules substituent groups having the nucleating action described in U.S. Pat. No. 3,718,470, thiourea bonding type acyl hydrazine compounds described in U.S. Pat. Nos. 4,030,925, 4,031,127, 4,245,037, 4,255,511, 4,266,013 and 4,276,364 and British Patent 2,012,443, and acyl hydrazine compounds to which thioamido rings or heterocyclic groups such as triazole and tetrazole are bound as an adsorption group, described in U.S. Pat. Nos. 4,080,270 and 4,278,748 and British Patent 2,011,391.

The photographic useful compounds preferred in the present invention are nitrogen-containing heterocyclic compounds such as thiazole and benzotriazole, mercapto compounds, thioether compounds, sulfinic acid compounds, thiosulfonic acid compounds, thioamide compounds, urea compounds, selenourea compounds and thiourea compounds. More preferred are nitrogen-containing heterocyclic compounds, mercapto compounds, thioether compounds and thiourea compounds, and particularly preferred are nitrogen-containing heterocyclic compounds. The nitrogen-containing heterocyclic compounds are preferably nitrogen-containing heterocyclic compounds represented by formulas (C-I) to (C-IV):

(C-I)

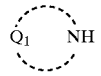

(C-II)

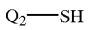

(C-III)

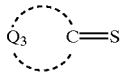

(C-IV)

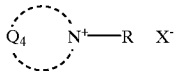

The compound of formula (C-I) is a nitrogen-containing heterocyclic compound containing an imino group (interchangeably isomerizable) in a heterocyclic ring, and the compound of formula (C-II) is a nitrogen-containing heterocyclic compound containing a mercapto group (interchangeably isomerizable). The compound of formula (C-III) a nitrogen-containing heterocyclic compound containing a thione group (not interchangeably isomerizable) in a heterocyclic ring, and the compound of formula (C-IV) is a nitrogen-containing heterocyclic compound containing a quaternary ammonium group. They may be in the form of appropriate salts thereof.

In the formulas, $Q_1$, $Q_2$, $Q_3$ and $Q_4$ each represents a nitrogen-containing heterocyclic ring, and examples thereof include an imidazole ring, a benzimidazole ring, a naphthoimidazole ring, a thiazole ring, a benzothiazole ring, a naphthothiazole ring, an oxazole ring, a benzoxazole ring, a naphthoxazole ring, a benzoselenazole ring, a triazole ring, a benzotriazolering, a tetrazole ring, an azaindene ring (e.g., diazaindene, triazaindene, tetraazaindene, pentaazaindene), a purine ring, a thiadiazole ring, an oxadiazole ring, a selenadiazole ring, an indazole ring, atriazine ring, a pyrazole ring, a pyrimidine ring, a pyridazine ring, a quinoline ring, a rhodanine ring, a thiohydantoin ring, an oxazolidinedione ring and a phthalazine ring.

Of these, preferred are an azaindene ring, a (benzo) triazole ring, an indazole ring, a triazine ring, a purine ring and a tetrazole ring for formula (C-I), a tetrazole ring, a triazole ring, a (benz)imidazole ring, a (benzo)thiazole ring, a (benz)oxazole ring, a thiadiazole ring, an azaindene ring and a pyrimidine ring for formula (C-II), a (benzo)thiazole ring, a (benz)imidazole ring, a (benz) oxazole ring, a triazole ring and a tetrazole ring for formula (C-III), and a (benzo, naphtho)thiazole ring, a (benz, naphtho)imidazole ring and a (benz, naphth)oxazole ring for formula (C-IV). The term "(benzo, naphtho)thiazole ring" indicated above means "a thiazole ring, a benzothiazole ring or a naphthothiazole ring". The same applies to the other cases.

These heterocyclic rings may have appropriate substituent groups such as a hydroxyl group, an alkyl group (e.g., methyl, ethyl, pentyl), an alkenyl group (e.g., allyl), an alkylene group (e.g., ethynyl), an aryl group (e.g., phenyl, naphthyl), an aralkyl group (e.g., benzyl), an amino group, a hydroxyamino group, an alkylamino group (e.g., ethylamino), a dialkylamino group (e.g., dimethylamino), an arylamino group (e.g., phenylamino), an acylamino group (e.g., acetylamino), an acyl group (e.g., acetyl), an alkylthio group (e.g., methylthio), a carboxyl group, a sulfo group, an alkoxyl group (e.g., ethoxy), an aryloxy group (e.g., phenoxy), an alkoxycarbonyl group (e.g., methoxycarbonyl), a carbamoyl group which may be substituted, a sulfamoyl group which may be substituted, a ureido group which may be substituted, a cyano group, a halogen atom (e.g., chlorine, bromine), a nitro group, a mercapto group and a heterocyclic ring (e.g., pyridyl).

In the formula, R represents an alkyl group (e.g., methyl, ethyl, hexyl), an alkenyl group (e.g., allyl, 2-butenyl), an alkylene group (e.g., ethynyl), an aryl group (e.g., phenyl) or an aralkyl group (e.g., benzyl), and these groups may further have suitable substituent groups.

X-represents an anion (for example, an inorganic anion such as a halogen ion or an organic anion such as a paratoluene-sulfonate ion).

Of the above-described compounds, preferred are the compounds of formulas (C-I), (C-II) and (C-IV).

Of the compounds of formula (C-I), particularly preferred are tetraazaindenes substituted by hydroxyl groups (which are interchangeably isomerizable and can have imino groups), and of the compounds of formula (C-II), particularly preferred are mercaptotetrazoles having acidic groups (e.g., carboxyl, sulfo). Of the compounds of formula (C-IV), particularly preferred are benzothiazoles.

Of the above-described compounds, the compounds of formulas (C-I) and (C-II) combine with silver ions to form silver salts, and nitrogen-containing heterocyclic compounds are preferred in which the solubility product of the silver salts to water is from $10^{-9}$ to $10^{-20}$, and particularly from $5\times10^{-10}$ to $10^{-18}$ at near room temperature.

The photographic useful compounds may be added at any time, before addition of the sensitizing dyes, after the termination of addition thereof, or during the period of from the initiation of addition thereof to the termination of addition thereof. However, they are added preferably before addition of the sensitizing agents or during the period of from the initiation of addition thereof to the termination of addition thereof, and more preferably during the period of from the initiation of addition thereof to the termination of addition thereof.

Although the amount of the photographic useful compound added varies depending the function thereof and the kind of emulsion, it is typically from $5\times10^{-5}$ to $5\times10^{-3}$ mol per mol of silver.

Specific examples of the photographic useful compounds which can be allowed to be adsorbed by the silver halide grains are shown below, but are not to be construed, of course, as limiting the present invention.

C-1

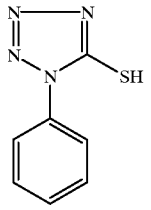

C-2

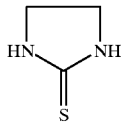

C-3

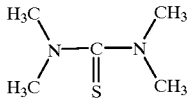

C-4

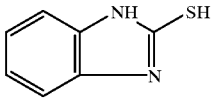

C-5

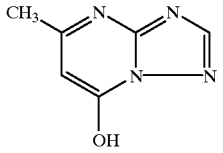

C-6

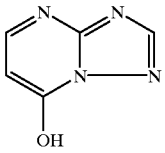

C-7

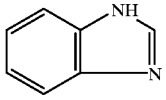

C-8

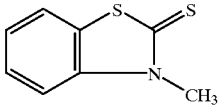

C-9

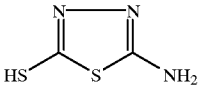

C-10

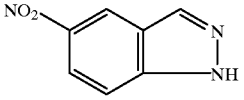

C-11

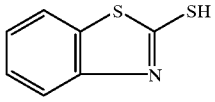

C-12

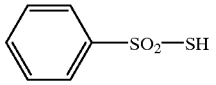

-continued

C-13

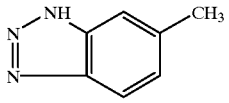

C-14

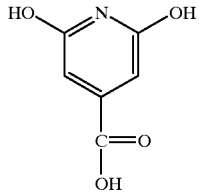

C-15

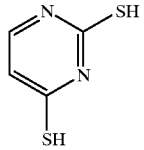

C-16

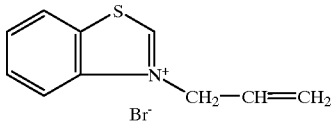

C-17

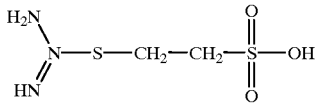

C-18

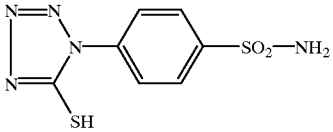

C-19

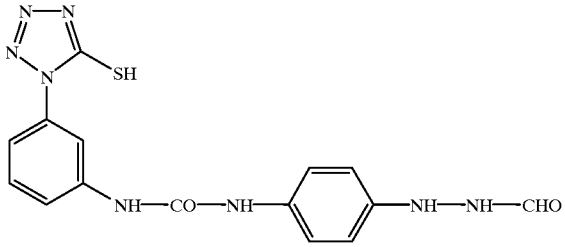

C-20

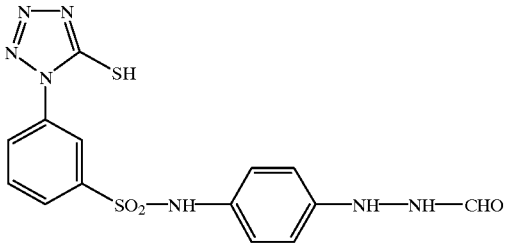

C-21

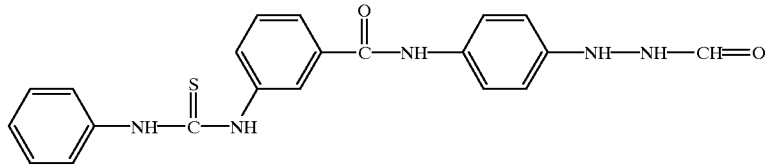

C-22

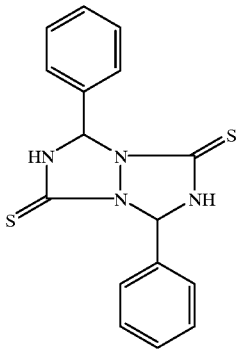

C-23

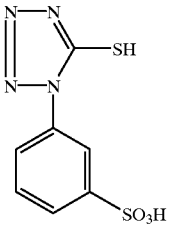

C-24

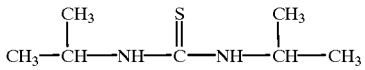

C-25

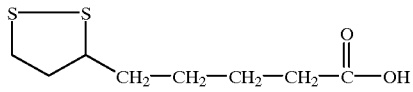

In the photographic emulsion presiding over the light sensitive mechanism in the present invention, any of silver bromide, silver iodobromide, silver chlorobromide, silver iodide, silver iodochloride, silver iodobromochloride and silver chloride may be used as the silver halide. The halogen composition contained in the outermost surfaces of the emulsion grains is preferably 0.1 mol % or more of iodine, more preferably 1 mol % or more of iodine and particularly preferably 5 mol % or more of iodine, thereby allowing the construction of a stronger multiple-layer adsorption structure.

Although the grain size distribution may be either wide or narrow, the narrower is better.

The silver halide grains contained in the photographic emulsions may have a regular crystal form such as a cubic, an octahedral, a tetradecahedral or a rhombic dodecahedral form, an irregular crystal form such as a spherical or a tabular form, a hkl face or a mixture of the grains having these crystal forms. However, preferred are tabular grains, which are described in detail below. As to the grains having a hkl face, reference can be made to *Journal of Imaging Science,* 30, 247–254 (2986).

The silver halide photographic emulsion used in the present invention may contain the above-described silver halide grains either alone or as a mixture of a plurality of them.

The silver halide grain may be one having phases different from each other in the inside and a surface layer thereof, one having a polyphase structure such as a junction structure, one having a localized phase on a grain surface, or one in which the whole grain is formed of a uniform phase. Further, these grains may be present as a mixture. These various kinds of emulsions may be either of the surface latent image type in which latent images are mainly formed on surfaces of the grains or of the internal latent image type in which images are formed inside the grains.

In the present invention, tabular silver halide grains whose halogen composition is silver chloride, silver bromide, silver chlorobromide, silver iodobromide, silver chloroiodobromide or silver iodochloride are preferably used.

The tabular grain having a (100) or (111) main surface is preferred. The tabular grain having the (111) main surface (hereinafter referred to as a (111) tabular grain) usually has a triangle or hexagonal face. In general, a more uniform distribution causes a higher ratio of tabular grains having hexagonal faces. The hexagonal monodisperse tabular grains are described in JP-B-5-61205.

The tabular grain having the (100) face as a main surface (hereinafter referred to as a (100) tabular grain) has a rectangular or square form. In this emulsion, a grain from an acicular grain to a grain having an adjacent side ratio of less than 5:1 is called the tabular grain. In the tabular grain containing a silver chloride or a silver halide having a large amount of silver chloride, the (100) tabular grain is originally high in main surface stability, compared with the (111) tabular grain. In the case of the (111) tabular grain, it is necessary to stabilize the (111) main surface, which is described in JP-A-9-80660, JP-A-9-80656 and U.S. Pat. No. 5,298,388.

Silver chloride or the (111) tabular grains high in silver chloride content used in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

The high silver bromide (111) tabular grains used in the present invention are described in U.S. Pat. Nos. 4,425,425, 4,425,426, 443,426, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

The (100) tabular grains used in the present invention are described in U.S. Pat. Nos. 4,386,156, 5,275,930, 5,292,632, 5,314,798, 5,320,938, 5,319,635 and 5,356,764, European Patents 569,971 and 737,887, JP-A-6-308648 and JP-A-9-5911.

The silver halide emulsions used in the present invention are preferably emulsions comprising tabular silver halide grains having a higher surface area/volume ratio by which the sensitizing dyes disclosed in the present invention are adsorbed. In the emulsions, the silver halide grains having an aspect ratio of 2 or more (preferably, 100 or less), preferably 5 to 80, more preferably 8 to 80 are present in an amount of 50% (area) or more of the total silver halide grains. The thickness of the tabular grains is preferably less than 0.2 $\mu$m, more preferably less than 0.1 $\mu$m, and still more preferably less than 0.07 $\mu$m. For preparing such high aspect ratio and thin tabular grains, the following processes are applied.

In the tabular grains used in the present invention, it is desirable that the intergranular dislocation line distribution is uniform. In the emulsions of the present invention, silver halide grains having 10 or more dislocation lines per one grain occupy preferably 50% (by the number of grains) to 100%, more preferably 70% to 100%, and particularly preferably 90% to 100%.

Less than 50% causes unfavorable intergranular uniformity.

When the ratio of grains containing dislocation lines and the number of dislocation lines are determined in the present invention, they are determined by directly observing the dislocation lines preferably for at least 100 grains, more preferably for 200 grains or more, particularly preferably for 300 grains or more.

As protective colloids used in preparing the emulsions of the present invention, and as binders for other hydrophilic colloidal layers, gelatin is advantageously used, but other hydrophilic colloids can also be used.

Examples of the hydrophilic colloids which can be used include proteins such as gelatin derivatives, graft polymers of gelatin with other polymers, albumin and casein; cellulose derivatives such as hydroxyethyl cellulose, carboxymethyl cellulose and cellulose sulfates; saccharide derivatives such as sodium alginate and starch derivatives; and various kinds of synthetic hydrophilic polymers such as homopolymers and copolymers of polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

As gelatin, acid-treated gelatin and enzyme-treated gelatin as described in *Bull. Soc. Sci. Photo. Japan,* 16, 30 (1966), as well as lime-treated gelatin, may be used, and a hydrolyzed or enzyme-decomposed product of gelatin can also be used.

It is preferred that the emulsions used in the present invention are washed with water for desalination and dispersed with freshly prepared protective colloids. The temperature of washing can be selected according to the purpose, but preferably selected within the range of 5° C. to 50° C. The pH in washing can also be selected depending on the purpose, but preferably selected within the range of 2 to 10, more preferably 3 to 8. The pAg in washing can also be selected according to the purpose, but preferably selected within the range of 5 to 10. A method for washing can be selected for use from noodle water washing, dialysis using semipermeable membranes, centrifugation, coagulation precipitation and ion exchange. The coagulation precipitation can be selected from processes using sulfates, processes using organic solvents, processes using water-soluble polymers and processes using gelatin derivatives.

In the preparation of the emulsions in the present invention, for example, in grain formation, in desalting, in chemical sensitization or before coating, the presence of salts of metal ions are preferred depending on the purpose. When the grains are doped with the metal salts, the metal salts are preferably added in the grain formation. When the metal salts are used for modification of surfaces of the grains or as chemical sensitizers, the metal salts are preferably added after the grain formation and before termination of the chemical sensitization. A method of doping the entire grain and a method of doping only a core portion or a shell portion of the grain can also be selectively used. Examples of the metals which can be used include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added as long as they are in salt forms in which they can be dissolved in forming the grains, such as ammonium salts, acetates, nitrates, sulfates, phosphates, hydroxides, six-coordinated complexes and four-coordinated complexes. Examples of such salts include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. A ligand of the coordination compound can be selected from halo, aquo, cyano, cyanate, thiocyanate, nitrosyl, thionitrosyl, oxo and carbonyl. These metal compounds may be used either alone or a combination of two or more of them.

The metal compounds are preferably added as solutions thereof in water or appropriate organic solvents such as methanol and acetone. For stabilizing the solution, aqueous solutions of hydrogen halides (e.g., HCl, HBr) or alkali halides (e.g., KCl, NaCl, KBr, NaBr) can be added. Further, acids and alkalis may be added as necessary. The metal compounds can be added to a reaction vessel either before the grain formation or in the course of the grain formation. They can also be added to aqueous solutions of water-soluble silver salts (e.g., $AgNO_3$) or alkali halides (e.g., NaCl, KBr, KI), and the resulting solutions can be continuously added during the formation of silver halide grains. Further, solutions of the metal compounds prepared independently of the solutions of water-soluble silver salts or alkali halides may be continuously added at suitable time during the grain formation. Combinations of various addition methods are also preferred.

It is also sometimes useful to add chalcogen compounds as described in U.S. Pat. No. 3,772,031 during the preparation of the emulsions. In addition to S, Se and Te, cyanates, thiocyanates, selenocyanates, carbonates, phosphates and acetates may be allowed to exist.

The silver halide grains used in the present invention can be subjected to at least one of sulfur sensitization, selenium sensitization, gold sensitization, palladium sensitization, noble metal sensitization and reduction sensitization at any manufacturing stages of the silver halide emulsions. It is preferred to combine two or more kinds of sensitization processes. Various types of emulsions can be prepared depending on the stage at which the grains are subjected to chemical sensitization. There are a type of embedding a chemical sensitizing nucleus in the inside of the grain, a type of embedding the nucleus in a shallow position from a surface of the grain and a type of preparing the chemical sensitizing nucleus on the surface of the grain.

One of the chemical sensitization processes which can be preferably carried out in the present invention is chalcogen sensitization, noble metal sensitization or a combination thereof. It can be conducted using active gelatin as described in T. H. James, *The Photographic Process,* 4th ed., pages 67 to 76, Macmillan (1977). Further, sulfur, selenium, tellurium, gold, platinum, palladium, iridium or a combination of a plurality of these sensitizers can be used at a pAg of 5 to 10 at a pH of 5 to 8 at a temperature of 30° C. to 80° C. as described in *Research Disclosure,* 120 (April, 1974) 12008, ibid., 34 (June, 1975) 13452, U.S. Pat. Nos. 2,642,361, 3,297,446, 3,772,031, 3,857,711, 3,901,714, 4,266,018 and 3,904,415, and British Patent, 1,315,755. In noble metal sensitization, salts of noble metals such as gold, platinum, palladium and iridium can be used. In particular, gold sensitization, palladium sensitization and both of them are preferably used among others. In the case of gold sensitization, known compounds such as chloroauric acid, potassium chloroaurate, potassium aurithiocyanate, gold sulfide and gold selenide can be used. The palladium compounds mean divalent or tetravalent palladium salts. Preferred examples of the palladium compounds are represented by $R_2PdX_6$ or $R_2PdX_4$, wherein R represents a hydrogen atom, an alkali metal atom or an ammonium group, and X represents a halogen atom such as chlorine, bromine or iodine.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. The gold compounds and the palladium compounds are preferably used in combination with thiocyanates or selenocyanates.

As the sulfur sensitizers, there can be used hypo, thiourea compounds, rhodanine compounds and sulfur-containing compounds described in U.S. Pat. Nos. 3,857,711, 4,266,018 and 4,054,457. The chemical sensitization can also be carried out in the presence of so-called chemical sensitizing aids. As the useful chemical sensitizing aids, compounds are used which are known to inhibit fogging and to enhance sensitivity in the course of chemical sensitization, such as azaindene, azapyridazine and azapyrimidine. Examples of the chemical sensitizing aids are described in U.S. Pat. Nos. 2,131,038, 3,411,914 and 3,554,757, JP-A-58-126526 and G. F. Duffin, *Photographic Emulsion Chemistry*, pages 138 to 143.

For the emulsions of the present invention, gold sensitization is preferably used in combination. The amount of the gold sensitizers is preferably from $1\times10^{-7}$ mol to $1\times10^{-4}$ mol, and more preferably from $5\times10^{-7}$ mol to $1\times10^{-5}$ mol, per mol of silver halide. The amount of the palladium compounds is preferably within the range of $5\times10^{-7}$ mol to $1\times10^{-3}$ mol per mol of silver halide. The amount of the thiocyanates or the selenocyanates is preferably within the range of $1\times10^{-6}$ mol to $5\times10^{-2}$ mol per mol of silver halide.

The amount of the sulfur sensitizers used in the silver halide grains of the present invention is preferably from $1\times10^{-7}$ mol to $1\times10^{-4}$ mol, and more preferably from $5\times10^{-7}$ mol to $1\times10^{-5}$ mol, per mol of silver halide.

For sensitizing the emulsions of the present invention, selenium sensitization is preferably used. In the selenium sensitization, known labile selenium compounds are used. Specific examples thereof include selenium compounds such as colloidal metallic selenium, selenourea derivatives (e.g., N,N-dimethylselenourea, N,N-diethylselenourea), selenoketones and selenoamides. In some cases, selenium sensitization is preferably used in combination with sulfur sensitization, noble metal sensitization or both of them.

It is preferred that the silver halide emulsions used in the present invention are subjected to reduction sensitization during the grain formation, after the grain formation and before or during the chemical sensitization, or after the chemical sensitization.

For reduction sensitization as used herein, any of a method of adding reduction sensitizers to the silver halide emulsions, a method of conducting growth or ripening in an atmosphere of a low pAg of 1 to 7 which is called silver ripening, and a method of conducting growth or ripening in an atmosphere of a high pH of 8 to 11 which is called high pH ripening can be selected. Further, two or more of them can also be used in combination.

The method of adding the reduction sensitizers is preferred, because the level of reduction sensitization can be precisely controlled.

As the reduction sensitizers, there are known reduction sensitizers such as stannous salts, ascorbic acid and derivatives thereof, amines and polyamines, hydrazine derivatives, formaminedisulfinic acids, silane compounds and borane compounds. In the reduction sensitization used in the present invention, these known reduction sensitizers can be selectively used, and two or more of the compounds can also be used in combination. Stannous chloride, thiourea dioxide, dimethylamine borane, ascorbic acid and derivatives thereof are preferred as the reduction sensitizers. The amount of the reduction sensitizers added is required to be selected because it depends on the emulsion manufacturing conditions. However, it is suitably within the range of $10^{-7}$ mol to $10^{-3}$ mol per mol of silver halide.

The reduction sensitizers are dissolved, for example, in water or organic solvents such as alcohols, glycols, ketones, esters and amides, and added during the growth of the grains. Although they may be previously added to a reaction vessel, they are preferably added at appropriate time during the growth of the grains. The reduction sensitizers may be previously added to aqueous solutions of water-soluble silver salts or water-soluble alkali halides, and silver halide grains may be allowed to precipitate using the resulting solutions. It is also preferred that the solution of the reduction sensitizer is added in several parts with the growth of the grains, or continuously for a long period of time.

Oxidizing agents to silver are preferably used in the production of the emulsions of the present invention. The oxidizing agents to silver mean compounds having the function of reacting with metallic silver to convert it to a silver ion. In particular, compounds are effective which convert to silver ions extremely fine silver grains produced as a by-product in the course of formation of the silver halide grains and chemical sensitization thereof. The silver ions produced herein may form either silver salts sparingly soluble in water such as silver halides, silver sulfide and silver selenide, or silver salts easily soluble in water such as silver nitrate. The oxidizing agents to silver may be inorganic compounds or organic compounds. Examples of the inorganic oxidizing agents include ozone; hydrogen peroxide and adducts thereof (e.g., $NaBO_2.H_2O_2.3H_2O$, $2NaCO_3.H_2O_2$, $Na_4P_2O_7.2H_2O_2$. $2Na_2SO_4.H_2O_2.2H_2O$); oxygen acid salts such as peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2O_4)_2].6H_2O$), permanganates (e.g., $KMnO_4$) and chromates (e.g., $K_2Cr_2O_7$); halogen elements such as iodine and bromine; perhalogenates (e.g., potassium periodate); salts of high-valent metals (e.g., potassium hexacyanoferrate (II)); and thiosulfonates.

Further, examples of the organic oxidizing agents include quinones such as p-quinone; organic peroxides such as peracetic acid and perbenzoic acid; and compounds releasing active halogen (e.g., N-bromsuccinimide, chloramine T, chloramine B).

The oxidizing agents used in the present invention are preferably ozone, hydrogen peroxide and adducts thereof, halogen elements, inorganic oxidizing agents of thiosulfonates and organic oxidizing agents of quinones. The oxidizing agents to silver are preferably used in combination with the above-described reduction sensitization. A method of conducting the reduction sensitization after the use of the oxidizing agents, a method of using the oxidizing agents after the reduction sensitization, or a method of allowing both to coexist at the same time can be selectively used. These methods can be selectively used either in the grain formation stage, or in the chemical sensitization stage.

Various compounds other than the above-described silver halide adsorptive compounds can be added to the photographic emulsions used in the present invention for preventing fog in the production stage of the photographic materials, or during storage or photographic processing thereof, or for stabilizing photographic characteristics. The antifoggants and stabilizers can be added at various times, for example, before, during or after the grain formation, during washing, in dispersing after washing, before, during or after the chemical sensitization, or before coating, according to their purpose. They can be used for many purposes of controlling crystal habit of the grains, decreasing the grain size, reducing the solubility of the grains, controlling chemical sensitization and controlling the arrangement of dyes, besides exhibiting the original antifogging and stabilizing effects by addition of them during the preparation of the emulsions.

The photographic material produced using the silver halide emulsion obtained according to the present invention only requires that a support is provided with at least one layer of silver halide emulsion layers such as blue-sensitive, green-sensitive and red-sensitive layers. There is no particular limitation on the number and the order of arrangement of the silver halide emulsion layers and light-insensitive layers. A typical example thereof has at least one color sensitive layer on a support, the color sensitive layer comprising a plurality of silver halide emulsion layers which are substantially identical in color sensitivity and different in sensitivity. The light-sensitive layer is a unit light-sensitive layer having color sensitivity to any one of blue, green and red lights. In general, in the unit light-sensitive layer of the multilayer silver halide color photographic material, the red-sensitive layer, the green-sensitive layer and the blue-sensitive layer are arranged from the support side in this order. However, the above-described order of arrangement may be reversed, or such an arrangement that a different light-sensitive layer is sandwiched between layers having the same color sensitivity may also be adopted, depending on its purpose.

A light-insensitive layer such as an intermediate layer may be provided between the above-described silver halide light-sensitive layers, or as the uppermost layer or the lowermost layer.

The intermediate layers may contain couplers or DIR compounds described in JP-A-61-43748, JP-A-59-113438, JP-A-59-113440, JP-A-61-20037 and JP-A-61-20038, and may contain color stain preventing agents, as usually employed.

As the plurality of silver halide emulsion layers constituting each unit light-sensitive layer, a two-layer structure of a high-speed emulsion layer and a low-speed emulsion layer can be preferably used as described in West German Patent 1,121,470 and British Patent 923,045. It is usually preferred that the emulsion layers are arranged so as to decrease in sensitivity toward a support in turn. A light-insensitive layer may also be provided between the respective silver halide emulsion layers. Further, low-speed emulsion layers may be arranged apart from a support and high-speed emulsin layers may be arranged near to the support, as described in JP-A-57-112751, JP-A-62-200350, JP-A-62-206541 and JP-A-62-206543.

Specific examples thereof include an arrangement in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL) from the side farthest from a support; an arrangement in the order of BH/BL/GL/GH/RH/RL; and an arrangement in the order of BH/BL/GH/GL/RL/RH.

As described in JP-B-55-34932, layers can also be arranged in the order of blue-sensitive layer/GH/RH/GL/RL from the side farthest from a support. Further, layers can also be arranged in the order of blue-sensitive layer/GL/RL/GH/RH from the side farthest from a support, as described in JP-A-56-25738 and JP-A-62-63936.

Furthermore, three layers different in sensitivity may be arranged so that the upper layer is a silver halide emulsion layer having the highest sensitivity, the middle layer is a silver halide emulsion layer having a sensitivity lower than that of the upper layer, the lower layer is a silver halide emulsion layer having a sensitivity further lower than that of the middle layer, and the sensitivity of the three layers is successively decreased toward a support, as described in JP-B-49-15495. Even when such three layers different in sensitivity are arranged, they may be arranged in the order of middle-speed emulsion layer/high-speed emulsion layer/ low-speed emulsion layer from the side remote from the support in the same layer having the same spectral sensitivity, as described in JP-A-59-202464.

In addition, they may be arranged in the order of high-speed emulsion layer/low-speed emulsion layer/middle-speed emulsion layer, or low-speed emulsion layer/middle-speed emulsion layer/high-speed emulsion layer.

In the case of four layers or more, the arrangement may also be changed as described above.

As described above, various layer structures and arrangements can be selected depending on the purpose of each photographic material.

The above-described various additives are used in the photographic materials of the present invention, various additives other than these can be used according to their purpose.

These additives are described in *Research Disclosure*, Item 17643 (December, 1978), ibid., Item 18716 (November, 1979) and ibid., Item 308119 (December, 1989) in greater detail, and corresponding portions thereof are shown in the following table.

| Type of Additives | RD 17643 | RD 18716 | RD 308119 |
|---|---|---|---|
| 1. Chemical Sensitizers | p. 23 | p. 648, right column | p. 996 |
| 2. Sensitivity Increasing Agents | | p. 648, right column | |
| 3. Spectral Sensitizers, Supersensitizers | pp. 23–24 | p. 648, right column to p. 649, right column | p. 996, right column to p. 998, right column |
| 4. Brightening Agents | p. 24 | p. 647 right column | p. 998, right column |
| 5. Antifoggants, Stabilizers | pp. 24–25 | p. 649, right column | p. 998, right column to p. 1000, right column |
| 6. Light Absorbers, Filter dyes, UV Absorbers | pp. 25–26 | p. 649, right column to p. 650, left column | p. 1003, left column to p. 1003, right column |
| 7. Stain Inhibitors | p. 25, right column | p. 650, left to right columns | p. 1002, right column |
| 8. Dye Image Stabilizers | p. 25 | | p. 1002, right column |
| 9. Hardeners | p. 26 | p. 651, left column | p. 1004, right column to p.1005, left column |
| 10. Binders | p. 26 | p. 651, left column | p. 1003, right column to p.1004, right column |
| 11. Plasticizers, Lubricants | p. 27 | p. 650, right column | p. 1006, left to right columns |
| 12. Coating Aids, Surfactants | pp. 26–27 | p. 650 right column | p. 1005, left column to p. 1006, left column |
| 13. Antistatic Agents | p. 27 | p. 650 right column | p. 1006, right column to p. 1007, left column |
| 14. Matte Agents | | | p. 1008, left column to p. 1009, left column |

For preventing deterioration of photographic properties caused by formaldehyde gas, compounds which can react with formaldehyde to immobilize it, which are described in U.S. Pat. Nos. 4,411,987 and 4,435,503, are preferably added to the photographic materials.

Various color couplers can be used in the present invention. Examples thereof are described in the patents cited in *Research Disclosure*, No. 17643, VII-C to G and ibid. No. 307105, VII-C to G described above.

Preferred examples of yellow couplers are described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and EP-A-249473.

As magenta couplers, 5-pyrazolone compounds and pyrazoloazole compounds are preferably used. Particularly preferred are couplers described in U.S. Pat. Nos. 4,310,619 and 4,351,897, European Patent 73,636, U.S. Pat. Nos. 3,061,432 and 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and PCT International Publication No. WO88/04795.

Cyan couplers include phenol couplers and naphthol couplers. Preferred examples thereof are described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-121365 and EP-A-249453, U.S. Pat. Nos. 3,446,622, 4,333,999, 4,775,616, 4,451,559, 4,427,767, 4,690,889, 4,254,212 and 4,296,199 and JP-A-61-42658.

Typical examples of dye-forming polymer couplers are described in U.S. Pat. Nos. 3,451,820, 4,080,211, 4,367,282, 4,409,320 and 4,576,910, British Patent 2,102,137 and EP-A-341188.

Preferred examples of couplers whose forming dyes have appropriate diffusibility include those described in U.S. Pat. No. 4,366,237, British Patent 2,125,570, European Patent 96,570 and West German Patent Application (OLS) No. 3,234,533.

Preferred colored couplers for correcting unnecessary absorption of forming dyes are described in *Research Disclosure*, No. 17643, Item VII-G, ibid. 307105, Item VII-G, U.S. Pat. No. 4,163,670, JP-B-57-39413, U.S. Pat. Nos. 4,004,929 and 4,138,258 and British Patent 1,146,368. It is also preferred to use couplers for correcting unnecessary absorption of forming dyes with fluorescent dyes released on coupling, and to use couplers having dye precursor groups as releasing groups which can react with developing agents to form dyes. The former couplers are described in U.S. Pat. No. 4,774,181 and the latter couplers are described in U.S. Pat. No. 4,777,120.

Couplers which release photographically useful residues on coupling can also be preferably used in the present invention. Preferred DIR couplers which release development restrainers are described in the patents cited in *Research Disclosure*, No. 17643, Item VII-F and ibid., No. 307105, Item VII-F described above, JP-A-57-151944, JP-A-57-154234, JP-A-60-184248, JP-A-63-37346, JP-A-63-37350 and U.S. Pat. Nos. 4,248,962 and 4,782,012.

Preferred couplers which imagewise release nucleating agents or development accelerators on development are described in British Patents 2,097,140 and 2,131,188, JP-A-59-157638 and JP-A-59-170840. Further, preferred couplers which release fogging agents, development accelerators, solvents for silver halides and the like by oxidation-reduction reaction with oxidation products of developing agents are described in JP-A-60-107029, JP-A-60-252340, JP-A-1-44940 and JP-A-1-45687.

Other compounds which can be used in the present invention include competitive couplers described in U.S. Pat. No. 4,130,427, multiequivalent couplers described in U.S. Pat. Nos. 4,283,472, 4,338,393 and 4,310,618, DIR redox compound releasing couplers, DIR coupler releasing couplers, DIR coupler releasing redox compounds and DIR redox releasing redox compounds described in JP-A-60-185950 and JP-A-62-24252, couplers which release dyes recoloring after releasing described in EP-A-173302 and EP-A-313308, bleach accelerator releasing couplers described in *Research Disclosure*, No. 11449, ibid., No. 24241 and JP-A-61-201247, ligand releasing couplers described in U.S. Pat. No. 4,555,477, leuco dye releasing couplers described in JP-A-63-75747 and fluorescent dye releasing couplers described in U.S. Pat. No. 4,774,181.

The couplers used in the present invention can be incorporated in the photographic materials by various conventional dispersing methods.

Examples of high boiling solvents used in oil-in-water dispersion methods are described, for example, in U.S. Pat. No. 2,322,027.

Specific examples of the high boiling solvents having a boiling point of 175° C. or more at normal pressure which are used in oil-in-water dispersion methods include phthalic acid esters (e.g., dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate, bis(1,1-diethylpropyl)phthalate); phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate); benzoic acid esters (e.g., 2-ethylhexyl benzoate, dodecyl benzoate, 2-ethylhexyl p-hydroxybenzoate); amides (e.g., N,N-diethyldodecaneamide, N,N-diethyllaurylamide, N-tetradecylpyrrolidone); alcohols or phenols (e.g., isostearyl alcohol, 2,4-di-tert-amylphenol); aliphatic carboxylic acid esters (e.g. bis(2-ethylhexyl) sebacate, dioctyl azelate, glycerol tributyrate, isostearyl lactate, trioctyl citrate); aniline derivatives (e.g., N,N-dibutyl-2-butoxy-5-tert-octylaniline); and hydrocarbons (e.g., paraffin, dodecylbenzene, diisopropylnaphthalene). Organic solvents having a boiling point of about 30° C. or more and preferably about 50° C. to about 160° C. may be used as auxiliary solvents. Typical examples thereof include ethyl acetate, butyl acetate, ethyl propionate, methyl ethyl ketone, cyclohexanone, 2-ethoxyethyl acetate and dimethylformamide.

The stages and effects of latex dispersion methods and examples of latexes for impregnation are described in U.S. Pat. No. 4,199,363, West German Patent Application (OLS) Nos. 2,541,274 and 2,541,230.

It is preferred that the color photographic materials according to the present invention contain various preservatives or antifungal agents such as phenetyl alcohol, and 1,2-benzisothiazoline-3-one, n-butyl p-hydroxybenzoate, phenol, 4-chloro-3,5-dimethylphenol, 2-phenoxyethanol and 2-(4-thiazolyl)benzimidazole described in JP-A-63-257747, JP-A-62-272248 and JP-A-1-80941.

The present invention can be applied to various color photographic materials. Typical examples thereof include color negative films for general use or cinematographic use, color reversal films for slides or television, color paper, color positive films and color reversal paper. The present invention can also be particularly preferably applied to duplicating films.

Appropriate supports which can be used in the present invention are described, for example, in *Research Disclosure*, No. 17643, page 28, ibid., No. 18716, page 647, right column to page 648, left column, and ibid., No. 307105, page 879.

In the photographic materials of the present invention, the total film thickness of all hydrophilic colloidal layers on the side having an emulsion layer is preferably 28 μm or less, more preferably 23 μm or less, still more preferably 18 μm or less, and yet still more preferably 16 μm or less. The film swelling speed T1/2 is preferably 30 seconds or less, and more preferably 20 seconds or less. The film thickness as used herein means a thickness measured under conditions of 25° C. −55% (RH) (for 2 days), and the film swelling speed T1/2 can be measured by methods known in the art. For example, measurement can be made by using a swellometer described in A. Green et al., *Photogr. Sci. Eng.,* 19 (2), 124–129. Taking 90% of a maximum thickness of a swelled film reached by processing with a color developing solution at 30° C. for 3 minutes and 15 seconds as a saturated film thickness, T1/2 is defined as a time required to reach ½ of the saturated film thickness.

The film swelling speed T1/2 can be adjusted by adding a hardening agent to gelatin used as a binder or changing the storage conditions after coating.

The photographic material of the present invention is preferably provided with a hydrophilic colloidal layer (referred to as a back layer) having a total dry film thickness of 2 to 20 μm on the side opposite to a side having an emulsion layer. It is preferred that the back layers contain the above-described light absorbers, filter dyes, ultraviolet absorbers, antistatic agents, hardening agents, binders, plasticizers, lubricants, coating aids and surfactants. The swelling rate of the back layers is preferably from 150% to 500%.

The color photographic materials according to the present invention can be developed by usual methods described in *Research Disclosure*, No. 17643, pages 28 and 29, ibid., No. 18716, page 651, left column to right column, and ibid., No. 307105, pages 880 and 881 described above.

Color developing solutions used for processing of the photographic materials of the present invention are preferably aqueous alkaline solutions mainly containing aromatic primary amine color developing agents. Although the aminophenol compounds are also useful as the color developing agents, p-phenylenediamine compounds are preferably used. Typical examples thereof include 3-methyl-4-amino-N,N-diethylaniline, 3-methyl-4-amino-N-ethyl-N-β-hydroxyethylaniline, 3-methy-1-4-amino-N-ethyl-N-β-methanesulfonamidoethylaniline, 3-methyl-4-amino-N-ethyl-β-methoxyethylaniline, and sulfates, hydrochlorides or p-toluenesulfonates thereof. Of these, a sulfate of 3-methyl-4-amino-N-ethyl-N-β-hydroxyethylaniline is particularly preferred. These compounds can also be used as a combination of two or more of them depending on their purpose.

The color developing solutions generally contain pH buffers such as carbonates, borates or phosphates of alkali metals, and developing inhibitors or antifoggants such as chlorides, bromides, iodides, benzimidazoles, benzothiazoles or mercapto compounds. Further, the color developing solutions may contain various preservatives such as hydroxylamine, diethylhydroxylamine, sulfites, hydrazines such as N,N-biscarboxymethylhydrazine, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; dye forming couplers; competitive couplers; auxiliary developing agents such as 1-phenyl-3-pyrazolidone; tackifiers; various chelating agents represented by aminopolycarboxylic acids, aminopolyphosphonic acids, alkylphosphonic acids and phosphonocarboxylic acids, as required. Typical examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di (o-hydroxyphenylacetic acid) and salts thereof.

When reversal processing is performed, ordinary black-and-white development is usually conducted, followed by color development. For black-and-white developers used in this case, known black-and-white developing agents such as dihydroxybenzenes (for example, hydroquinone), 3-pyrazolidones (for example, 1-phenyl-3-pyrazolidone), or aminophenols (for example, N-methyl-p-aminophenol) can be used alone or in combination. These color developing solutions and black-and-white developing solutions are generally adjusted to pH 9 to 12. Although the replenishment rate of these developing solutions vary according to color photographic materials to be processed, it is generally 3 liters or less per $m^2$ of photographic material, and it can also be reduced to 500 ml or less by lowering the concentration of bromide ions in the replenishers. When the replenishment is reduced, the contact area of the processing solution with air is preferably lowered to prevent liquid evaporation and air oxidation.

The contact area of a photographic processing solution with air in a processing tank can be represented by the opening ratio defined below:

$$\text{Opening ratio}=[\text{Contact area of processing solution with air } (cm^2)] \div [\text{Volume of processing solution } (cm^2)]$$

The opening ratio described above is preferably 0.1 or less, and more preferably from 0.001 to 0.05. Methods for lowering the opening ratio like this include a method of using a movable lid as described in JP-A-1-82033 and a slit development processing method as described in JP-A-63-216050, in addition to a method of providing a shelter such as a floating lid on a surface of a photographic processing solution in a processing tank. It is desirable to reduce the opening ratio, not only for both the color development and black-and-white development steps, but also for various succeeding steps, for example, bleaching, bleach-fixing, fixing, washing and stabilization. The replenishment rate can also be reduced by using means for depressing accumulation of bromide ions in the developing solution.

Although the color development processing time is usually established between 2 minutes and 5 minutes, the processing time can be further reduced by elevating the temperature, heightening the pH and using the color developing agent at a higher concentration.

After color development, the photographic emulsion layers are generally bleached. Bleaching may be conducted simultaneously with fixing (bleach-fixing), or separately. Further, bleach-fixing may be conducted after bleaching to conduct rapid processing. Furthermore, processing in two successive bleach-fixing baths, fixing before bleach-fixing or fixing after bleach-fixing may also be arbitrarily applied depending on the purpose. As bleaching agents, for example, compounds of polyvalent metals such as iron (III), peroxides (particularly, sodium peroxide is suitable for color negative films for cinematographic use), quinones and nitro compounds are used. Typical examples of the bleaching agents include organic complex salts of iron (III), for example, iron complex salts of aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycoletherdiaminetetraacetic acid; and iron complex salts of, for example, citric acid, tartaric acid and malic acid. Of these, the iron (III) complex salts of organic aminopolycarboxylic acids including ethylenediaminetetraacetic acid iron (III) complex salt and 1,3-diaminopropanetetraacetic acid iron (III) complex salt are preferred from the viewpoints of rapid processing and prevention of environmental pollution. Further, The iron (III) complex salts of organic aminopolycarboxylic acids are particularly useful to both the bleaching solutions and the bleach-fixing solutions. The pH of the bleaching solutions and the bleach-fixing solutions using these iron (III) complex salts of organic aminopolycarboxylic acids is usually from 4.0 to 8.0. However, processing can also be conducted at a lower pH for rapid processing.

Various bleaching promoters can be used in the bleaching solutions, the bleach-fixing solutions and the pre baths thereof as required. Specific examples of useful bleaching promoters include compounds having mercapto groups or disulfide groups described in U.S. Pat. No. 3,893,858, German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-18426 and *Research Disclosure*, No. 17129 (July, 1978); thiazolidine derivatives described in JP-A-50-140129; thiourea derivatives described in JP-B-45-8506, JP-A-52-20832, JP-A-53-32735 and U.S. Pat. No. 3,706,561; iodides described in German Patent 1,127,715 and JP-A-58-16235; polyoxyethylene compounds described in German Patents 966,410 and 2,748,430; and polyamine compounds described in JP-B-45-8836. Furthermore, compounds described in JP-A-49-40943, JP-A-49-59644, JP-A-53-94927, JP-A-54-35727, JP-A-55-26506 and JP-A-58-163940 and bromide ions can be used. The compounds having mercapto groups or disulfide groups are preferred among others from the viewpoint of high promoting effect. In particular, the compounds described in U.S. Pat. No. 3,893,858, German Patent 1,290,812 and JP-A-53-95630 are preferred. Compounds described in U.S. Pat. No. 4,552,884 are also preferred. These bleaching promoters may be added to the photographic materials. When color photographic materials for photographing are subjected to bleach-fixing, these bleaching promoters are particularly effective.

Besides the above-described compounds, organic acids are preferably added to the bleaching solutions and the bleach-fixing solutions, for preventing bleaching stains. Particularly preferred organic acids are compounds having an acid dissociation constant (pKa) of 2 to 5, and specific examples thereof include acetic acid, propionic acid and hydroxyacetic acid.

Fixing agents used in the fixing solutions or the bleach-fixing solutions include, for example, thiosulfates, thiocyanates, thioether compounds, thioureas and large quantities of iodides. Of these, the thiosulfates are generally used, and ammonium thiosulfate is most widely used. It is also preferred that the thiosulfates are used in combination with thiocyanates, thioether compounds or thioureas. As preservatives for the fixing solutions or the bleach-fixing solutions, sulfites, bisulfites, carbonyl bisulfite addition compounds or sulfinic acid compounds described in EP-A-294769 are preferred. Further, various aminopolycarboxylic acids or organic phosphonic acids are preferably added to the fixing solutions or the bleach-fixing solutions, for stabilizing the solutions.

In the present invention, it is preferred that compounds having a pKa of 6.0 o 9.0, preferably imidazoles such as imidazole, 1-methylimidazole, 1-ethylimidazole and 2-methylimidazole, are added in an amount of 0.1 to 10 mol/liter to the fixing solutions or the bleach-fixing solutions for adjusting the pH.

It is preferred that the total time required for the bleaching stage is shorter as long as it does not result in poor desilverization. The time is preferably from 1 to 3 minutes, and more preferably from 1 to 2 minutes. Further, the processing temperature is from 25 to 50° C., and preferably 35 to 45° C. Within the preferred temperature range, the desilverization speed is improved, and generation of stains after processing is effectively prevented.

In the desilverization stage, it is preferred that stirring is strengthened as much as possible. Specific examples of methods for strengthen stirring include a method of colliding a jet stream of a processing solution on an emulsion surface of a photographic material described in JP-A-62-183460, a method of enhancing the stirring effect by use of rotating means described in JP-A-62-183461, a method of moving a photographic material while bringing a wiper blade into contact with an emulsion surface to produce turbulence on the emulsion surface, thereby improving the stirring effect, and a method of increasing the overall circulating flow rate of a processing solution. Such means for improving the stirring effect are effective for all of the bleaching, bleach-fixing and fixing solutions. Improved stirring is considered to hasten the supply of the bleaching solutions and the fixing solutions into emulsion films, resulting in an increase in desilverization speed. The above-described means for improving the stirring effect are more effective when the bleaching promoters are used, by which the promoting effect can be significantly enhanced and the fixing inhibiting action can be removed.

It is preferred that automatic processors used for processing the photographic materials of the present invention have means for transferring photographic materials described in JP-A-60-191257, JP-A-60-191258 and JP-A-60-191259. As described in JP-A-60-191257, such a transferring means can significantly reduce introduction of the processing solution from a prebath to a subsequent bath, and the processing solution is effectively prevented from deteriorations of qualities. Such an effect is particularly effective to shorten the processing time in each stage and to reduce the replenishment rate of the processing solution.

The photographic materials of the present invention are generally subjected to washing and/or stabilization after desilverization. The amount of washing water used in the washing stage can be widely established depending on the characteristics of the photographic materials (for example, materials to be used such as couplers), the use, the temperature of washing water, the number of washing tanks (the number of stages), the countercurrent or direct current replenishment system and other various conditions. Of these, the relationship between the amount of washing water and the number of washing tanks in the multistage countercurrent system can be determined by a method described in *Journal of the Society of Motion Picture and Television Engineers,* 64, 248–253 (May, 1955). According to the multistage countercurrent system described in the above-described literature, the amount of washing water can be noticeably reduced. However, the increased residence time of washing water in the tanks produces the problem that bacteria propagate in water and the resulting suspended matter adheres on the photographic materials. In order to solve such a problem in the processing of the color photographic materials of the present invention, a method for reducing calcium and magnesium ions described in JP-A-62-288838 can be very effectively used. Disinfectants can also be used, which include isothiazolone compounds and thiabendazoles described in JP-A-57-8542; chlorine disinfectants such as chlorinated sodium isocyanurate; and disinfectants such as benzotriazole described in Hiroshi Horiguchi, *Bohkin Bohbaizai no Kagaku* (*Chemistry of Bacteria Prevention and Fungus Prevention*), Sankyo Shuppan (1986), *Biseibutsu no Mekkin, Sakkin, Bohbai Gijutsu* (*Sterilization, Pasteurization and Fungus Prevention Techniques of Microorganisms*), edited by Eisei Gijutsukai, Kogyo Gijutsukai (1982) and *Bokin Bohbaizai Jiten* (*Dictionary of Disinfectants and Fungicides*), edited by Nippon Bohkin Bohbai Gakkai (1986).

The pH of washing water used in the processing of the photographic materials of the present invention is from 4 to 9, and preferably from 5 to 8. The temperature of washing water and the washing time can be variously set according to the characteristics and the use of the photographic materials. In general, however, the washing time is from 20 seconds to 10 minutes at 15 to 45° C., and preferably from 30 seconds to 5 minutes at 25 to 40° C. Further, the photographic materials of the present invention can also be processed directly with the stabilizing solutions, instead of washing described above. In such stabilization, all the known methods described in JP-A-57-8543, JP-A-58-14834 and JP-A-60-220345 can be used.

In some cases, the stabilizing treatment further follows the above-described washing treatment. Examples of such stabilizing treatment include a stabilizing bath containing a dye stabilizer and a surfactant, which is used as a last bath for the color photographic, materials for photographing. Examples of the dye stabilizers include aldehydes such as formalin and glutaraldehyde, N-methylol compounds, hexamethylenetetramine and aldehyde-sulfurous acid adducts. Various chelating agents or antifungal agents can also be added to the stabilizing bath.

Overflowed solutions caused by replenishment of the washing water and/or the stabilizing solutions can be reused in other stages such as the desilverization stage.

For example, when all the above-described processing solutions are concentrated by vaporization in the processing by automatic processors, it is preferable to correct the respective concentrations with water.

Color developing agents may be included in the photographic materials of the present invention to simplify and quicken the processing. For this, various precursors of the color developing agents are preferably used. Examples thereof include indoaniline compounds described in U.S. Pat. No. 3,342,597; Schiff base type compounds described in U.S. Pat. No. 3,342,599, *Research Disclosure*, No. 14,850 and ibid., No. 15,159; aldol compounds described in ibid., No. 13,924; metal salt complexes described in U.S. Pat. No. 3,719,492; and urethane compounds described in JP-A-53-135628.

To promote color development, various 1-phenyl-3-pyrazolidone compounds may be included in the photographic materials of the present invention as required. Typical compounds thereof are described in JP-A-56-64339, JP-A-57-144547 and JP-A-58-115438.

The various processing solutions used in the present invention are used at 10 to 50° C. The standard temperatures are usually from 33 to 38° C. However, the use of higher temperatures can promote the processing to save the time, whereas the use of lower temperatures can improve image quality and stability of the processing solutions.

Further, the silver halide photographic materials of the present invention can also be applied to heat developable light-sensitive materials described in U.S. Pat. No. 4,500,626, JP-A-60-133449, JP-A-59-218443, JP-A-61-238056 and EP-A-210,660.

The silver halide color photographic materials of the present invention exhibit the effect more easily and are effective, when applied to lens-attached film units as described in JP-B-2-32615 and JP-B-U-3-39784 (the term "JP-B-U" as used herein means an "examined Japanese utility model publication").

The silver halide photographic materials of the present invention can also be preferably used as diffusion transfer photographic materials. Most typical examples of the diffusion transfer photographic materials are color diffusion transfer film units, and in a typical example thereof, en image receiving element and a light-sensitive element are laminated on a transparent support, and it is unnecessary to peel off the light-sensitive element from the image receiving element after completion of a transferred image. More specifically, the image receiving element comprises at least one mordant layer, and a preferred embodiment of the light-receiving element is constituted by a combination of a blue-sensitive emulsion layer, a green-sensitive emulsion layer and a red-sensitive emulsion layer, a combination of a green-sensitive emulsion layer, a red-sensitive emulsion layer and an infrared-sensitive layer, a combination of a blue-sensitive emulsion layer, a red-sensitive emulsion layer and an infrared-sensitive layer, or each combination of a yellow dye image forming compound, a magenta dye image forming compound and cyan dye image forming compound with each layer described above. The term "infrared-sensitive emulsion layer" as used herein means an emulsion layer having the spectral sensitivity maximum to light of 700 nm or more, particularly 740 nm or more. A white reflective layer containing a solid pigment such as titanium oxide is provided between the mordant layer and the light-sensitive layer or the dye image forming compound-containing layer so that a transferred image can be viewed through the transparent support.

For making it possible to complete development processing in the dark room, a light-shielding layer may further provided between the white reflective layer and the light-sensitive layer. Further, for enabling the whole or a part of the light-sensitive element to be peeled off from the image receiving element, a peeling layer may be provided in an appropriate part as required. Such embodiments are described in JP-A-56-67840 and Canadian Patent 674,082.

As another lamination and separation type embodiment, there is a color diffusion transfer photographic film unit comprising a white support provided thereon a light-sensitive element having successively (a) a layer having a neutralization function, (b) a dye image receiving layer, (c) a peeling layer and (d) at least one silver halide emulsion layer combined with a dye image forming compound, a light-shielding agent-containing alkali treating composition and a transparent cover sheet, and a layer having a light-shielding function on the side opposite to a side on which the processing composition of the emulsion layer is developed.

In another embodiment in which no peeling is required, the above-described light-sensitive element is formed on one transparent support, a white reflective layer is formed thereon, and an image receiving layer is further formed thereon. U.S. Pat. No. 3,730,718 describes an embodiment in which an image receiving element, a white reflective layer, a light-shielding layer and a light-sensitive element are laminated on the same substrate, and the light-sensitive layer is intentionally peeled off from the image receiving element.

On the other hand, typical forms in which light-sensitive elements and image receiving elements are separately formed on two supports, respectively, are roughly divided into two types, a peeling type and a type requiring no peeling. These are described in detail. In a preferred embodiment of the peeling type film unit, at least one image receiving layer is formed on one support, a light-sensitive element is formed on a support having a light-shielding layer, and a coating face of a light-sensitive layer and a coating face of a mordant layer do not face each other before completion of exposure. However, the coating face of the light-sensitive layer is thought out to be reversed in an image formation apparatus to come into contact with the coating face of the image receiving layer after completion of exposure (during development processing). After a transferred image is completed on the mordant layer, the light-sensitive element is rapidly peeled off from the image receiving element.

In a preferred embodiment of the film unit of the type requiring no peeling, at least one mordant layer is formed on a transparent support, a light-sensitive layer is formed on a transparent support or a support having a light-shielding layer, and a coating face of a light-sensitive layer is overlaid with a coating face of the mordant layer, facing each other.

A container which contains an alkaline processing solution and can be ruptured by pressure (processing element) may be combined with the above-described forms. Above all, in the film unit of the type requiring no peeling in which the image receiving element and the light-sensitive element are laminated on one support, this processing element is preferably arranged between the light-sensitive element and a cover sheet superimposed thereon. In the form in which the light-sensitive elements and the image receiving elements are separately formed on two supports, respectively, the processing elements are preferably arranged between the light-sensitive elements and the image receiving elements in development processing at the latest. It is preferred that the processing element contains either or both of a light-shielding agent (such as carbon black or a dye varying in color according to the pH) and a white pigment (such as titanium oxide), depending on the form of film unit. Further, in the color diffusion transfer film unit, a neutralization timing mechanism comprising a combination of a neutralization layer and a neutralization timing layer is preferably integrated into the cover sheet, the image receiving element or the light-sensitive element.

The dye image forming substances used in the present invention are non-diffusible compounds releasing diffusible dyes (or dye precursors) with respect to silver development or compounds whose diffusibility varies, which are described in *The Theory of the Photographic Process*, the fourth edition. These compounds are all represented by the following formula (XVIII):

$$(\text{DYE}-\text{Y})_n\text{-Z} \qquad \text{(XVIII)}$$

wherein DYE represents a dye group, a dye group temporarily shortened in wavelength or a dye precursor; Z represents a group having a property of allowing the difference in diffusibility of the compound represented by $(\text{DYE}-\text{Y})_n$-Z to occur with respect to silver development, or releasing DYE and allowing the difference in diffusibility between DYE released and $(\text{DYE}-\text{Y})_n$-Z; n represents 1 or 2, and when n is 2, two (DYE−Y)'s may be the same or different.

Based on the function of Z, these compounds are roughly divided into negative type compounds which become diffusible in silver-developed portions and positive type compounds which become diffusible in undeveloped portions.

Specific examples of the negative type Z groups include groups which are oxidized as a result of development and cleaved to release diffusible dyes.

Specific examples of the Z groups are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322 and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56-164342 and JP-A-57-119345.

Of the Z groups of the negative type dye releasing redox compounds, particularly preferred groups include N-substituted sulfamoyl groups (wherein N-substituted groups are groups derived from aromatic hydrocarbon rings or hetero rings) Typical examples of the Z groups are shown below, but they are not limited thereto.

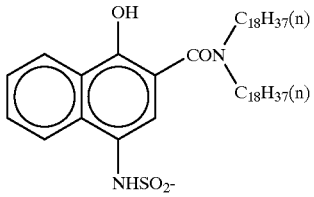

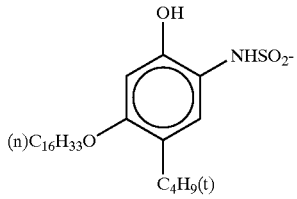

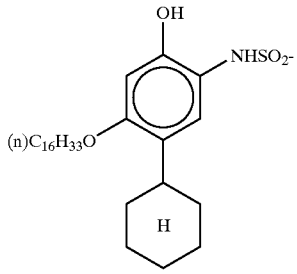

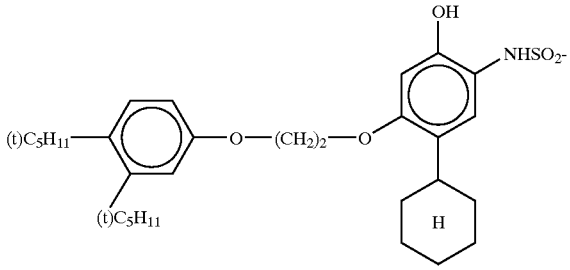

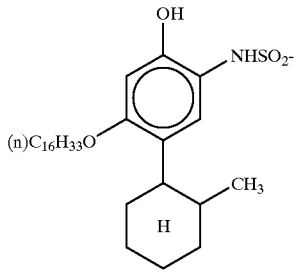

The positive type compounds are described in *Angev. Chem. Int. Ed. Engl.,* 22, 191 (1982).

Specific examples thereof include compounds (dye developing agents) which are at first diffusible under alkaline conditions, but oxidized by development to become non-diffusible. Typical Z groups effective for the compounds of this type are described in U.S. Pat. No. 2,983,606.

Further, the positive type compounds include compounds of another type which release diffusible dyes by self ring closure under alkaline conditions, but substantially not cease to release the dyes upon oxidation by development. Specific examples of the Z groups having such a function are described in U.S. Pat. No. 3,980,479, JP-A-53-69033, JP-A-54-130927, U.S. Pat. Nos. 3,421,964 and 4,199,355.

Furthermore, the positive type compounds include compounds of a further type which do not themselves release dyes, but release dyes upon reduction. The compounds of this type are used in combination with electron donors and can release the diffusible dyes imagewise by reaction with the remainder of the electron donors oxidized imagewise by silver development. Atomic groups having such a function are described, for example, in U.S. Pat. Nos. 4,183,753, 4,142,891, 4,278,750, 4,139,379 and 4,218,368, JP-A-53-110827, U.S. Pat. Nos. 4,278,750, 4,356,249 and 4,358,535, JP-A-53-110827, JP-A-54-130927, JP-A-56-164342, Journal of Technical Disclosure 87-6199 and EP-A-220746.

Specific examples thereof are shown below, but they are not limited thereto.

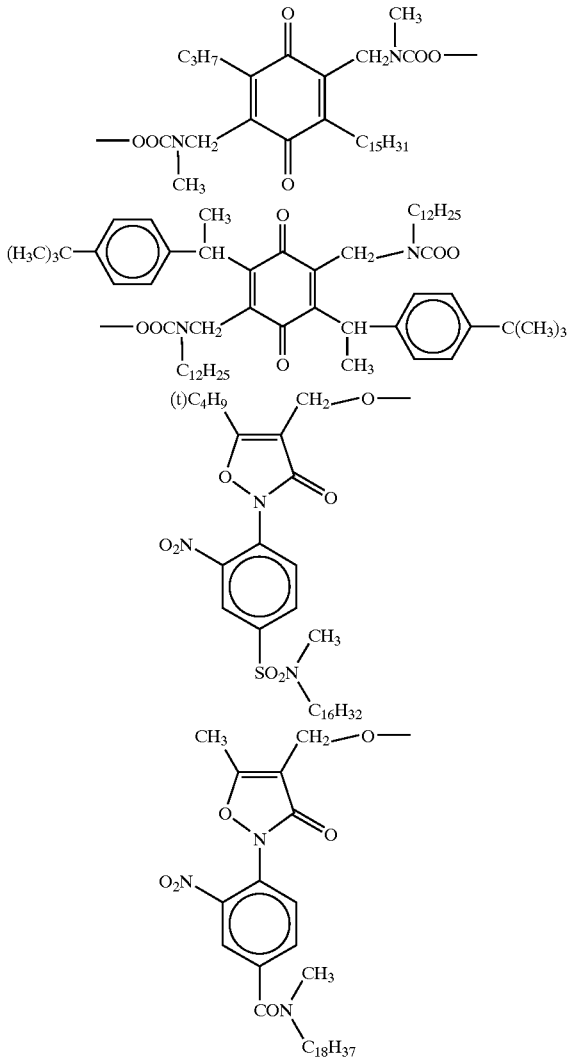

When the compounds of this, type are used, they are preferably used in combination with anti-diffusible electron donor compound (well known as ED compounds) or precursors thereof Examples of the ED compounds are described in U.S. Pat. Nos. 4,263,393 and 4,278,750 and JP-A-56-138736.

As specific examples of dye image forming substances of still another type, the following compounds can also be used:

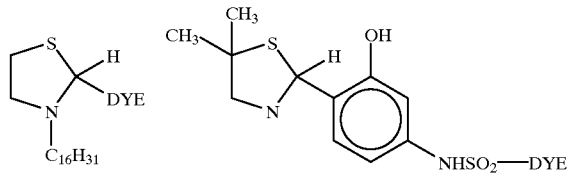

Details thereof are described in U.S. Pat. Nos. 3,719,489 and 4,098,783.

On the other hand, specific examples of the dyes represented by DYE of the above-described formula are described in the following literatures:

Examples of yellow dyes:

U.S. Pat. Nos. 3,597,200, 3,309,199, 4,013,633, 4,245,028, 4,156,609, 4,139,383, 4,195,992, 4,148,641, 4,148,643 and 4,336,622, JP-A-51-114930, JP-A-56-71072, *Research Disclosure*, No. 17630 (1978) and ibid., No. 16475 (1977)

Examples of magenta dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134

Examples of cyan dyes:

U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure*, No. 17630 (1978) and ibid., No. 16475 (1977)

These compounds can be dispersed by a method described in JP-A-62-215272, pages 144 to 146. These dispersions may contain compounds described in JP-A-62-215272, pages 137 to 144.

EXAMPLE

Examples are shown below for describing the present invention in more detail, but are not to be construed as limiting the present invention.

Example 1

Synthesis of Compound (I-1)

Compound (I-1) was synthesized according to the following scheme 1:

Scheme 1

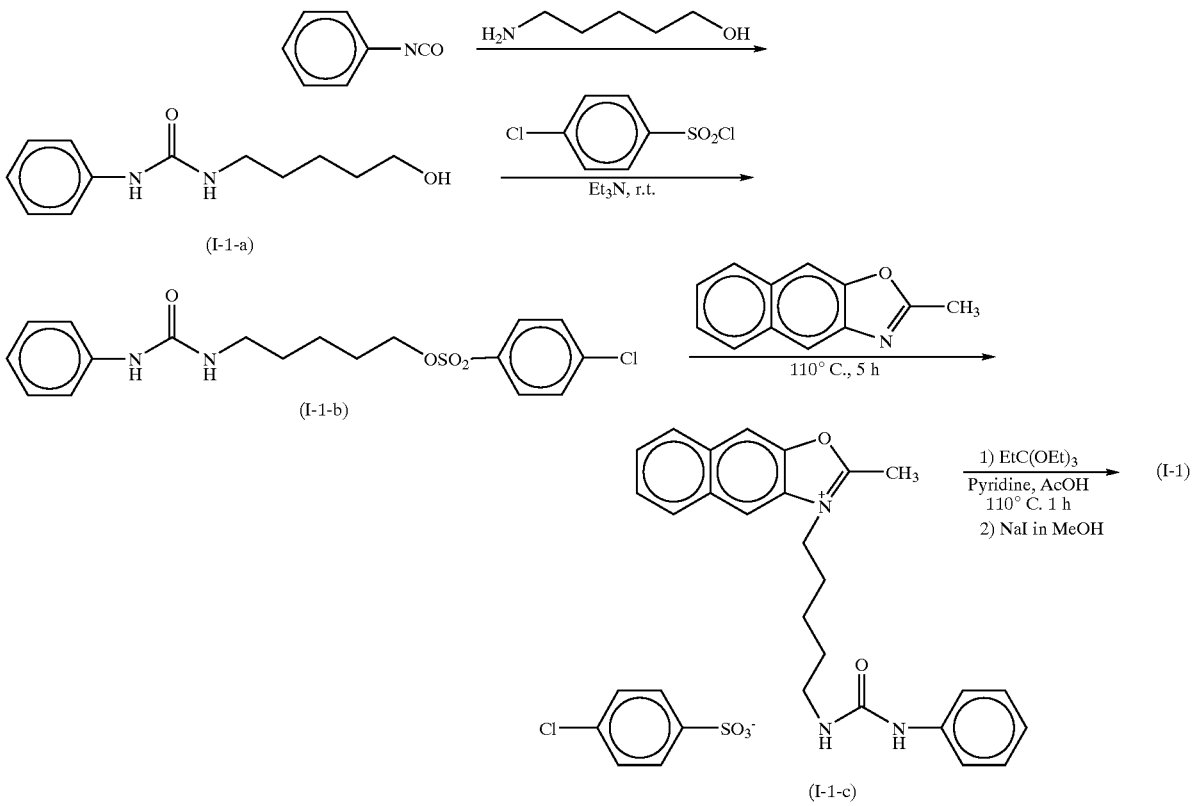

Synthesis of Compound (I-1-a)

Compound (I-1-a) can be synthesized from commercially available phenyl isocyanate and 5-amino-1-pentanol in a good yield.

Synthesis of Compound (I-1-b)

Compound (I-1-a) (6.0 g) was dissolved in 40 ml of triethylamine, and the resulting solution was stirred under ice cooling. Then, 9.0 g of 4-chlorobenzenesulfonyl chloride was added in parts thereto little by little. After completion of addition, the temperature of the solution was elevated to room temperature, and stirred at room temperature for 2 hours. Water was added to the reaction solution, which was extracted with ethyl acetate. After successively washed with water, 0.2 M aqueous hydrochloric acid, a saturated aqueous solution of sodium bicarbonate and a saturated saline solution, the resulting organic layer was dried on anhydrous magnesium sulfate and dried. Then, the solvent was removed by distillation to obtain a crude product of compound (I-1-b). This was recrystallized from an ethyl acetate-hexane solvent, thereby obtaining 8.9 g of compound (I-1-b) in an 83% yield.

Synthesis of Compound (1-1)

Compound (I-1) (3.0 g) and 1.7 g of 2-methyl-5,6-benzobenzoxazole were stirred at 110° C. for 5 hours. The reaction solution was allowed to cool, and when the internal temperature reached about 60° C., 150 ml of ethyl acetate was added thereto. After stirring at room temperature for 1 hour, the solution was allowed to stand, and separated oily matter was taken out by decantation. After the same washing operation with ethyl acetate was repeated twice, the oily matter was dried under reduced pressure. Thus, a composition of compound (I-1-c) was obtained. Then, 4 ml of triethyl orthopropionate, 6 ml of pyridine and 2 ml of acetic acid were successively added thereto, followed by stirring at an external temperature of 110° C. for 1 hour. After the reaction solution was allowed to cool to near room temperature, 70 ml of ethyl acetate and 80 ml of hexane were added, and stirred at room temperature to separate oily matter. This oily matter was taken out by decantation, and purified by silica gel column chromatography ($SiO_2$: 80 g, solvent: dichloromethane/methanol=30 to 10). The resulting chlorobenzenesulfonate was dissolved in methanol, and a solution of NaI in methanol was added thereto, thereby precipitating crystals, which were filtered and dried to obtain 0.22 g of compound (I-1) (solution absorption (MeOH) $\lambda_{max}$=516.2 nm, $\epsilon$=1.61×10$^5$)

Example 2

Synthesis of Compound (I-2)

Compound (I-2) was synthesized according to the following scheme 2:

Synthesis of Compound (I-2-a)

6-Bromocapryl chloride (6.3 g) in 50 ml toluene was gradually added dropwise to 5 g of p-chlorophenylurea synthesized from p-chlorophenyl isocyanate and ammonium, and after completion of dropping, the mixture was stirred at room temperature for 30 minutes. Thereafter, the external temperature was elevated to 110° C., followed by stirring at 100° C. for 3 hours with bubbling nitrogen gas. Then, 50 ml of toluene was added thereto, and the mixture was allowed to stand and cooled to room temperature. Crystals precipitated were filtered, and the resulting crystals were washed with hexane, followed by drying under reduced pressure, thereby obtaining 7.65 g of compound (1-2-a) in a 75% yield.

Synthesis of Compound (I-2-b)

A mixture of 5.0 g of compound (1-2-a) and 1.9 g of 2-methyl-5,6-benzobenzoxazole was stirred at 130° C. for 5 hours, and allowed to cool. Then, 100 ml of ethyl acetate was added, and stirred at room temperature for 2 hours. Crystals were collected by filtration, washed with ethyl acetate, and dried under reduced pressure, thereby obtaining 2.36 g of compound (I-2-b) in a 51% yield.

Synthesis of Compound (I-2)

Compound (I-2-b) (2.3 g), 4 ml of triethyl orthopropionate, 6 ml of pyridine and 2 ml of acetic acid were mixed, and stirred at an external temperature of 120° C. for 1 hour. After cooling, 100 ml of ethyl acetate and 50 ml of hexane were added to the mixture to separate a viscous liquid, which was taken out by decantation. The viscous liquid was similarly washed twice, and ethyl acetate and hexane were thoroughly removed. Then, 20 ml of methanol was added to precipitate crystals, which were collected by filtration. Methanol was added to the crystals again, and 2 ml of trietylamine was added thereto. When the mixture was stirred, the crystals were dissolved. The resulting solution was filtered in this state to remove dust, and the filtrate was Scheme 2

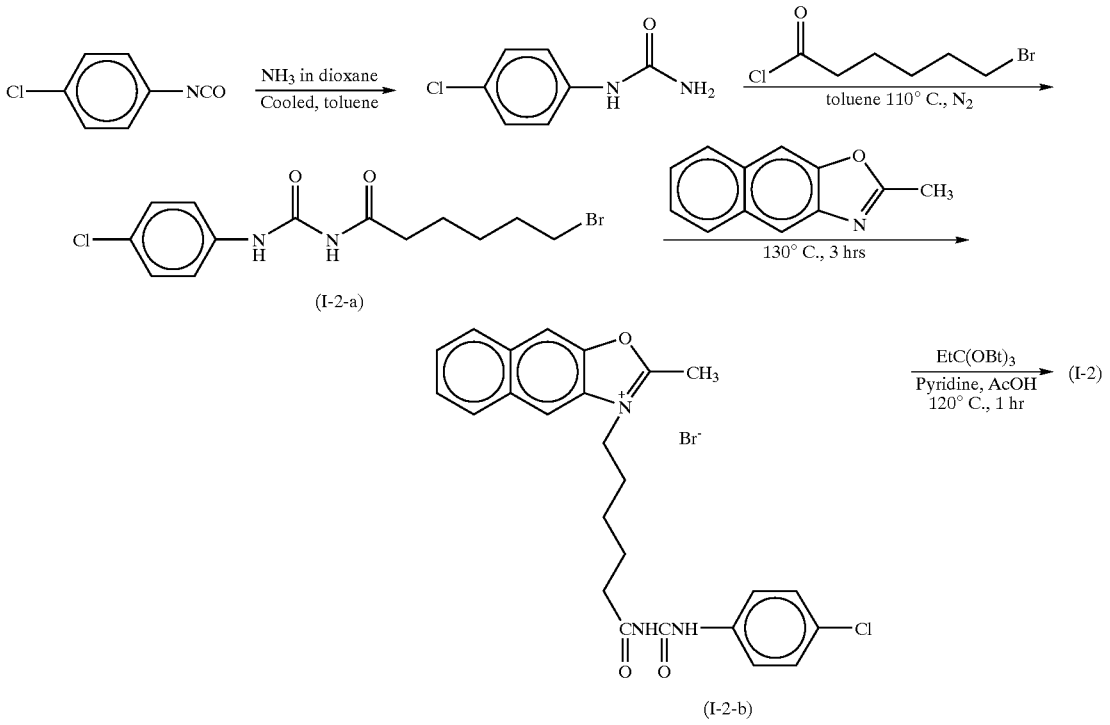

concentrated under reduced pressure, thereby removing methanol to about 40 ml. Although crystals were precipitated at this time, 2 ml of acetic acid was further added and the solution was cooled to allow the crystals to be completely precipitated. Then, the crystals were filtered, washed with methanol, and dried under reduced pressure, thereby obtaining 0.43 g of compound (I-2) (solution absorption (MeOH) $\lambda_{max}$=515.5 nm, $\epsilon$=1.21×10$^5$, pKa1=7.48, pKa2=10.27) in a 20% yield.

Example 3

Preparation of Octahedral Silver Bromide Emulsion (Emulsion A) and Tabular Silver Bromide Emulsion (Emulsions B and C)

In a reaction vessel, 1000 ml of water, 25 g of deionized bone gelatin, 15 ml of a 50% aqueous solution of $NH_4NO_3$ and 7.5 ml of a 25% aqueous solution of $NH_3$ were placed, and thoroughly stirred keeping the temperature at 50° C. Then, 750 ml of a 1 N aqueous solution of silver nitrate and a 1 mol/liter aqueous solution of potassium bromide were added for 50 minutes, and the silver potential was kept at −40 mV during the reaction. The resulting silver bromide grains were octahedral, and had a sphere-corresponding diameter (i.e., an equivalent sphare diameter) of 0.846±0.036 $\mu$m. The temperature of the above-described emulsion was lowered, and a copolymer of isobutene and monosodium maleate was added thereto as a flocculating agent to sediment grains, which were washed with water and desalted. Then, 95 g of deionized bone gelatin and 430 ml of water were added thereto, and the pH and the pAg were adjusted to 6.5 and 8.3, respectively, at 50° C. Thereafter, potassium thiocyanate, chloroauric acid and sodium thiosulfate were added to conduct ripening at 55° C. for 50 minutes so as to give an optimum sensitivity. This emulsion was taken as emulsion A.

Potassium bromide (6.4 g) and 6.2 g of low molecular weight gelatin having an average molecular weight of 15,000 or less were dissolved in 1.2 liters of water, and 8.1 ml of a 16.4% aqueous solution of silver nitrate and 7.2 ml of a 23.5% aqueous solution of potassium bromide were added thereto for 10 seconds with keeping the temperature thereof at 30° C. by the double jet method. Then, a 11.7% aqueous solution of gelatin was further added, and the temperature was elevated to 75° C. After ripening for 40 minutes, 370 ml of a 32.2% aqueous solution of silver nitrate and a 20% aqueous solution of potassium bromide were added for 10 minutes with keeping the silver potential at −20 mV, and after physical ripening for 1 minute, the temperature was lowered to 35° C. Thus, a pure monodisperse tabular silver bromide grain emulsion (specific gravity: 1.15) having an average projected area diameter of 2.32 $\mu$m, a thickness of 0.09 $\mu$m and a coefficient of variation for diameter of 15.1% was obtained. Then, soluble salts were removed by the flocculation precipitation method. The temperature was maintained at 40° C. again, and 45.6 g of gelatin, 10,ml of a 1 mol/liter aqueous solution of sodium hydroxide, 167 ml of water and 1.66 ml of 35% phenoxyethanol were added to adjust the pAg and the pH to 8.3 and 6.20, respectively.

Potassium thiocyanate, chloroauric acid and sodium thiosulfate were added to this emulsion to conduct ripening at 55° C. for 50 minutes so as to give an optimum sensitivity. The resulting emulsion was taken as emulsion B. An emulsion chemically sensitized with potassium thiocyanate, chloroauric acid, pentafluorophenyl-diphenylphosphine selenide and sodium thiosulfate, in place of potassium thiocyanate, chloroauric acid and sodium thiosulfate, was taken as emulsion C. When the dye-occupying area was 80 Å$^2$, the monolayer saturated coating amounts of emulsions A and B were 5.4×10$^{-4}$ and 1.42×10$^{-3}$ mol/mol Ag, respectively.

Each of first dyes shown in Table 1 was added to each of the emulsions obtained as described above with keeping the temperature thereof at 50° C., followed by stirring for 30 minutes. Then, second and third dyes shown in Table 1 were each continuously added, followed by further stirring at 50° C. for 30 minutes.

TABLE 1

| | Emulsion | First Dye (amount added, mol/mol Ag) | Second Dye (amount added, mol/mol Ag) | Third Dye (amount added, mol/mol Ag) |
|---|---|---|---|---|
| Comparison 1 | B | Dye 1 (1.56 × 10$^{-3}$) | | |
| Comparison 2 | B | Dye 1 (1.56 × 10$^{-3}$) | Dye 1 (1.56 × 10$^{-3}$) | Dye 3 (1.56 × 10$^{-3}$) |
| Invention 1 | B | I-1 (1.56 × 10$^{-3}$) | I-1 (3.12 × 10$^{-3}$) | |
| Invention 2 | C | 1-3 (1.56 × 10$^{-3}$) | 1-3 (1.56 × 10$^{-3}$) | Dye 4 (1.56 × 10$^{-3}$) |

Dye 1

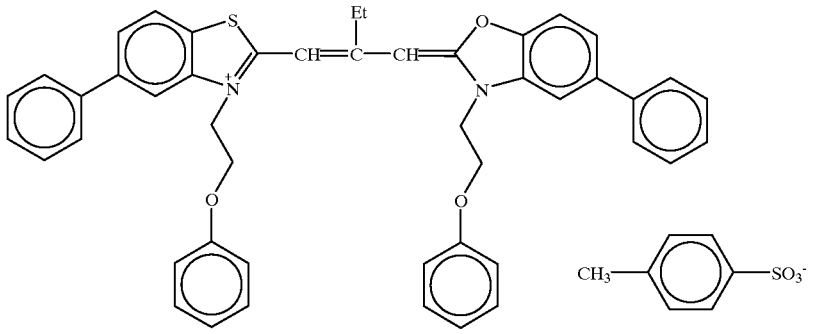

TABLE 1-continued

| Emulsion | First Dye (amount added, mol/mol Ag) | Second Dye (amount added, mol/mol Ag) | Third Dye (amount added, mol/mol Ag) |
|---|---|---|---|
| Dye 2 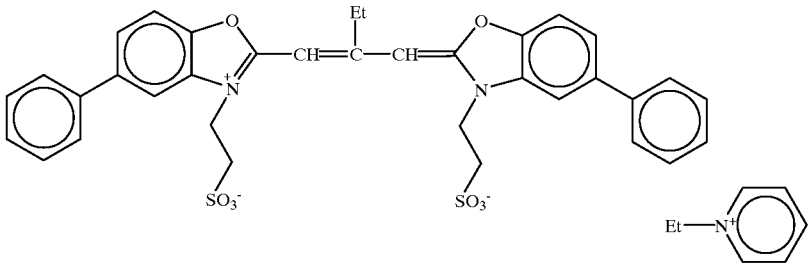 | | | |
| Dye 3 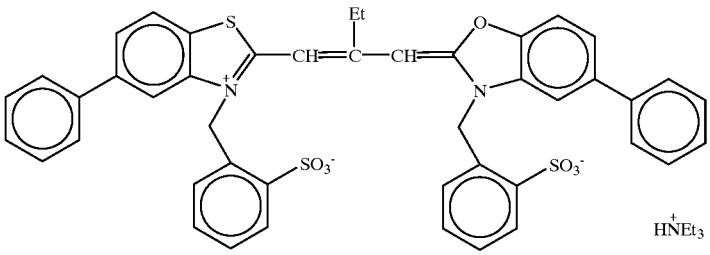 | | | |
| Dye 4 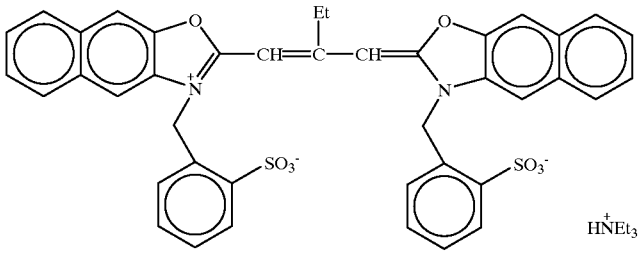 | | | |
| Dye 5 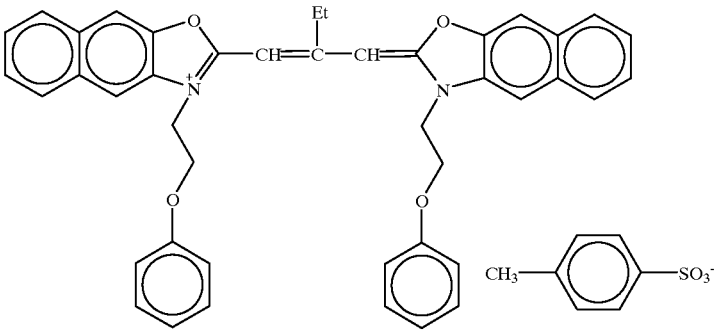 | | | |

The dye adsorption was determined by subjecting the resulting liquid emulsion to centrifugal sedimentation at 10,000 rpm for 10 minutes, freeze drying the precipitate, adding 25 ml of a 25% aqueous solution of sodium thiosulfate and methanol to 0.05 g of the precipitate to bring the volume of 50 ml, and analyzing the resulting solution by high performance liquid chromatography to determine the dye concentration.

As to measurement of the light absorption intensity per unit area, an absorption spectrum was determined by thinly applying the resulting emulsion onto a slide glass, and measuring a transmission spectrum and a reflection spectrum of each grain by the following method using an MSP65 microspectrophotometer manufactured by Karl Zweiss Co., Ltd. A reference for the transmission spectrum was determined by measuring a portion where no grain is present, and a reference for the reflection spectrum was determined by measuring silicon carbide whose reflectance was know. A measuring portion was a circular aperture portion having a diameter of 1 $\mu$m, and the transmission spectrum and the reflection spectrum were measured in the wave number region of 14000 $cm^{-1}$ (714 nm) to 28000 $cm^{-1}$ (357 nm), adjusting the position so that the aperture portion did not overlap with a contour of the grain. Taking 1-T (transmittance)-R(reflectance) as absorptivity A, the absorption spectrum was determined. The absorption of the silver halide was subtracted to give absorptivity A', and ½ of a value obtained by integrating -Log (1-A') to the wave number ($cm^{-1}$) was taken as the light absorption intensity per unit area. The integration range was from 14000 $cm^{-1}$ to 28000 $cm^{-1}$. In this case, a tungsten lamp was used as a light source, and the voltage of the light source was 8 V. In order to minimize damages of the dye caused by light irradiation, a primary monochromator was used the wavelength distance was set to 2 nm, and the slit width to 2.5 nm.

The infinite diffusion reflectance of the completed emulsion at the time when reference was made to an emulsion in which no dye was added was converted by the Kubelka-Munk's equation to obtain the absorption spectrum of only the dye of the emulsion.

Further, the spectral sensitivity of a coating film was determined from an exposure showing a density of fog+0.2, exposing the coating film with a spectral exposure apparatus adjusted so that the number of photons of respective wavelengths in the exposure wavelength region became the same.

A gelatin hardener and a coating aid were further added to the resulting emulsion, and concurrently applied onto a cellulose acetate film support together with a gelatin protective layer so as to give an amount of silver coated of 3.0 g $Ag/m^2$. The resulting film was exposed to a tungsten lamp (color temperature: 2854 K) for 1 second through a continuous wedge color filter. Using as a color filter a Fuji gelatin filter SC-50 (manufactured by Fuji Photo Film Co., Ltd.) for minus blue exposure exciting the dye side, light of 50 nm or less was shut off to irradiate the sample. The exposed sample was developed at 20° C. for 10 minutes using the following surface developing solution MA-1.

Surface Developing Solution MAA-1

| | |
|---|---|
| Metol | 2.5 g |
| L-Ascorbic Acid | 10 g |
| Nabox (Fuji Photo Film Co., Ltd.) | 35 g |
| Potassium Bromide | 5 g |
| Water to make | 1 liter |
| pH | 9.8 |

For the developed film, the optical density was measured with a Fuji automatic densitometer, and the sensitivity was the reciprocal of an amount of light required to give an optical density of fog+0.2, and a value taking as 100 the sensitivity when only dye 1 was added.

Results thereof are shown in Table 2.

TABLE 2

| | Adsorption (1) ($10^{-3}$ mol/mol Ag) | Number of Adsorption Layers | Light Absorption Intensity (2) | Absorption Width (3) (80% of Amax) | Absorption Width (3) (50% of Amax) | Spectral Sensitivity Width (80% of Smax) | Spectral Sensitivity Width (50% of Smax) | Minus Blue Sensitivity (4) | Residual Color (5) |
|---|---|---|---|---|---|---|---|---|---|
| Comparison 1 | 1.44 | 1.00 | 99 | 19 | 77 | 31 | 79 | 100 | C |
| Comparison 2 | 3.01 | 2.09 | 189 | 83 | 127 | 58 | 131 | 180 | C |
| Invention 1 | 3.20 | 2.21 | 209 | 25 | 94 | 43 | 96 | 202 | A |
| Invention 2 | 3.18 | 2.21 | 207 | 24 | 92 | 41 | 94 | 205 | A |

(1) The total of adsorptions of respective dyes
(2) Light absorption intensity determined by microspectrophotometry
(3) A value determined from a diffusion reflection spectrum of an emulsion and a spectrum after conversion by the Kubelka-Munk's equation
(4) Sensitivity at the time when the sensitivity of only dye 1 (Comparison 1) was taken as 100
(5) The residual color was evaluated according to three grades: A (relatively good), C (relatively poor) and B (intermediate between A and C).

According to the present invention; both the first layer dye and the second and later layer dyes formed J-associated products, showed a sharp absorption waveform and spectral sensitivity distribution, and could have a high sensitivity only in a desired wavelength region. Further, not only the color separation was good and the color reproducibility was improved, but also both the residual color and the sensitivity were improved.

Also for emulsion A, similar effects were confirmed.

Example 4

Based on a method for preparing an octahedral internal latent image type direct positive emulsion, which is described in Example 1 of JP-A-2000-284442, a pure octahedral internal latent image type direct positive silver bromide emulsion was prepared in which silver bromide grains had a projected area-corresponding circular diameter (i.e., an equivalent circle diameter) of 0.56 $\mu$m.

This emulsion had a specific gravity of 1.10, a silver content of 61.7 g per kg of emulsion, and a gelatin content of 4.85%.

Dyes shown in Table 3 were added to this emulsion with keeping the temperature of the emulsion at 60° C.

TABLE 3

| | First Dye (amount added, mol/mol Ag) | Second Dye (amount added, mol/mol Ag) |
|---|---|---|
| Comparison 3 | Dye 1 ($0.74 \times 10^{-3}$) | Dye 5 ($1.48 \times 10^{-3}$) |
| Comparison 4 | Dye 1 ($0.74 \times 10^{-3}$) | Dye 5 ($1.48 \times 10^{-3}$) |
| Invention 3 | Dye 1 ($0.74 \times 10^{-3}$) | I-1 ($1.48 \times 10^{-3}$) |

For the emulsions, the adsorption of the sensitizing dyes was measured in the same manner as described in Example 3, and each of the emulsions was applied onto a cellulose acetate film support to prepare a sample for examining the photographic properties.

The coated samples thus prepared were exposed in the same manner as described in Example 3, bleached at 20° C. for 3 minutes with a bleaching solution described below, and developed at 20° C. for 3 minutes and 30 seconds with a total developing solution described below.

The sensitivity was determined in accordance with the method described in Example 3, and indicated by the reciprocal of an amount of light required to give an optical density of fog+0.1, and a value taking as 100 the sensitivity when only the first dye of Comparison 3 was added.

Results obtained are shown in Table 4.

Bleaching Solution

| | |
|---|---|
| Phenosafranine | 0.0123 g |
| Hot Water | 75 ml |
| After dissolution | |
| Water | 875 ml |
| Potassium Ferricyanide | 3.0 g |
| Water to make | 1000 ml |

Total Developing Solution

| | |
|---|---|
| Metol | 2.2 g |
| Sodium Sulfite | 96.0 g |
| Hydroquinone | 8.8 g |
| Sodium Carbonate Monohydrate | 56.0 g |
| Potassium Bromide | 5.0 g |
| Potassium Iodide | 0.5 g |
| Water to make | 1000 ml |

TABLE 4

| | Adsorption (mmol/mol Ag) | Number of Adsorption Layers | Light Absorption Intensity | Sensitivity |
|---|---|---|---|---|
| Comparison 3 | 1.51 | 1.91 | 171 | 188 |
| Comparison 4 | 1.54 | 1.93 | 169 | 179 |
| Invention 3 | 2.01 | 2.54 | 218 | 208 |

When only the first dye of Comparison 3 was added, the adsorption was 0.7 mmol/mol Ag, the number of adsorption layers was 0.9, and the light absorption intensity was 76.

As shown in Table 4, the present invention provided adsorption, the number of adsorption layers, light absorption intensity and spectral sensitivity higher than those of the dyes for comparison.

According to the present invention, both the first layer sensitizing dye and the second and later layer sensitizing dye could form J-associated products, could be adsorbed in multiple layers, and could be spectrally sensitized within a narrow wavelength range.

Example 5

Based on a method for preparing a hexagonal tabular internal latent image type direct positive emulsion T, which is described in Example 1 of JP-A-2000-284442, a hexagonal tabular internal latent image type direct positive silver bromide emulsion (5-0) was prepared in which silver bromide grains had a projected area-corresponding circular diameter of 2.20 μm and a thickness of 0.38 μm.

The first dyes shown in Table 5 were each added to the emulsion maintained at 60° C., and stirred for 30 minutes. Then, the temperature thereof was lowered to 40° C., and a nucleating agent, 2-{4-[3-(3-phenylthioureido) benzoylamino]phenyl}-1-formylhydrazine, was added thereto in an amount of 0.061 mmol per mol of silver. After 5 minutes, the second dyes were each added, and stirred for 15 minutes to prepare emulsions 5-1 to 5-3. The adsorption of the sensitizing dyes of these emulsions was measured in the same manner as described in Example 1.

Then, sample 5-0 for comparison was prepared in the same manner as with light-sensitive element 101 for comparison described in Example 1 of JP-A-2000-284442 with the exception that the thirteenth layer was removed and emulsion A-1 of the fourteenth layer was replaced by the above-described emulsion 5-0.

In the preparation of sample 5-0, emulsions 5-1 to 5-3 previously prepared were each used in place of the emulsion and the nucleating agent of the fourteenth layer to prepare samples 5-1 to 5-3, respectively.

TABLE 5

| | Emulsion | First Dye (amount added, mol/mol Ag) | Second Dye (amount added, mol/mol Ag) | Adsorption (mol/mol Ag) | Number of Adsorption Layers | Light Absorption Intensity ($cm^{-1} \times mol/cm^2$) |
|---|---|---|---|---|---|---|
| Comparison 6 | 5-1 | Dye 1 (0.38) | Not added | 0.36 | 0.88 | 76 |
| Comparison 7 | 5-2 | Dye 1 (0.38) | Dye 5 (0.38)<br>Dye 4 (0.38) | 1.11 | 2.58 | 224 |
| Invention 5 | 5-3 | Dye 1 (0.38) | I-3 (0.76) | 1.19 | 2.93 | 253 |

The samples prepared were exposed and spreading-developed at 25° C. by the method described in Example 1 of JP-A-2000-284442 described above, and then, the transfer magenta density was measured with a color densitometer to determine the sensitivity. The sensitivity was also determined by the method described in Example 1 of JP-A-2000-284442 described above, and indicated by a relative value taking the sensitivity of sample 5-0 as 100. Results obtained are shown in Table 6.

TABLE 6

| | Sample | Emulsion | Relative Sensitivity |
|---|---|---|---|
| Comparison 5 | 5-0 | 5-0 | 100 |
| Comparison 6 | 5-1 | 5-1 | 71 |
| Comparison 7 | 5-2 | 5-2 | 209 |
| Invention 5 | 5-3 | 5-3 | 228 |

In each of samples 5-0 and 5-1 for comparison, only the first dye was added. Accordingly, the amount of the sensitizing dyes added was lower than the monolayer saturated adsorption, resulting in low light absorption intensity and sensitivity. Further, sample 5-3 of the present invention was higher in light absorption intensity and sensitivity than sample 5-2 for comparison. According to sample 5-3 of the present invention, both the first layer sensitizing dye and the second and later layer sensitizing dye could form J-associated products, and could be spectrally sensitized within a narrow wavelength range.

As described above, according to the present invention, substantial increases in light absorption intensity and sensitivity were also obtained in the diffusion transfer color photographic materials constituted by multiple layers.

Example 6

According to the preparation of sample 101 of a multiple-layer color photographic material described in Example 5 of JP-A-8-29904, similar samples were prepared.

In the preparation of the samples, emulsion H of the ninth layer of sample 101 described in Example 5 of JP-A-8-29904 was replaced by the emulsions described in Example 3 of the present invention. That is to say, ExS-4,ExS-5 and Ex-6 added in Example 5 of JP-A-8-29904 were replaced by the emulsion for comparison used in Comparison 2 and the emulsion used in Invention 2, respectively, described in Example 3 of the present invention to prepare sample 6-1 and sample 6-2, respectively.

The samples thus prepared were exposed using a Fuji FW type sensitometer (manufactured by Fuji Photo Film Co., Ltd.) through an optical wedge and a green filter for 1/100 second, and subjected to color development processing using the same processing processes and processing solutions as with Example 1 of JP-A-8-29904, followed by measurement of the magenta density. Results obtained are shown in Table 7. The sensitivity was expressed by the reciprocal of an exposure amount required to give an optical density of fog+0.2, and indicated by a relative value based on the sensitivity of sample 6-1.

TABLE 7

| Sample | Emulsion | Relative Sensitivity | Residual Color* | Note |
|---|---|---|---|---|
| 6-1 | Comparison 2 | 100 (reference) | C | Comparison |
| 6-2 | Invention 2 | 138 | A | Invention |

●The residual color was evaluated according to three grades:
A (relatively good),
C (relatively poor) and
B (intermediate between A and C).

The adsorption on surfaces of the silver halide grains in multiple layers according to the constitution of the present invention could substantially increase the sensitivity as shown in Table 7, even when the emulsion substantially increased in the adsorption of the sensitizing dye was applied to the negative type multiple-layer color photographic material. Further, according to sample 6-2, both the first layer sensitizing dye and the second and later layer sensitizing dye could form J-associated products, and could be spectrally sensitized within a narrow wavelength range. Furthermore, the residual color was also improved.

In addition, even when the emulsion of the present invention was applied to various silver halide photographic materials such as an X-ray photographic material, a reversal multiple-layer color photographic material and a heat developable multiple-layer color photographic material, results approximately similar to the results shown in Examples 3 to 6 described above were obtained.

Example 7

In sample 108 of Japanese Patent Application No. 11-268662, the sensitizing dye of emulsion P of the eleventh layer was changed to methine compound I-2 of the present invention, and dye addition, chemical sensitization and evaluation were carried out in the same manner as with Example 3, which revealed that effects similar to those of Example 3 of the present invention were obtained.

Similarly, in sample 108 of Japanese Patent Application No. 11-268662, the sensitizing dye of emulsion P of the eleventh layer was changed to methine compound I-5 of the present invention. As a result, effects similar to those of Example 3 were obtained.

Also in color photographic materials containing emulsions in which the sensitizing dyes of the present invention were adsorbed in multiple layers, the present invention proved to be useful.

Example 8

Similarly to Example 3, evaluation was made in a color negative photographic material system of Example 5 of JP-A-8-29904, a color reversal photographic material system of JP-A-7-92601 and Example 1 of JP-A-11-160828, a color paper system of Example 1 of JP-A-6-347944, an X-ray photographic material system of Example 1 of JP-A-8-122954, an instant photographic material system of Example 1 of JP-A-2000-284442, a heat developable photographic material system of Example 1 of Japanese Patent Application No. 2000-89436 and a printing photographic material system of Example 1 of JP-A-8-292512. As a result, effects similar to those of Example 3 were obtained, and the present invention proved to be similarly useful.

Example 9

Each of first dyes shown in Table 8 was added to each of emulsions B and C prepared in the same manner as with Example 3 with keeping the temperature thereof at 50° C., followed by stirring for 30 minutes. Then, second and third dyes shown in Table 8 were each continuously added, followed by further stirring at 50° C. for 30 minutes. The adsorption of dyes, the light adsorption intensity per unit area, absorption spectra of emulsions and the spectral sensitivity of coating films were determined in the same manner as with Example 3.

TABLE 8

| | Emulsion | First Dye (amount added, mol/mol Ag) | Second Dye (amount added, mol/mol Ag) | Third Dye (amount added, mol/mol Ag) |
|---|---|---|---|---|
| Comparison 9 | B | Dye 1 ($1.56 \times 10^{-3}$) | | |
| Comparison 10 | B | Dye 1 ($1.56 \times 10^{-3}$) | Dye 1 ($1.56 \times 10^{-3}$) | Dye 3 ($1.56 \times 10^{-3}$) |
| Invention 7 | B | I-15 ($2.34 \times 10^{-3}$) | I-16 ($2.34 \times 10^{-3}$) | Not added |
| Invention 8 | C | I-15 ($1.56 \times 10^{-3}$) | I-16 ($3.12 \times 10^{-3}$) | I-16 ($1.56 \times 10^{-3}$) |

A gelatin hardener and a coating aid were further added to each of the resulting emulsions, and concurrently applied onto a cellulose acetate film support together with a gelatin protective layer so as to give an amount of silver coated of 3.0 g Ag/$m^2$. The resulting films were exposed to a tungsten lamp (color temperature: 2854 K) for 1 second through a continuous wedge color filter. Further, the resulting films were treated under the following forced deterioration treatment conditions I to III, and then, similarly exposed.

Forced deterioration treatment condition I: temperature; 50° C., humidity; 80%, for 3 days Forced deterioration treatment condition II: temperature; 60° C., humidity; 30%, for 3 days Forced deterioration treatment condition III: temperature; 30° C., humidity; 80%, for 3 months Using as a color filter a Fuji gelatin filter SC-50 (manufactured by Fuji Photo Film Co., Ltd.) for minus blue exposure exciting the dye side, light of 50 nm or less was shut off to irradiate the samples. The exposed samples were developed at 20° C. for 10 minutes using the surface developing solution MAA-1 used in Example 3.

For the developed films, the optical density was measured with a Fuji automatic densitometer, and the sensitivity was the reciprocal of an amount of light required to give an optical density of fog+0.2, and a value taking as 100 the sensitivity when only dye 1 was added.

Results thereof are shown in Table 9.

(1) The total of adsorptions of respective dyes (2) Light absorption intensity determined by microspectrophotometry (3) A value determined from a diffusion reflection spectrum of an emulsion and a spectrum after conversion by the Kubelka-Munk's equation (4) Sensitivity at the time when the sensitivity of only dye 1 (Comparison 1) was taken as 100

(5) Forced deterioration was performed under the following conditions. The sensitivity was indicated by a relative value taking the sensitivity of a fresh film of Comparison 1 as 100 for each case.

Forced deterioration condition I: temperature; 50° C., humidity; 80%, for 3 days (wet)

Forced deterioration condition II: temperature; 60° C., humidity; 30%, for 3 days (dry)

Forced deterioration condition III: temperature; 30° C., humidity; 80%, for 3 months Based on a method for preparing an octahedral internal latent image type direct positive emulsion, which is described in Example 1 of JP-A-2000-284442, a pure octahedral internal latent image type direct positive silver bromide emulsion was prepared in which silver bromide grains had a projected area-corresponding circular diameter of 0.56 μm.

This emulsion had a specific gravity of 1.10, a silver content of 61.7 g per kg of emulsion, and a gelatin content of 4.85%.

Dyes shown in Table 10 were added to this emulsion with keeping the temperature of the emulsion at 60° C.

TABLE 10

| | First Dye (amount added, mol/mol Ag) | Second Dye (amount added, mol/mol Ag) |
|---|---|---|
| Comparison 11 | Dye 1 ($0.74 \times 10^{-3}$) | Dye 5 ($1.48 \times 10^{-3}$) |
| Comparison 12 | Dye 1 ($0.74 \times 10^{-3}$) | Dye 5 ($1.48 \times 10^{-3}$) |
| Invention 9 | I-15 ($1.11 \times 10^{-3}$) | I-16 ($1.11 \times 10^{-3}$) |

For the emulsions, the adsorption of the sensitizing dyes was measured in the same manner as described in Example 9, and each of the emulsions was applied onto a cellulose acetate film support to prepare a sample for examining the photographic properties.

For the coated samples thus prepared, fresh samples and samples treated under forced deterioration treatment conditions I to III were exposed in the same manner as described in Example 9, bleached at 20° C. for 3 minutes with a bleaching solution described below, and developed at 20° C. for 3 minutes and 30 seconds with a total developing solution described below.

TABLE 9

| | Adsorption (1) | Number of | Photographic Properties of Fresh Film | | | | | | Minus Blue Sensitivity after Forced Deterioration Treatment (5) | | |
|---|---|---|---|---|---|---|---|---|---|---|---|
| | | | Light Absorption | Absorption Width (3) | | Spectral Sensitivity Width | | Minus Blue | | | |
| | ($10^{-3}$ mol/mol Ag) | Adsorption Layers | Intensity (2) | (80% of Amax) | (50% of Amax) | (80% of Smax) | (50% of Smax) | Sensitivity (4) | Condition I | Condition II | Condition III |
| Comparison 9 | 1.44 | 1.00 | 99 | 19 | 77 | 31 | 79 | 100 | 76 | 82 | 95 |
| Comparison 10 | 3.01 | 2.09 | 189 | 83 | 127 | 58 | 131 | 180 | 92 | 121 | 165 |
| Invention 7 | 3.41 | 2.37 | 239 | 24 | 95 | 42 | 95 | 229 | 192 | 209 | 220 |
| Invention 8 | 3.81 | 2.65 | 258 | 31 | 96 | 45 | 97 | 241 | 209 | 230 | 238 |

The sensitivity was determined in accordance with the method described in Example 9, and indicated by the reciprocal of an amount of light required to give an optical density of fog+0.1, and a value taking as 100 the sensitivity when only the first dye of Comparison 3 was added.

Results obtained are shown in Table 11.

Bleaching Solution

| | |
|---|---|
| Phenosafranine | 0.0123 g |
| Hot Water | 75 ml |
| After dissolution | |
| Water | 875 ml |
| Potassium ferricyanide | 3.0 g |
| Water to make | 1000 ml |

Total Developing Solution

| | |
|---|---|
| Metol | 2.2 g |
| Sodium Sulfite | 96.0 g |
| Hydroquinone | 8.8 g |
| Sodium Carbonate Monohydrate | 56.0 g |
| Potassium Bromide | 5.0 g |
| Potassium Iodide | 0.5 g |
| Water to make | 1000 ml |

TABLE 11

| | Absorption (mmol/mol Ag) | Number of Adsorption Layers | Light Absorption Intensity | Sensitivity of Fresh Sample | Sensitivity after Forced Deterioration* I | II | III |
|---|---|---|---|---|---|---|---|
| Comparison 11 | 1.51 | 1.91 | 171 | 188 | 88 | 103 | 153 |
| Comparison 12 | 1.54 | 1.93 | 169 | 179 | 93 | 104 | 145 |
| Invention 9 | 2.58 | 2.43 | 238 | 217 | 181 | 193 | 201 |

*Forced deterioration treatment conditions I to III are the same as shown in Table 9.

When only the first dye of Comparison 11 was added, the adsorption was 0.7 mmol/mol Ag, the number of adsorption layers was 0.9, and the light absorption intensity was 76.

As shown in Table 11, the present invention provided adsorption, the number of adsorption layers, light absorption intensity and spectral sensitivity higher than those of the dyes for comparison.

According to the present invention, both the first layer sensitizing dye and the second and later layer sensitizing dye could form J-associated products, and could be adsorbed in multiple layers. The storage stability was also improved.

Example 11

Based on a method for preparing a hexagonal tabular internal latent image type direct positive emulsion T, which is described in Example 1 of JP-A-2000-284442, a hexagonal tabular internal latent image type direct positive silver bromide emulsion (11-0) was prepared in which silver bromide grains had a projected area-corresponding circular diameter of 2.20 μm and a thickness of 0.38 μm.

The first dyes shown in Table 12 were each added to the emulsion maintained at 60° C., and stirred for 30 minutes. Then, the temperature thereof was lowered to 40° C., and a nucleating agent, 2-{4-[3-(3-phenylthioureido) benzoylamino]phenyl}-1-formylhydrazine, was added thereto in an amount of 0.061 mmol per mol of silver. After 5 minutes, the second dyes were each added, and stirred for 15 minutes to prepare emulsions 11-1 to 11-3. The adsorption of the sensitizing dyes of these emulsions was measured in the same manner as described in Example 1.

Then, sample 11-0 for comparison was prepared in the same manner as with light-sensitive element 101 for comparison described in Example 1 of JP-A-2000-284442 with the exception that the thirteenth layer was removed and emulsion A-1 of the fourteenth layer was replaced by the above-described emulsion 11-0.

In the preparation of sample 11-0, emulsions 11-1 to 11-3 previously prepared were each used in place of the emulsion and the nucleating agent of the fourteenth layer to prepare samples 11-1 to 11-3, respectively.

TABLE 12

| | Emulsion | First Dye (amount added, mol/mol Ag) | | Second Dye (amount added, mol/mol Ag) | | Adsorption (mol/mol Ag) | Number of Adsorption Layers | Light Absorption Intensity ($cm^{-1} \times mol/cm^2$) |
|---|---|---|---|---|---|---|---|---|
| Comparison 13 | 11-1 | Dye 1 | (0.38) | Not added | | 0.36 | 0.88 | 76 |
| Comparison 14 | 11-2 | Dye 1 | (0.38) | Dye 5 | (0.38) | 1.11 | 2.58 | 224 |
| | | | | Dye 4 | (0.38) | | | |
| Invention 10 | 11-3 | I-15 | (0.57) | I-16 | (0.57) | 1.41 | 3.92 | 279 |

For the samples thus prepared, fresh samples and samples treated under forced deterioration treatment conditions I to III were exposed and developed at 25° C. by the method described in Example 1 of JP-A-2000-284442 described above, and then, the transfer magenta density was measured with a color densitometer to determine the sensitivity. The sensitivity was also determined by the method described in Example 1 of JP-A-2000-284442 described above, and indicated by a relative value taking the sensitivity of sample 11-0 as 100. Results obtained are shown in Table 13.

TABLE 13

| | Sample | Emulsion | Relative Sensitivity | Relative Sensitivity after Forced Deterioration* | | |
|---|---|---|---|---|---|---|
| | | | | I | II | III |
| Comparison 15 | 11-0 | 11-0 | 100 | 51 | 70 | 81 |
| Comparison 16 | 11-1 | 11-1 | 71 | 23 | 33 | 65 |
| Comparison 17 | 11-2 | 11-2 | 209 | 90 | 101 | 153 |
| Invention 11 | 11-3 | 11-3 | 248 | 203 | 211 | 243 |

•Forced deterioration treatment conditions I to III are the same as shown in Table 9.

In each of samples 11-0 and 11-1 for comparison, only the first dye was added. Accordingly, the amount of the sensitizing dyes added was lower than the monolayer saturated adsorption, resulting in low light absorption intensity and sensitivity. Further, sample 11-3 of the present invention was higher in light absorption intensity and sensitivity than sample 11-2 for comparison. According to sample 11-3 of the present invention, both the first layer sensitizing dye and the second and later layer sensitizing dye could form J-associated products, and could be spectrally sensitized within a narrow wavelength range. As described above, according to the present invention, substantial increases in light absorption intensity and sensitivity were also obtained in the diffusion transfer color photographic materials constituted by multiple layers, and the storage stability was also improved.

Example 12

According to the preparation of sample 101 of a multiple-layer color photographic material described in Example 5 of JP-A-8-29904, similar samples were prepared.

In the preparation of the samples, emulsion H of the ninth layer of sample 101 described in Example 5 of JP-A-8-29904 was replaced by the emulsions described in Example 3 of the present invention. That is to say, ExS-4, ExS-5 and Ex-6 added in Example 5 of JP-A-8-29904 were replaced by the emulsion for comparison used in Comparison 10 and the emulsion used in Invention 8, respectively, described in Example 9 of the present invention to prepare sample 12-1 and sample 12-2, respectively.

For the samples thus prepared, fresh samples and samples treated under forced deterioration treatment conditions I to III described in Example 9 of the present invention were exposed using a Fuji FW type sensitometer (manufactured by Fuji Photo Film Co., Ltd.) through an optical wedge and a green filter for 1/100 second, and subjected to color development processing using the same processing processes and processing solutions as with Example 1 of JP-A-8-29904, followed by measurement of the magenta density. Results obtained are shown in Table 14. The sensitivity was expressed by the reciprocal of an exposure amount required to give an optical density of fog+0.2, and indicated by a relative value based on the sensitivity of sample 12-1.

TABLE 14

| Sample | Emulsion | Sensitivity of Fresh Sample | Sensitivity after Forced Deterioration* | | |
|---|---|---|---|---|---|
| | | | I | II | III |
| 12-1 | Comparison 10 | 100 (reference) | 83 | 89 | 96 |
| 12-2 | Invention 8 | 127 | 121 | 123 | 126 |

•Forced deterioration treatment conditions I to III are the same as shown in Table 9.

The adsorption on surfaces of the silver halide grains in multiple layers according to the constitution of the present invention could substantially increase the sensitivity as shown in Table 14, even when the emulsion substantially increased in the adsorption of the sensitizing dye was applied to the negative type multiple-layer color photographic material. Further, according to sample 12-2, both the first layer sensitizing dye and the second and later layer sensitizing dye could form J-associated products, and could be spectrally sensitized within a narrow wavelength range. Furthermore, the storage stability was also improved.

Example 13

Similarly to Example 9, evaluation was made in a color reversal photographic material system of JP-A-7-92601 and Example 1 of JP-A-11-160828, a color paper system of Example 1 of JP-A-6-347944, an X-ray photographic material system of Example 1 of JP-A-8-122954, a heat developable photographic material system of Example 1 of Japanese Patent Application No. 2000-89436 and a printing photographic material system of Example 1 of JP-A-8-292512. As a result, effects similar to those of Example 9 were obtained, and the present invention proved to be similarly useful.

The use of the photographic emulsions of the present invention provides photographic materials not only having desired absorption and sensitivity waveform, and high sensitivity, but also more improved in residual color and storage stability than conventional photographic materials of multiple-layer adsorption.

While the present invention has been described in detail and with reference to specific embodiments thereof, it will be apparent to one skilled in the art that various changes and modifications can be made therein without departing from the spirit and scope thereof.

What is claimed is:

1. A silver halide photographic emulsion comprising silver halide grains and methine dye compounds, wherein said methine dye compounds are adsorbed on the silver halide grains in multiple dye layers containing at least a first dye layer and a second dye layer, and the methine dye compound in each dye layer has in a molecule thereof at least one atomic group in which the two groups represented by formulas (I) and (II) are adjacent to each other or adjacent to each other through an atom:

$$X—H \quad (I)$$

wherein X represents an atom electrically more negative than a carbon atom, $$Y \quad (II)$$

wherein Y represents an atom electrically more negative than a carbon atom, and has one or more lone electron pairs, wherein said methine dye compound has in a molecule thereof at least one atomic group in which at least three groups selected from the group consisting of groups represented by formulas (I) and (II) are adjacent to each other or adjacent to each other through another atom, other than an atomic group represented by the following formula (III), (IV), or (V):

(III)

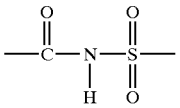

(VI)

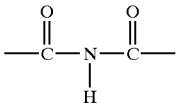

(V)

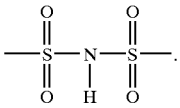

2. The silver halide photographic emulsion as in claim 1, wherein said methine compound further has in a molecule thereof at least one aromatic group not conjugated with a dye chromophoric group.

3. The silver halide photographic emulsion as in claim 1, wherein said methine compound has a basic nucleus obtained by cyclocondensation of three or more rings.

4. The silver halide photographic emulsion as in claim 1, wherein said methine compound is a cyanine dye.

5. The silver halide photographic emulsion as in claim 4, wherein said methine compound is a methine compound in which said atomic group containing at least one group represented by formulae (1) and (2) is contained in a group substituted at the N-position.

6. The silver halide photographic emulsion as in claim 1, wherein said multiple dye layers comprise at least one kind of methine dye having a site which can form three or more complementary hydrogen bonds between molecules of a single or more kinds of dyes.

7. The silver halide photographic emulsion as in claim 6, wherein at least one methine dye compound having at least one structure site represented by the following formula (VI) in a molecule thereof as a substituent group is used in combination with at least one methine dye compound having at least one structure site represented by the following formula (VII) in a molecule thereof as a substituent group:

(VI)

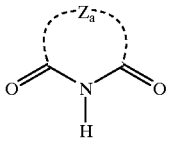

wherein Za represents an atomic group necessary to form a 5- or 6-membered nitrogen-containing heterocyclic ring, (VII)

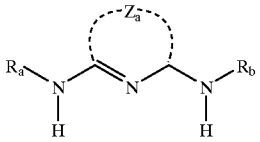

wherein Zb represents an atomic group necessary to form a 5- or 6-membered nitrogen-containing heterocyclic ring, and Ra and Rb each represents a hydrogen atom or a substituent group.

8. The silver halide photographic emulsion as in claim 7, wherein said nitrogen-containing heterocyclic ring formed by Za represented by formula (VI) is barbituric acid or cyanuric acid.

9. The silver halide photographic emulsion as in claim 7, wherein said nitrogen-containing heterocyclic ring formed by Zb represented by formula (VII) is melamine.

10. The silver halide photographic emulsion according to claim 1, wherein adsorption energy (ΔG) of the dye contained in a second and later layers is 20 kJ/mol or more.

11. The silver halide photographic emulsion as in claim 1, wherein excitation energy of the dye contained in the second and later layers is transferred to the dye contained in the first layer at an efficiency of 10% or more.

12. The silver halide photographic emulsion as in claim 1, wherein all dyes adsorbed on surfaces of silver halide grains contained in the first and later layers show J-band absorption.

13. The silver halide photographic emulsion as in claim 1, wherein said silver halide grains have a spectral absorption maximum wavelength of less than 500 nm and a light absorption intensity of 60 or more, or a spectral absorption maximum wavelength of 500 nm or more and a light absorption intensity of 100 or more.

14. The silver halide photographic emulsion as in claim 1, wherein when the maximum value of spectral absorptivity due to the sensitizing dye of the emulsion is taken as Amax, the wavelength distance between the shortest wavelength showing 50% of Amax and the longest wavelength is 120 nm or less.

15. The silver halide photographic emulsion as in claim 1, wherein said methine dye compound used in the emulsion is subjected by J-association.

16. The silver halide photographic emulsion as in claim 1, wherein said methine dye compound used in the emulsion is subjected to J-association in a 10% or less aqueous solution of gelatin.

17. A silver halide photographic material which comprises a silver halide photographic emulsion comprising silver halide grains and methine dye compounds, wherein said methine dye compounds are adsorbed on the silver halide grains in multiple dye layers containing at least a first dye layer and a second dye layer, and the methine dye compound in each dye layer has in a molecule thereof at least one atomic group in which the two groups represented by formulas (I) and (II) are adjacent to each other or adjacent to each other through another atom:

X—H (I)

wherein X represents an atom electrically more negative than a carbon atom,

Y (II)

wherein Y represents an atom electrically more negative than a carbon atom, and has one or more lone electron pairs, wherein said methine dye compound has in a molecule thereof at least one atomic group in which at least three groups selected from the group consisting of groups represented by formulas (I) and (II) are adjacent to each other or adjacent to each other through another atom, other than an atomic group represented by the following formula (III), (IV), or (V):

(III)

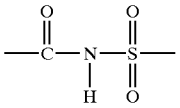

(VI)

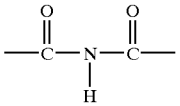

-continued (V)

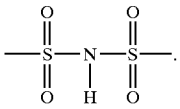

18. The silver halide photographic emulsion according to claim 1, wherein said at least one atomic group is selected from the group consisting of urea, a carboxylic acid anhydride, a sulfonic acid ester, a sulfonic acid amide, an alkoxycarbonylamino group, a carbamoyloxy group, an orthoester group, a carbonyihydrazino group, a 2-oxazolidinone ring, a 2-imidazolidinone ring, a carbonic acid ester group, a triazane group, a triazene group, a 2,6-diaminopyridino group, a 2-aminopyridino group, a 2-(acylamino)pyridino group, acylthiourea, a cyclic or chain diacyihydrazido group, a cyclic or chain acylurea, uracil, oxazolidinedione, a tetraaminomethylene group, (pyridine-2-yl)urea, barbituric acid, an azodicarboxylic acid monoester and diester, melamine, parabanic acid, 2,6-(diacylamino)pyridine, carbamoylurea and acylcarbamoylurea.

* * * * *